US009910391B2

(12) United States Patent
Nishizawa et al.

(10) Patent No.: US 9,910,391 B2
(45) Date of Patent: Mar. 6, 2018

(54) IMAGE HEATING APPARATUS

(71) Applicant: CANON KABUSHIKI KAISHA, Tokyo (JP)

(72) Inventors: Yuki Nishizawa, Yokohama (JP); Shizuma Nishimura, Suntou-gun (JP); Shinji Hashiguchi, Mishima (JP); Koji Uchiyama, Mishima (JP); Mahito Yoshioka, Numazu (JP); Hiroshi Kita, Mishima (JP); Akira Kuroda, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/104,511

(22) PCT Filed: Dec. 10, 2014

(86) PCT No.: PCT/JP2014/083322
§ 371 (c)(1),
(2) Date: Jun. 14, 2016

(87) PCT Pub. No.: WO2015/093497
PCT Pub. Date: Jun. 25, 2015

(65) Prior Publication Data

US 2016/0313683 A1 Oct. 27, 2016

(30) Foreign Application Priority Data

Dec. 18, 2013 (JP) ..... 2013-261516

(51) Int. Cl.
*G03G 15/20* (2006.01)

(52) U.S. Cl.
CPC ..... *G03G 15/2053* (2013.01); *G03G 15/2042* (2013.01); *G03G 2215/2035* (2013.01)

(58) Field of Classification Search
CPC combination set(s) only.
See application file for complete search history.

(56) References Cited

U.S. PATENT DOCUMENTS 6,087,641 A * 7/2000 Kinouchi ..... G03G 15/2064 219/619
2004/0037597 A1* 2/2004 Haseba ..... G03G 15/2053 399/328

(Continued)

FOREIGN PATENT DOCUMENTS

JP S51120451 A 10/1976
JP 59-33788 A 2/1984

(Continued)

*Primary Examiner* — Clayton E Laballe
*Assistant Examiner* — Jas Sanghera
(74) *Attorney, Agent, or Firm* — Canon U.S.A., Inc. IP Division

(57) ABSTRACT

An image heating apparatus for heating an image formed on a recording material includes a tubular rotary member including a conductive layer, a magnetic core inserted into a hollow portion of the rotary member, a coil helically wound around an outer side of the magnetic core in the hollow portion, and a control unit configured to control a frequency of an alternating current flowing through the coil, in which the conductive layer generates heat by an electromagnetic induction in an alternating magnetic field formed when the alternating current flows through the coil, and the control unit controls the frequency in accordance with a size of the recording material.

20 Claims, 39 Drawing Sheets

(56) References Cited

U.S. PATENT DOCUMENTS

| | | | |
|---|---|---|---|
| 2005/0173415 | A1 | 8/2005 | Yamamoto |
| 2013/0119052 | A1 | 5/2013 | Yamamoto |

FOREIGN PATENT DOCUMENTS

| | | | |
|---|---|---|---|
| JP | 2000029332 | A | 1/2000 |
| JP | 2002040872 | A | 2/2002 |
| JP | 2004157503 | A | 6/2004 |
| JP | 2005010184 | A | 1/2005 |
| JP | 2005100699 | A | 4/2005 |
| JP | 2005208469 | A | 8/2005 |
| JP | 2006293079 | A | 10/2006 |
| JP | 2009229696 | A | 10/2009 |

* cited by examiner

IMAGE HEATING APPARATUS

TECHNICAL FIELD

The present invention relates to an image heating apparatus of an electromagnetic induction heating system and an image forming apparatus provided with this image heating apparatus.

BACKGROUND ART

Image heating apparatuses of an electromagnetic induction heating system have been proposed as image heating apparatuses mounted to image forming apparatuses such as a copier and a printer of an electrophotographic system, and these image heating apparatuses have such advantages that warming-up time is short, and power consumption is also low.

PTL 1 discloses an image heating apparatus that is provided with a tubular member formed of a conductive material in a magnetic circuit through which an alternating magnetic flux passes and is configured to heat up the tubular member by Joule's heat generated in the tubular member by inducing a current to the tubular member.

However, the image heating apparatus disclosed in PTL 1 has a problem that the apparatus is provided with a core having a closed shape outside a heating rotary member, and a size of the apparatus is accordingly increased.

CITATION LIST

Patent Literature

PTL 1 Japanese Patent Laid-Open No. 51-120451

SUMMARY OF INVENTION

According to a first aspect of the invention, there is provided an image heating apparatus for heating an image formed on a recording material, the image heating apparatus including: a tubular rotary member including a conductive layer; a magnetic core inserted into a hollow portion of the rotary member; a coil helically wound around an outer side of the magnetic core in the hollow portion; and a control unit configured to control a frequency of an alternating current flowing through the coil, in which the conductive layer generates heat by an electromagnetic induction in an alternating magnetic field formed when the alternating current flows through the coil, and the control unit controls the frequency in accordance with a size of the recording material.

According to a second aspect of the invention, there is provided an image heating apparatus for heating an image formed on a recording material, the image heating apparatus including: a tubular rotary member including a conductive layer; a magnetic core inserted into a hollow an outer side of the magnetic core in the hollow portion; and a control unit configured to control a frequency of an alternating current flowing through the coil, in which the conductive layer generates heat by an electromagnetic induction in an alternating magnetic field formed when the alternating current flows through the coil, and the control unit controls the frequency in accordance with the number of the recording materials on which the image is heated.

According to a third aspect of the invention, there is provided an image heating apparatus for heating an image formed on a recording material, the image heating apparatus including a tubular rotary member including a conductive layer; a magnetic core inserted into a hollow portion of the rotary member; a coil helically wound around an outer side of the magnetic core in the hollow portion; and a control unit configured to control a frequency of an alternating current flowing through the coil, in which the conductive layer generates heat by an electromagnetic induction in an alternating magnetic field formed when the alternating current flows through the coil, and the control unit controls a heat generation distribution of the rotary member in a generatrix direction of the rotary member by changing the frequency.

Further features of the present invention will become apparent from the following description of exemplary embodiments with reference to the attached drawings.

DESCRIPTION OF EMBODIMENTS

First Embodiment

1. Regarding Image Forming Apparatus

Figure 1:
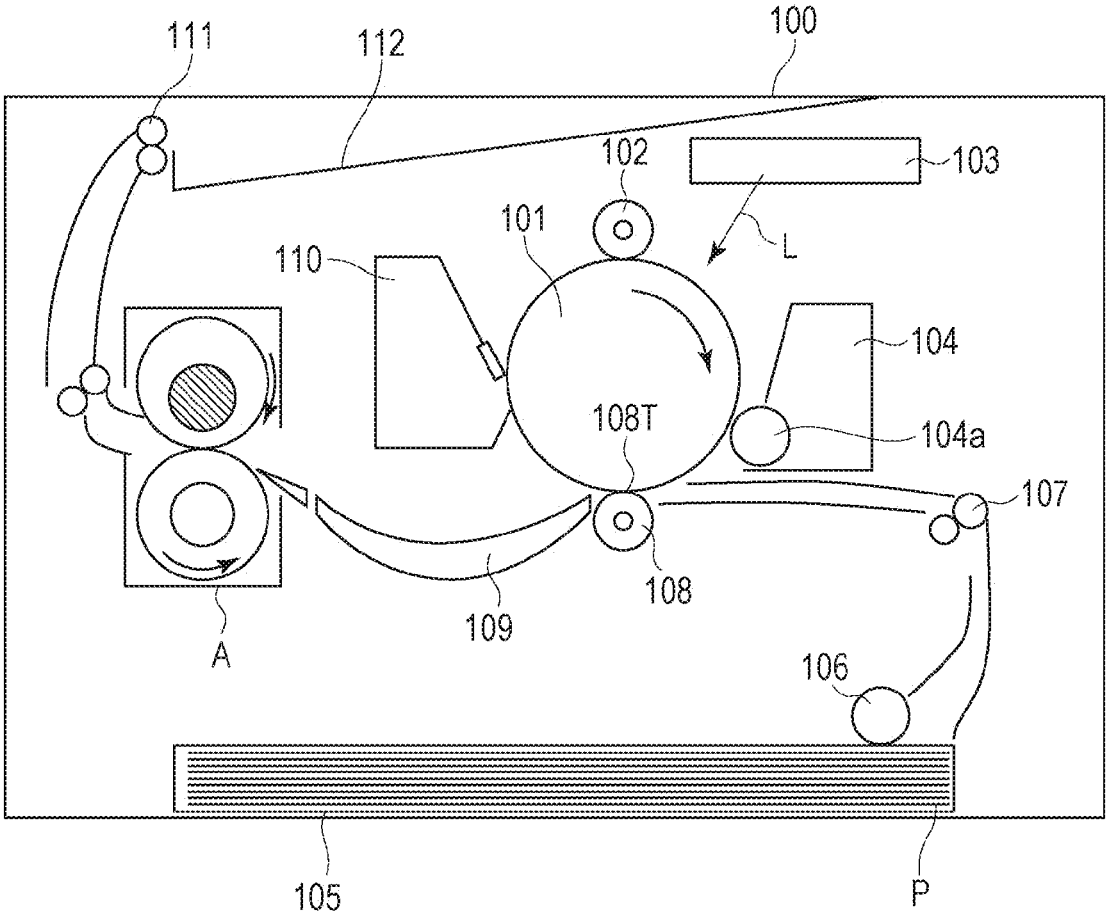
FIG. 1 is a schematic configuration diagram of an image forming apparatus provided with an image heating apparatus according to a first embodiment.

FIG. 1 illustrates an electrophotographic system laser beam printer as an image forming apparatus 100 provided with an image heating apparatus according to the present embodiment. A photosensitive drum 101 functions as an image bearing member and is rotated and driven at a predetermined process speed (peripheral velocity) in a clockwise direction as indicated by an arrow. The photosensitive drum 101 is uniformly charged at a predetermined polarity and a potential in its rotational process by a charging roller 102. A scanner 103 is a laser beam scanner functioning as an exposure unit. The scanner 103 outputs laser light L that has been input from an external device such as a computer (not illustrated) and ON/OFF modulated corresponding to a digital image signal generated by an image processing unit and performs scanning exposure on a charging processing surface of the photosensitive drum 101. With this scanning exposure, charge at an exposure bright section on the surface of the photosensitive drum 101 is removed, and an electrostatic latent image corresponding to the image signal is formed on the surface of the photosensitive drum 101. In a developing apparatus 104, developer (toner) is supplied to the surface of the photosensitive drum 101 from a developing' roller 104*a*, and electrostatic latent images on the surface of the photosensitive drum 101 are sequentially developed as toner images corresponding to transferrable images. Recording materials P are loaded and accommodated in a sheet feeding cassette 105. A sheet feeding roller 106 is driven on the basis of a sheet feeding start signal, and the recording materials P in the sheet feeding cassette 105 are separated to feed one sheet each. Then, the recording material P is introduced into a transfer nip part. 108T formed by the photosensitive drum 101 and a transfer roller 108 via a registration roller pair 107 at a predetermined timing. That is, conveyance of the recording material P is controlled by the registration roller pair 107 in a manner that a leading edge part of the toner image on the photosensitive drum 101 and a leading edge part of the recording material P reach the transfer nip part 108T at the same time. Thereafter, the recording material P is nipped and conveyed through the transfer nip part 108T, and during that period, a transfer voltage (transfer bias) controlled in a predetermined manner is applied from a transfer bias, applying power supply (not illustrated) to the transfer roller 108. The transfer bias having a polarity opposite to the toner is applied to the transfer roller 108, and the toner image on the surface of the photosensitive drum 101 side is electrostatically transferred onto a surface of the recording material P in the transfer nip part 108T. The recording material P after the transfer is separated from the surface of the photosensitive drum 101 and guided to a conveyance guide 109 to be conveyed to an image heating apparatus A. The above-described configuration up to the formation of the toner image on the recording material R is set as an image forming unit.

The recording material R on which the toner image is formed by the image forming unit is introduced into the image heating apparatus A. The toner image is heated in the image heating apparatus. On the other hand, the surface of the photosensitive drum 101 after the toner image transfer onto the recording material P is cleaned through removal of transfer residual tanner, paper powder, and the like in a cleaning apparatus 110, and the cleaned surface is used for the image formation repeatedly. The recording material P that has passed through the image heating apparatus A is discharged from a sheet discharge outlet 111 onto a sheet discharge tray 112.

2. Outline Description of Image Heating Apparatus

Figure 2A:
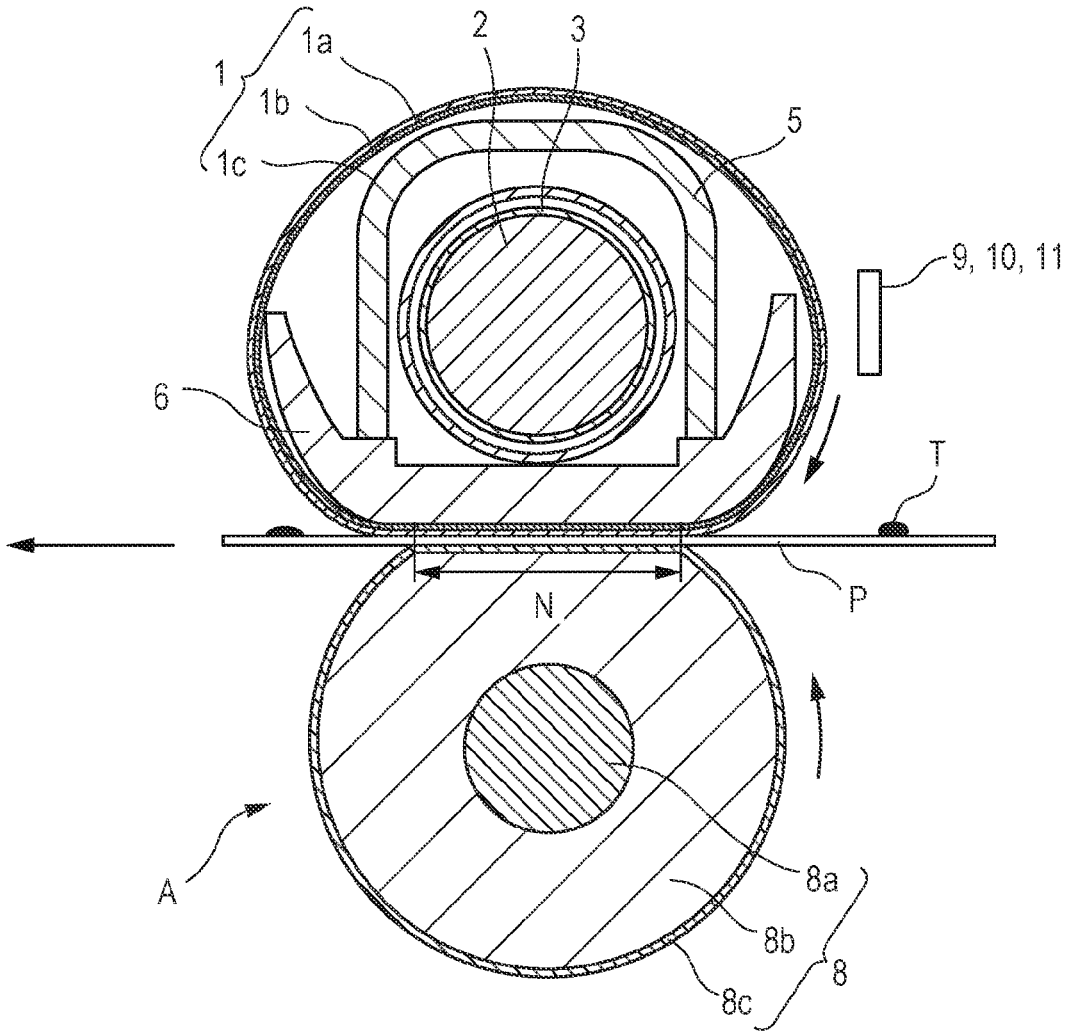
FIG. 2A illustrates a traverse section of a main part of the image heating apparatus according to the first embodiment.
Figure 2B:
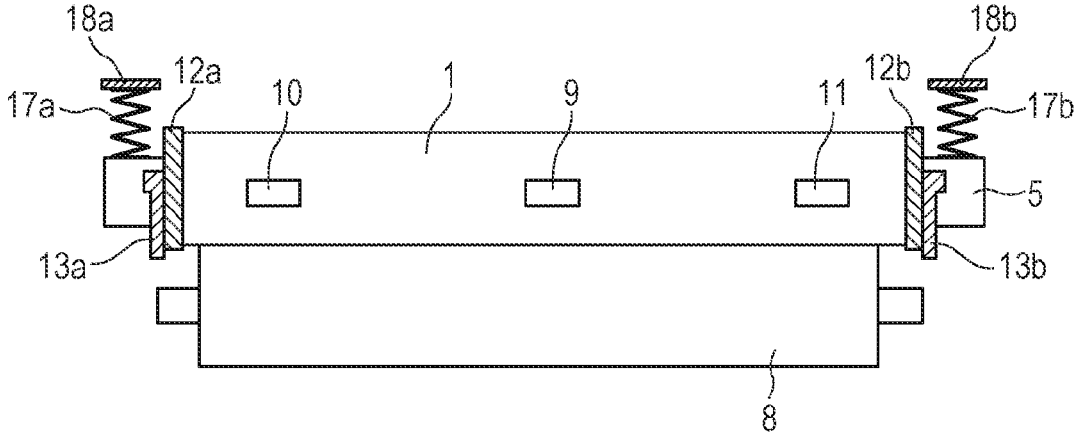
FIG. 2B is a front view of the main part of the image heating apparatus according to the first embodiment.
Figure 3:
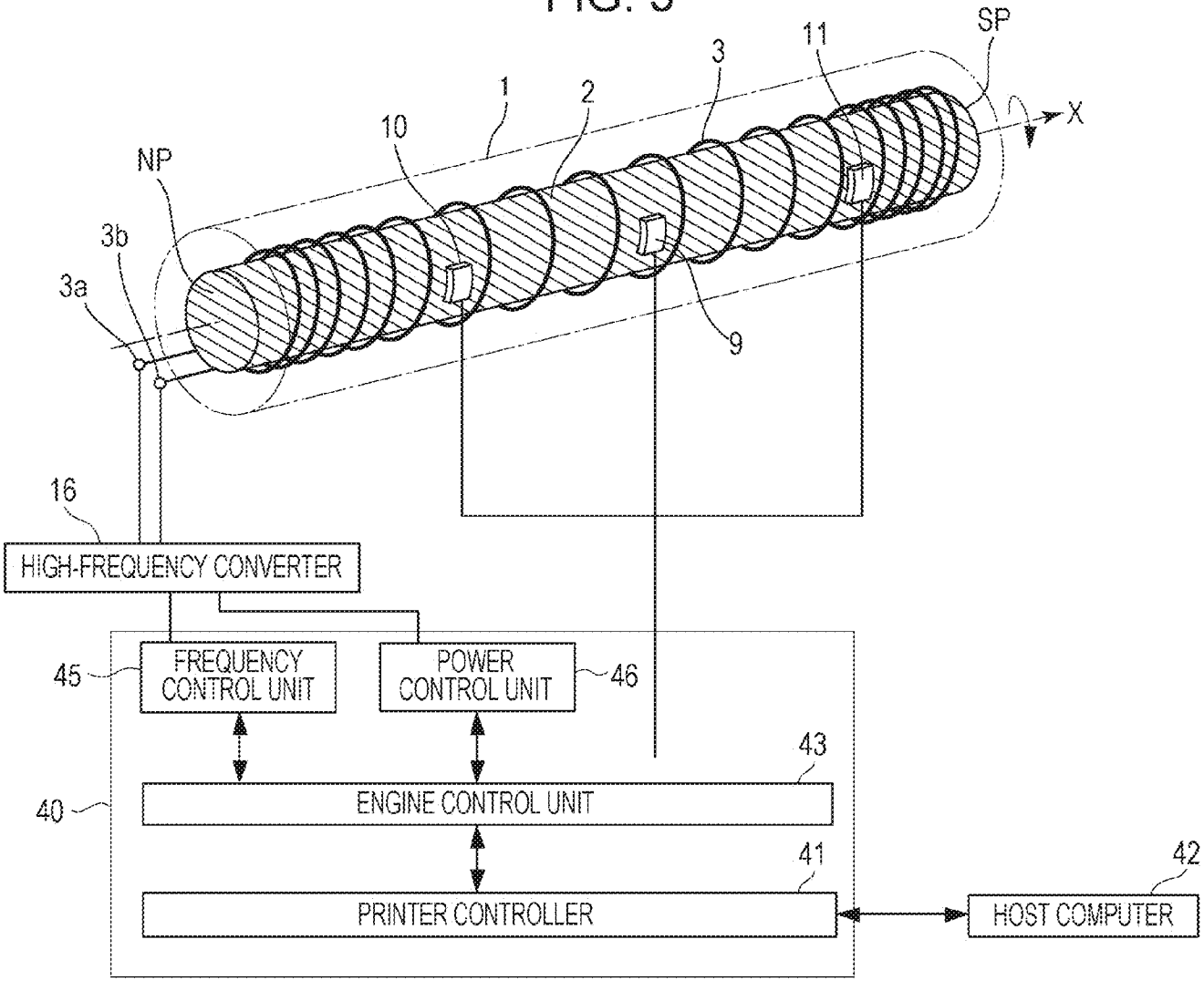
FIG. 3 is a perspective view of the main part of the image heating apparatus according to the first embodiment.

The image heating apparatus (image heating unit) A according to the present embodiment is an apparatus of an electromagnetic induction heating system. FIG. 2A illustrates a traverse section of the image heating apparatus A according to the present embodiment, and FIG. 2B is a front view of the image heating apparatus A. FIG. 3 is a perspective view and a control diagram of the image heating apparatus A. A pressure roller 8 functioning as an opposed member includes a core bar 8*a*, an elastic layer 8*b* formed on an outer side of the core bar 8*a*, and a releasing layer 8*c* as a front layer. A material of the elastic layer 8*b* is preferably a high heat resistance material such as silicone rubber, fluorocarbon rubber, or fluorosilicone rubber. Both end portions of the core bar 8*a* are rotatably held and arranged between frames (not illustrated) of the apparatus via a conductive shaft bearing. Pressure springs 17*a* and 17*b* are respectively provided between end portions of a pressurization stay 5 in FIG. 2B and spring bearing members 18*a* and 18*b* on an apparatus chassis side, so that the pressurization stay 5 is caused to have depressing force. It is noted that a suppress strength at a total pressure of approximately 100 N to 250 N (approximately 10 kgf to approximately 25 kgf) is supplied in the image heating apparatus A according to the present embodiment. Accordingly, a sleeve guide member 6 that is formed of heat resistant resin such as PPS and functions as a nip part forming member in contact with an inner surface of a film (sleeve) 1 forms the fixing nip part N with the pressure roller 8 via the sleeve 1. The pressure roller 8 is rotated and driven in an arrow direction by a driving member (not illustrated), and the sleeve 1 is caused to have rotating force by frictional force with an outer surface of the sleeve 1. Flange member 12*a* and 12*b* are external fit to end portions in the left and the right of the sleeve guide member 6 and rotatably installed while left and right positions are fixed by regulating members 13*a* and 13*b*. When the sleeve 1 rotates, the flange member 12*a* and 12*b* bear the end portions of the sleeve 1 and regulate the movement of the sleeve 1 in a generatrix direction. As a material of the flange member 12*a* and 12*b*, a material having a satisfactory heat resistance such as liquid crystal polymer (LCP) resin is preferably used.

The sleeve 1 includes a conductive layer 1*a* as a base layer with a diameter of 10 to 50 mm, an elastic layer 1*b* formed on an outer side of the conductive layer 1*a*, and a releasing layer 1*c* formed on an outer side of the elastic layer 1*b*. The conductive layer 1*a* is formed of a metal with a thickness of 10 to 50 μm. According to the present embodiment, a material of the conductive layer 1*a* is austenitic stainless steel having a low permeability. The elastic layer 1*b* is formed of silicone rubber having a hardness of 20 degrees (JIS-A, 1 kgf) and a thickness of 0.1 to 0.3 mm. The releasing layer 1*c* is formed of a fluorocarbon resin tube with a thickness of 10 to 50 μm. An induction current is generated in the conductive layer 1*a* to develop heat generation in the conductive layer 1*a*. With this heat generation in the conductive layer 1*a*, the entire sleeve 1 is heated, and the recording material P that passes through a fixing nip part N is heated to fix a toner image T.

A mechanism for generating the induction current on the conductive layer 1*a* will be described. FIG. 3 is a perspective view of the apparatus. A magnetic core 2 as a magnetic member has such a shape that a loop is not formed outside the sleeve 1 (the conductive layer 1*a*) (which is a shape with end portions) and is provided in a hollow portion of the sleeve 1 by a mounting unit (not illustrated). The magnetic core 2 forms an open magnetic path having magnetic poles NP and SP. A material of the magnetic core 2 is preferably a material having a small hysteresis loss and a high relative permeability, for example, a ferromagnetic material composed of an oxidative product or an alloy material having a high permeability, such as a calcined ferrite, ferrite resin, amorphous alloy, or permalloy. According to the present embodiment, a calcined ferrite having the relative permeability of 1800 is used. The magnetic core 2 has a cylindrical column shape with a diameter of 5 to 30 mm, and a length in a longitudinal direction is 240 mm.

Figure 4:
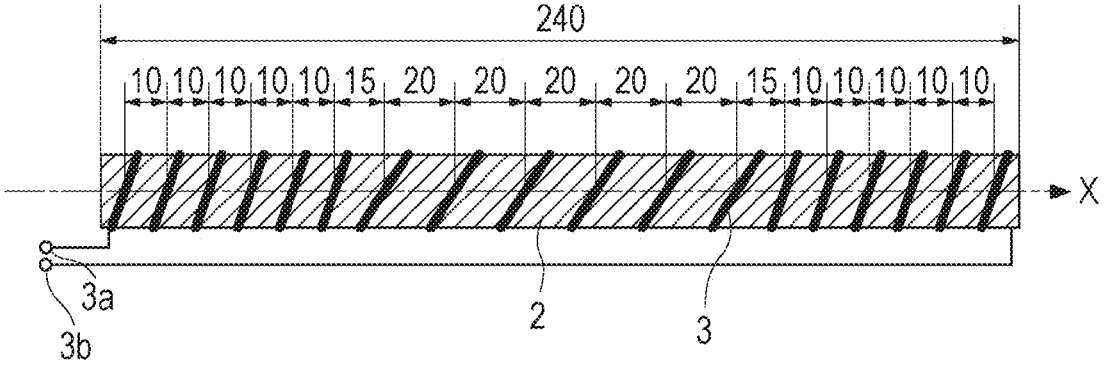
FIG. 4 illustrates winding intervals of an exciting coil.

An exciting coil 3 is obtained by winding a regular single conductive wire around the magnetic core 2 in the hollow portion of the sleeve 1 in a helical manner. At this time, the winding is carried out in a manner that a pitch in end portions in the longitudinal direction of the exciting coil 3 wound around the magnetic core 2 is smaller than a pitch in a central portion. FIG. 4 illustrates the magnetic core 2 around which the exciting coil 3 is wound. The exciting coil 3 is wound 18 times around the magnetic core 2 having a dimension of 240 mm in the longitudinal direction. The pitches for winding the exciting coil 3 are 10 mm in the end portions in the longitudinal direction, 20 mm in the central portion, and 15 mm in between. The exciting coil 3 is wound in a direction intersecting with the longitudinal direction of the, magnetic core 2 (X direction), and a high-frequency current flows through the exciting coil 3 via feeding point parts 3*a* and 3*b* by a high-frequency converter or the like, and a magnetic flux is generated to develop the electromagnetic induction heat generation in the conductive layer 1*a*.

It is noted that the exciting coil 3 may not necessarily have the configuration of directly being wound around the magnetic core 2, and may be wound around a bobbin or the like. That is, it is sufficient that the exciting coil 3 has a helical part in which a helical axis is approximately parallel to the generatrix direction of the sleeve 1, and the magnetic core 2 is arranged in the helical part.

3. Printer Control

The image heating apparatus A includes contactless-type temperature detection members 9, 10, and 11 and is arranged on an upstream side of the nip part N in a rotating direction of the sleeve 1 so as to face an outer peripheral surface of the sleeve 1 as illustrated in FIG. 2A. The temperature detection member 9 is arranged in the central portion, and the temperature detection members 10 and 11 are arranged in the end portions in the generatrix direction of the sleeve 1.

Power supplied to the image heating apparatus A is controlled in a manner that a detected temperature of the temperature detection member 9 is maintained at a predetermined target temperature. When small-size recording materials are continuously printed, the temperature detection members 10 and 11 can detect a temperature in a region through which the recording materials do not pass, which is so-called non-sheet passing portion. FIG. 3 is a block diagram of a printer control unit 40. A printer controller 41 communicates with a host computer 42 which will be described below, receives image data, and renders the received image data into information that can be printed by the printer. In addition, the printer controller 41 also exchanges signals with an engine control unit 43 and performs serial communication. The engine control unit 43 exchanges the signals with the printer controller 41 and further controls respective units 45 and 46 of a printer engine via the serial communication. A power control unit 46 controls the power supplied to the image heating apparatus A on the basis of temperatures detected by the temperature detection members 9, 10, and 11 and also performs malfunction detection of the image heating apparatus A. A frequency control unit 45 controls a driving frequency of a high-frequency converter 16, and the power control unit 46 controls the power of the high-frequency converter 16 by adjusting a voltage applied to the exciting coil.

In a printer system including the thus configured printer control unit 40, the host computer 42 transfers the image data to the printer controller 41 and sets various printing conditions in the printer controller 41 such as a size of the recording material in accordance with requests from a user.

4. Heat Generation Principle of the Conductive Layer 1*a*

Figure 5:
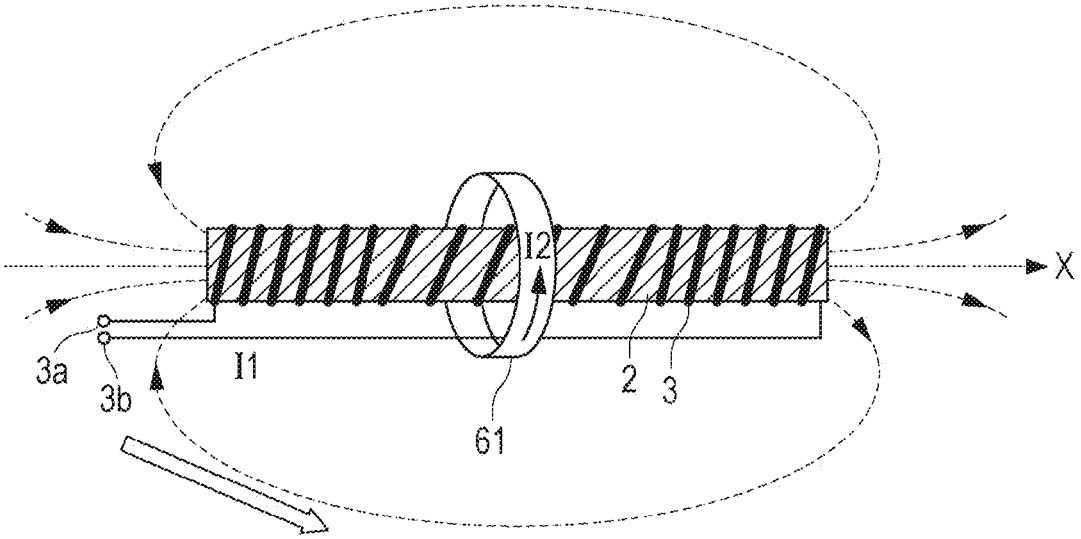
FIG. 5 illustrates a magnetic field in a case where a current flows through the exciting coil in an arrow direction.

FIG. 5 illustrates a magnetic field at a moment when a current is increased in the exciting coil 3 towards an arrow I1. The magnetic core 2 functions as a member configured to induce magnetic lines generated by causing an alternating current to flow through the exciting coil 3 towards the inside to form a magnetic path. For that reason, the magnetic lines pass through the inside of the magnetic core 2 in a part where the magnetic core 2 exists and the magnetic lines that have exited from one end of the magnetic core 2 diffuse and return to the other end of the magnetic core 2 (some of the magnetic lines discontinue in the end portion due to the illustration of the drawing). Herein, a circuit 61 having a cylindrical shape with a small width in the longitudinal direction is arranged on the outer side of the magnetic core 2.

An alternating magnetic field (magnetic field whose size and direction are repeatedly changed along with time) is formed inside the magnetic core 2. An induced electromotive force is generated in a circumferential direction of the circuit 61 in conformity to Faraday's law. Faraday's law indicates "a size of the induced electromotive force generated in the circuit 61 is proportional to a rate of the change of the magnetic field that perpendicularly penetrates through the circuit 61", and the induced electromotive force is represented by the following expression (1).

[Math 1]

$$V = -N\frac{\Delta\Phi}{\Delta t} \tag{1}$$

V: Induced electromotive force

Figure 6A:
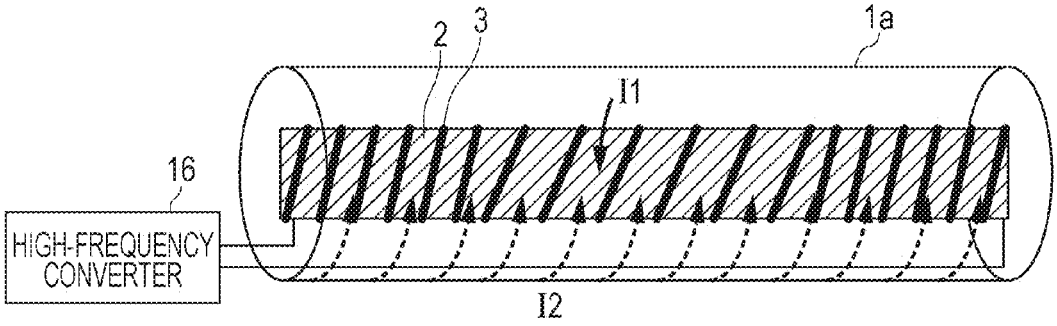
FIG. 6A illustrates a circumferential current flowing through a conductive layer.

N: Number of turns of the coil $\Delta\Phi/\Delta t$: Change of the magnetic flux that perpendicularly penetrates through the circuit in minute time $\Delta t$ The conductive layer 1*a* can be regarded as a product obtained by connecting a large number of the extremely short cylindrical circuits 61 to each other in the longitudinal direction. Therefore, when I1 flows through the exciting coil 3, the alternating magnetic field is formed inside the magnetic core 2, and the induced electromotive force in the circumferential direction represented by the expression (1) is applied to the entire conductive layer 1*a* in the longitudinal direction, and a circumferential current I2 indicated by a dotted line flows through the entire longitudinal section (FIG. 6A). Since the conductive layer 1*a* has an electric resistance, Joule's heat is generated when the circumferential current I2 flows. The circumferential current I2 continues to flow by changing its direction while the alternating magnetic field continues to be formed. This is the heat generation principle of the conductive layer 1*a* according to the present embodiment. It is noted that, in a case where I1 is set as a high-frequency alternating current at 50 kHz, the circumferential current I2 is also set as a high-frequency alternating current at 50 kHz.

Figure 6B:
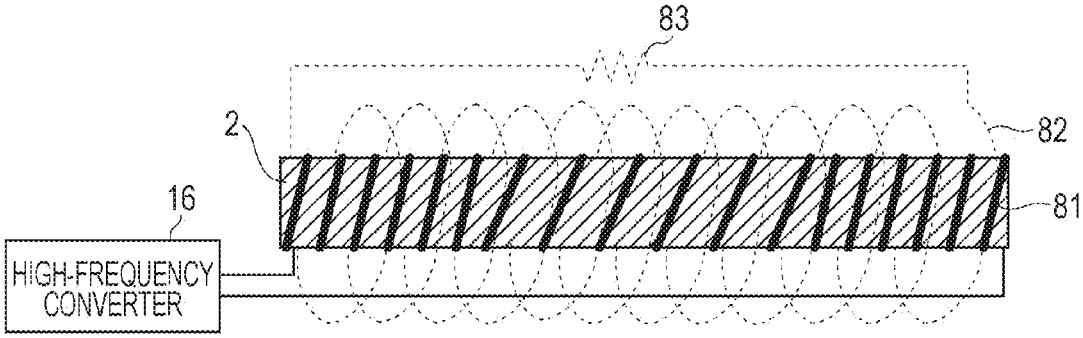
FIG. 6B illustrates transformer magnetic coupling.

As described above, I1 indicates the direction of the current flowing inside the exciting coil 3, and the induction current flows in the entire region in the dotted line arrow I2 direction in the circumferential direct ion of the conductive layer 1*a* in a direction for cancelling the alternating magnetic field formed by this. A physical model for inducing the current I2 is equivalent to magnetic coupling of a coaxial transformer having a shape wound by a primary coil 81 illustrated by a solid line and a secondary coil 82 illustrated by a dotted line as illustrated in FIG. 6B. The secondary coil 82 forms a circuit and includes a resistance 83. A high-frequency current is generated in the primary coil 81 by an alternating voltage generated from the high-frequency converter 16, and as a result, the induced electromotive force is applied to the secondary coil 82 to be consumed as heat by the resistance 83. Herein, the secondary coil 82 and the resistance 83 are based on modeling of joule's heat generated in the conductive layer 1*a*.

Figure 7A:
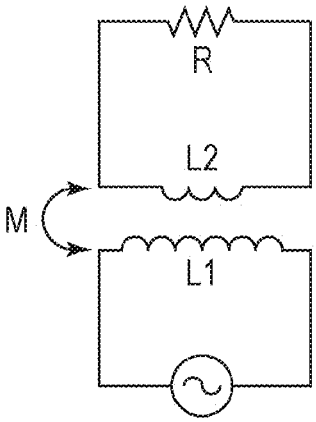
FIGS. 7A to 7C illustrate equivalent circuits.
Figure 7B:
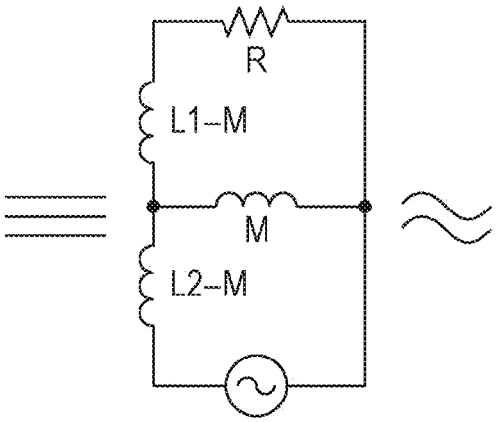
Figure 7C:
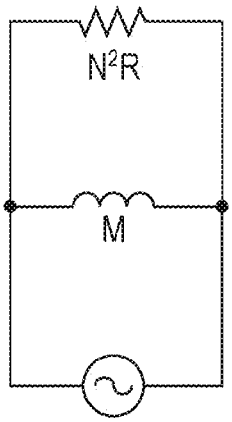

FIG. 7A illustrates an equivalent, circuit of the model diagram illustrated in FIG. 6B. L1 denotes an inductance of the primary coil 81 in FIG. 6B, L2 denotes an inductance of the secondary coil 82 in FIG. 6B, M denotes a mutual inductance of the primary coil 81 and the secondary coil 82, and R denotes the resistance 83. This circuit diagram of FIG. 7A can be equivalently transformed into FIG. 7B. To consider about a further simplified model, it is assumed that the mutual inductance M is sufficiently large, and L1≈L2≈M is established. In that case, since (L1−M) and (L2−M) are sufficiently small, the circuit can be approximated from FIG. 7B to FIG. 7C. Considerations will be given with respect to the configuration according to the present embodiment illustrated in FIG. 6A above by being replaced by FIG. 7C as the approximated equivalent circuit. In addition, here, the resistance will be described. The impedance on the secondary side in the state of FIG. 7A becomes the electric resistance R in the circumferential direction of the conductive layer 1*a*. In the transformer, the impedance on the secondary side is an equivalent resistance R' multiplied by $N^2$ (N denotes a transformer turns ratio) as seen from the primary side. Herein, it is possible to consider that the transformer turns ratio N is 18 while the conductive layer 1*a* is regarded that the number of turns is 1 with respect to the number of turns of the primary coil is equal to the number of turns of the exciting coil 3 in the conductive layer 1*a* (according to the present embodiment, 18 times). Therefore, it is possible to consider that $R'=N^2R=18^2R$ is established, and the higher the number of turns is, the larger the equivalent resistance R' is.

Figure 8A:
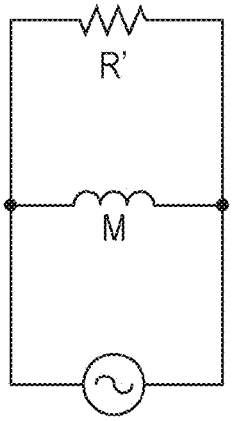
FIGS. 8A and 8B illustrate equivalent circuits.
Figure 8B:
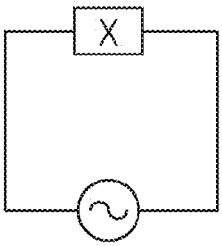

FIG. 8B defines and further simplifies a combined impedance X. When the combined impedance X is obtained, the following expression (2) is established.

[Math. 2]

$$\frac{1}{X} = \frac{1}{R'} + \frac{1}{j\omega M}, \quad (2)$$

$$(\omega = 2\pi f)$$

$$|X| = \frac{1}{\sqrt{\left(\frac{1}{x'}\right)^2 + \left(\frac{1}{\omega M}\right)^2}}$$

From the expression (2), it may be understood that the combined impedance X has a frequency dependency in a term $(1/\omega M)^2$. This means that the inductance M is also attribute to the combined impedance X together with the resistance R', and also means that a load resistance has a frequency dependency since a dimension of the impedance is [Ω]. This phenomenon where the combined impedance X is changed depending on the frequency will be qualitatively described for understanding operation of the circuit. In a case where the frequency is low, the inductance is close to short-circuit, and a current flows, on the inductance side. On the other hand, in a case where the frequency is high, the inductance is close to open-circuit, a current: flows on the resistance R side. As a result, the combined impedance X tends to be small when the frequency is low, and the combined impedance X tends to be large when the frequency is high. In a case where a high frequency that is higher than or equal to 20 kHz is used, the influence from the term of the inductance M in the combined impedance X is not negligible since the dependency on the frequency ω of the combined impedance X is large.

5. Cause for Decrease in Heating Value in the Vicinity of End Portions of Magnetic Core Here, a heat generation distribution of the image heating apparatus. A according to the present embodiment will be described. The heat generation distribution uniformly heated by the sleeve in the generatrix direction of the sleeve 1 is one of heat generation distributions used for heating up the image on the recording material.

Figure 9A:
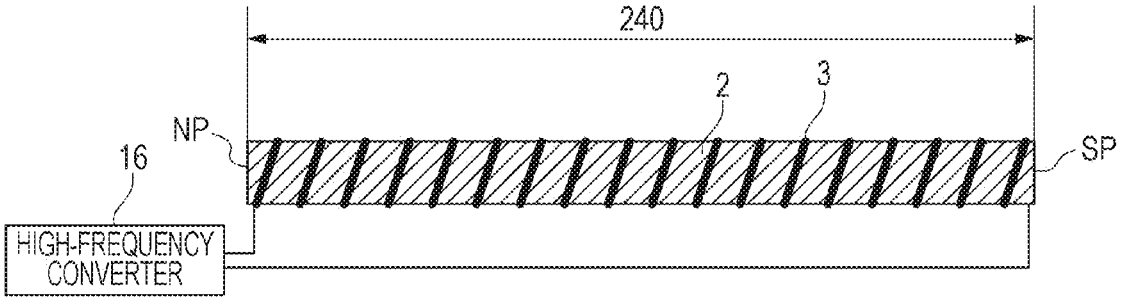
FIG. 9A illustrates winding intervals of the exciting coil.
Figure 9B:
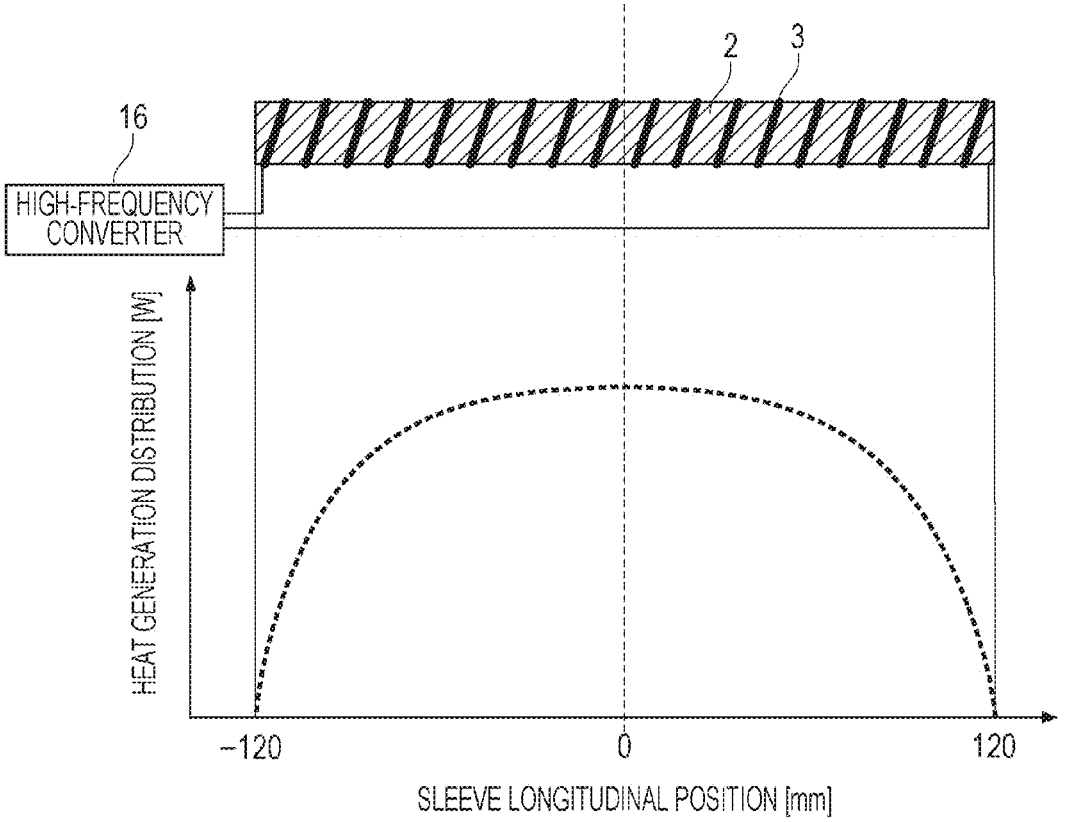
FIG. 9B illustrates a heating value distribution.

As illustrated in FIG. 9A, the magnetic core 2 has the shape where the loop is not formed outside the sleeve 1 (which is the shape with the end portions), and an open magnetic path having magnetic poles NP and SP are formed. Herein, as a comparison example, considerations will be given of a configuration where the exciting coil 3 is wound around the magnetic core 2 at an equal pitch like the image heating apparatus illustrated in FIG. 9B. Specifically, the exciting coil 3 is wound 18 times around the magnetic core 2 having a longitudinal dimension of 240 mm, and the pitch is 13 mm across the entire region. According to this configuration, it is possible to realize miniaturization of the magnetic core 2 with the configuration using the core having the shape with the ends, but heat generation nonuniformity in which the heating value in the vicinity of the end portions of the magnetic core 2 is lower than the heating value in the central portion occurs. When this heat generation nonuniformity occurs, heating fault occurs in the end portions where the heating value is low, which becomes the cause for an image defect. This heat generation nonuniformity relates, to the formation of the open magnetic path by using the magnetic core 2 with the end portions. The following two causes are conceivable.

5-1) Decrease in the apparent permeability in the end portions of the magnetic core 5-2) Decrease in the combined impedance X in the end portions of the magnetic core Hereinafter, the details will be described in parts 5-1) and 5-2).

5-1) Decrease in Apparent Permeability in End Portions of Magnetic Core

Figure 10A:
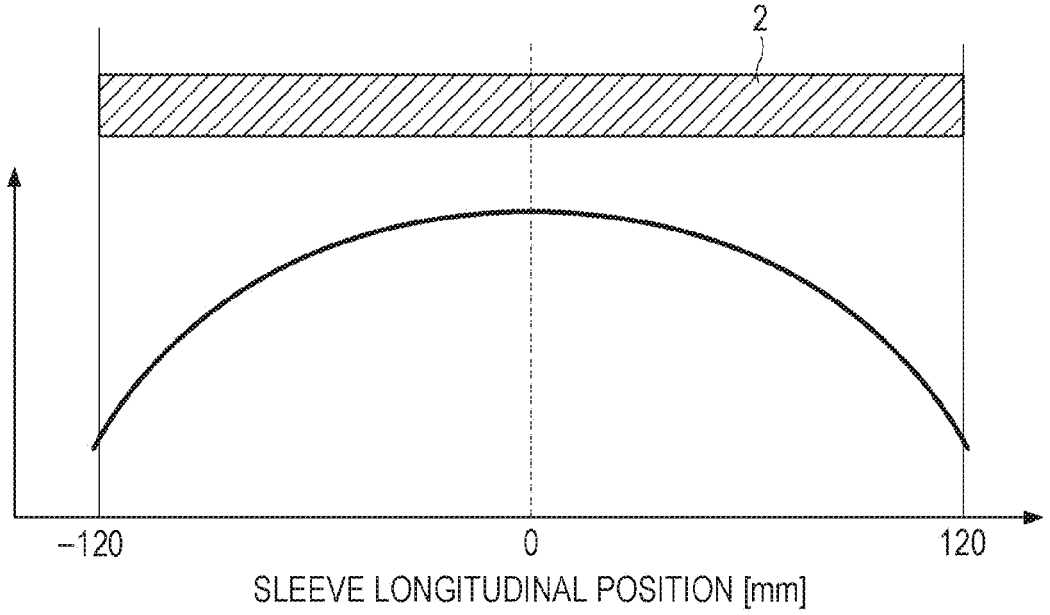
FIG. 10A is an image diagram of an apparent permeability.

A graphic representation of FIG. 10A is an image diagram indicating "an apparent permeability μ" in both the ends parts of the magnetic core is lower than the central portion. A reason why this phenomenon occurs will be described. In a uniform magnetic field H, a magnetic flux density B in a space follows the following expression (3) in a magnetic field region where magnetization of an object is substantially proportional to an external magnetic field.

[Math. 3]

$$B = \mu H \quad (3)$$

Figure 10B:
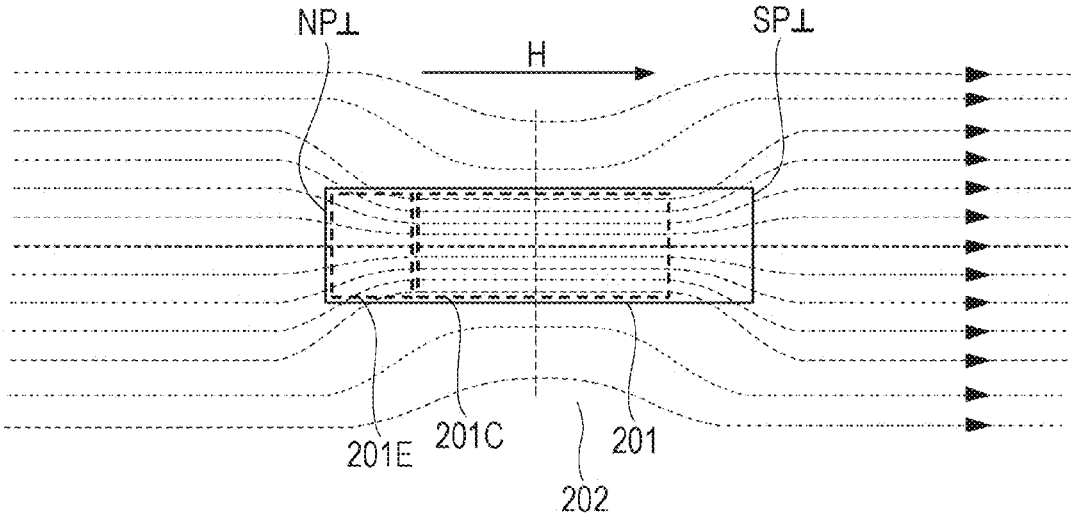
FIG. 10B is a shape diagram of a magnetic flux in a case where a ferrite and air are arranged in a uniform magnetic field.

Therefore, when a substance having a high permeability μ is placed in the magnetic field H, ideally, the high magnetic flux density B in proportion to the level of the permeability can be created. According to the present embodiment, this space where the magnetic flux density B is high is used as a "magnetic path". In particular, when the magnetic path is formed, a closed magnetic path formed with the magnetic path having the closed magnetic core and an open magnetic path formed with the core having the end portions exist. According to the present embodiment, the open magnetic path is used. FIG. 10B represents a shape of magnetic flux in a case where a ferrite 201 is arranged in the uniform magnetic field H (a surrounding area of the ferrite 201 is filled with air 202). The ferrite 201 includes the open magnetic path having boundary planes NP⊥ and SP⊥ with air perpendicular to the magnetic lines. In a case where the magnetic field H is generated in parallel to the longitudinal direction of the magnetic core, as illustrated in FIG. 10B, the density of the magnetic lines in the air is low, and the density of the magnetic lines in a central portion 201C of the magnetic core is high. Therefore, the magnetic flux density B in an end portion 201E is lower than that in the central portion 201C of the magnetic core. In this manner, a reason why the magnetic flux density B becomes smaller in the end portions of the magnetic core resides in a boundary condition between the air and the ferrite 201. Since the magnetic flux density B is continuous, on the boundary planes NP⊥ and SP⊥, the magnetic flux density B in the air part in contact with the ferrite 201 in the vicinity of the boundary planes is increased, and the magnetic flux density B in the ferrite end portion 201E in contact with the air is decreased. Accordingly, the magnetic flux density B in the ferrite end portion 201E is decreased. Since the magnetic core has the low magnetic flux density B in the end portion, it looks as if the permeability in the end portion is decreased. According to the present embodiment, this phenomenon is represented that the apparent permeability is decreased in the end portion of the magnetic core.

Figure 11:
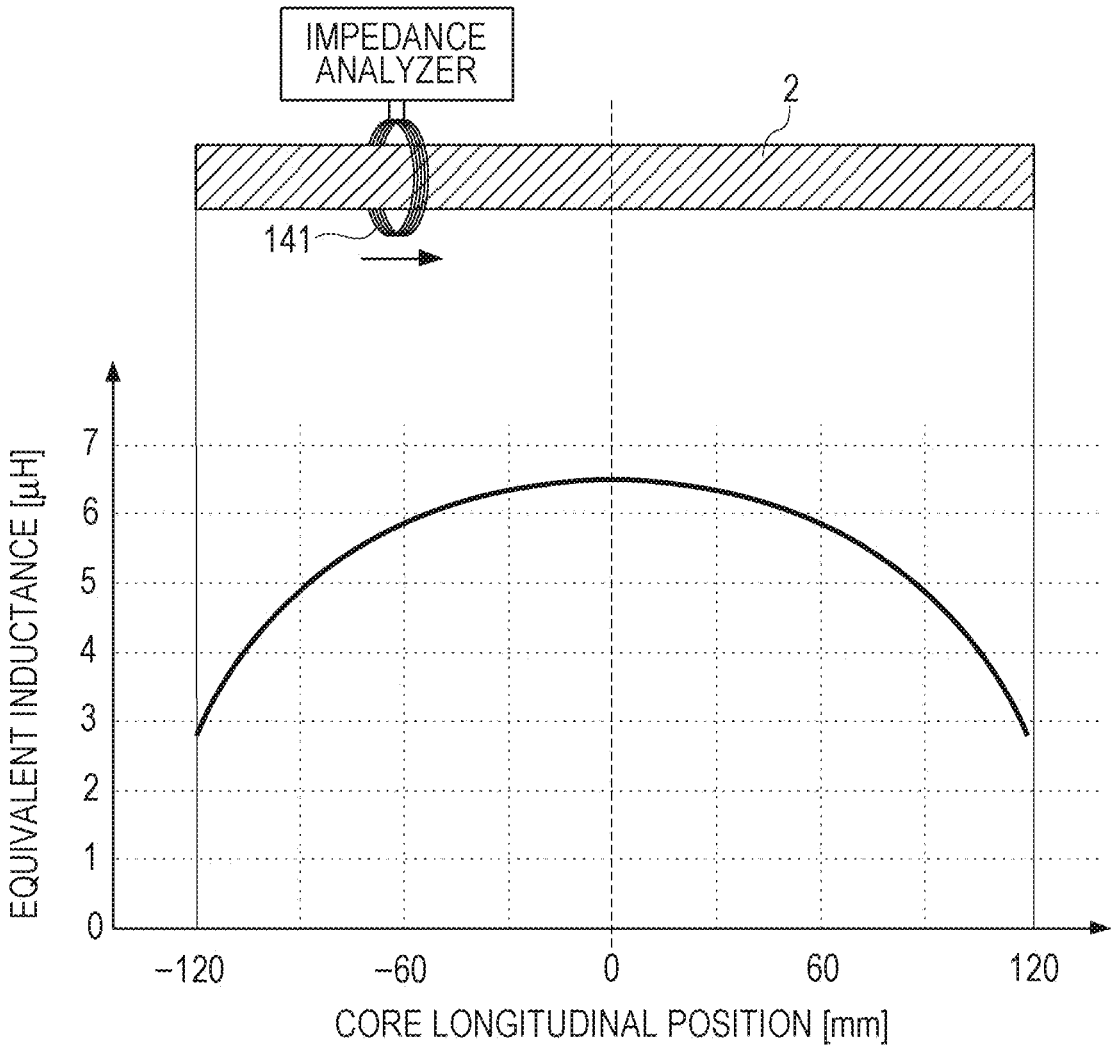
FIG. 11 is an explanatory diagram for describing scanning of the exciting coil on a magnetic core.

This phenomenon can be indirectly verified, by using an impedance analyzer. In FIG. 11, a coil 141 with a diameter of 30 mm (N=5 turns in the coil) is put through the magnetic core 2 and moved in an arrow direction. At this time, when end portions of the coil are connected to the impedance analyzer to measure an equivalent inductance L (the frequency is 50 kHz) from both the end portions of the coil 141, the equivalent inductance L has an arc-like distribution shape as illustrated in the graphic representation. The equivalent inductance L attenuates in the end portions by at least half of the equivalent inductance L in the central portion. L is in conformity to the following expression (4).

[Math 4]

$$L = \frac{\mu N^2 S}{l} \tag{4}$$

Where μ denotes the permeability of the magnetic core, N denotes the number of turns of the coil, l denotes a length of the coil, and S denotes a cross-sectional area of the coil. Since the shape of the coil 141 is not changed, S, N, and l are constants in the present: experiment. Therefore, a cause for the equivalent inductance L to have the arc-like distribution shape is that "the apparent permeability is decreased in the end portion of the magnetic core". To summarize the above descriptions, when the magnetic core is formed to have the shape with the end portions, the phenomenon where the apparent permeability is decreased in the end portion of the magnetic core is observed.

Figure 12A:
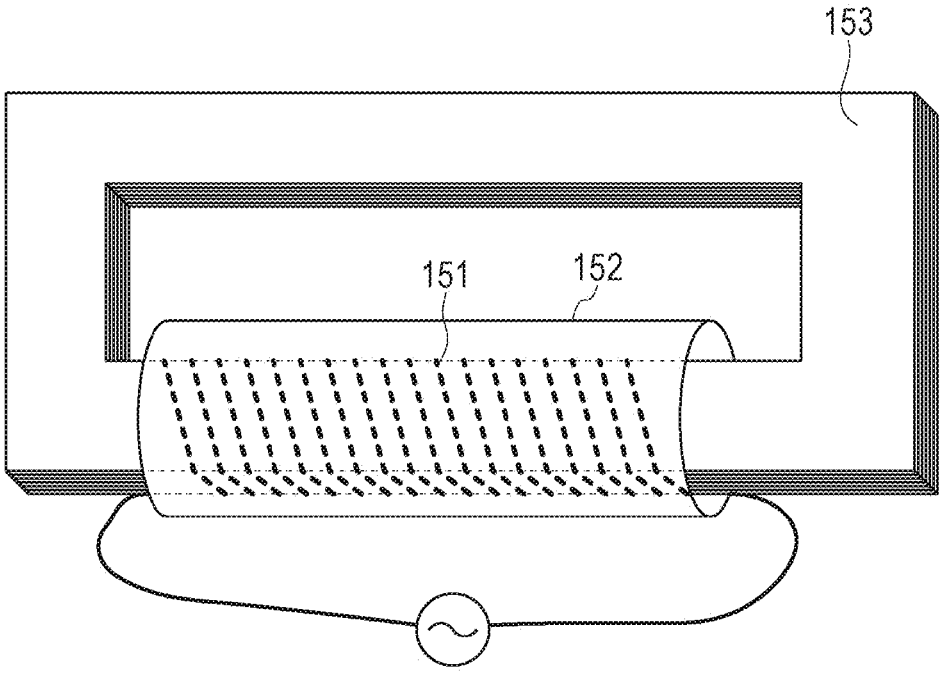
FIG. 12A is an explanatory diagram for describing a case where a closed magnetic path is formed.

It is noted that when the closed magnetic path using the magnetic core having the closed shape is used or when the magnetic core is divided into plural pieces, this phenomenon does not occur. For example, a case of the closed magnetic path as illustrated in FIG. 12A will be described. A magnetic core 153 forms a loop on an outer side of a conductive layer 152. In this case, since the magnetic path completes only with the magnetic core 153, the magnetic core 153 does not have boundary planes between the magnetic core and the air like the boundary planes NP⊥ and SP⊥ according to the present embodiment. Thus, the magnetic flux density B is uniform inside the magnetic core 153.

5-2) Decrease in Combined Impedance X in End Portions of Magnetic Core

Figure 13A:
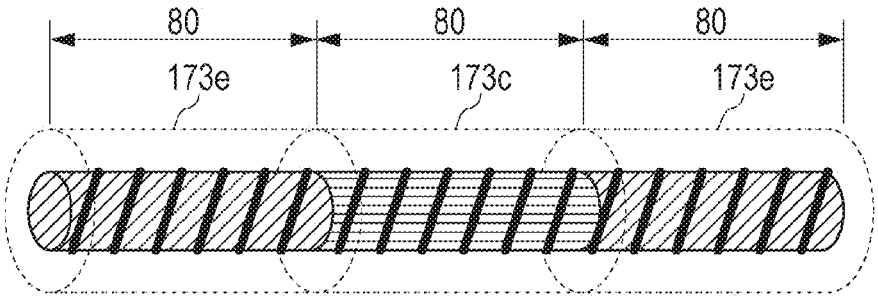
FIGS. 13A and 13B are arrangement diagrams of the conductive layer divided into three.
Figure 13B:
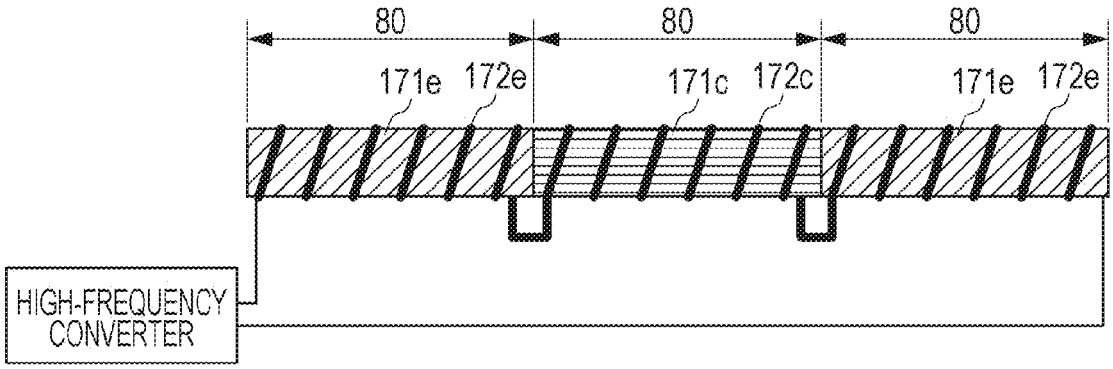
Figure 14A:
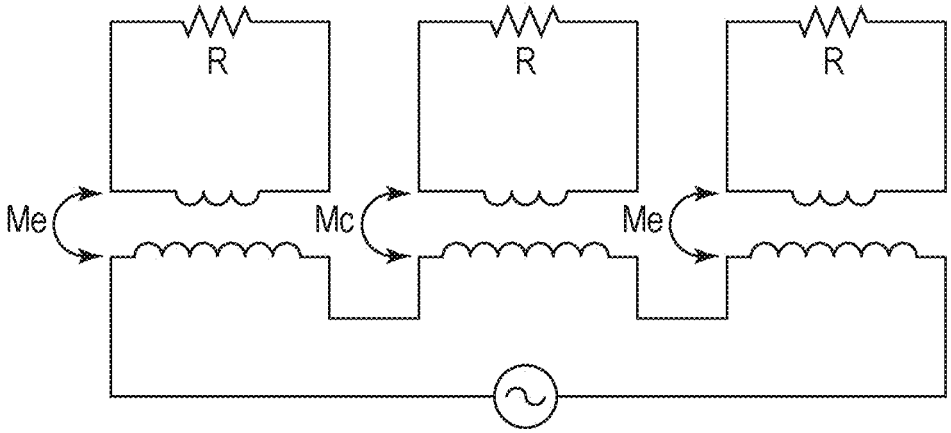
FIG. 14A is an equivalent circuit diagram.
Figure 14B:
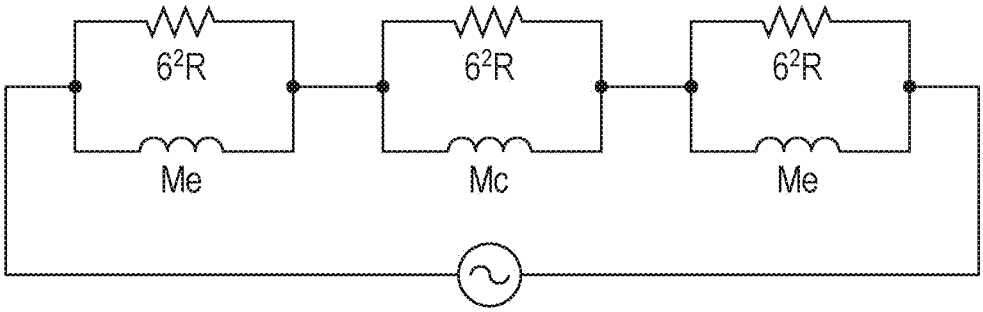
FIG. 14B is an equivalent circuit diagram obtained by further simplifying FIG. 14A.
Figure 14C:
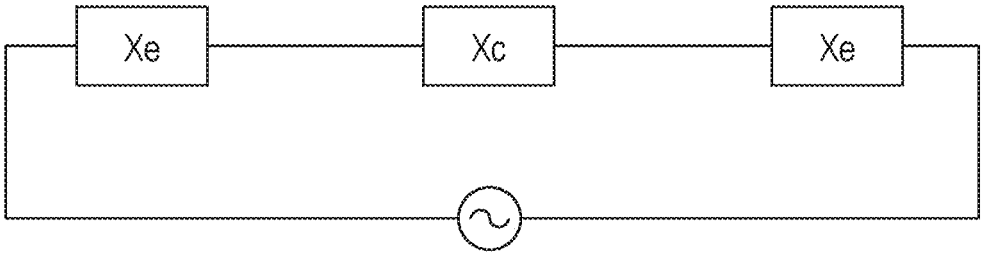
FIG. 14C is an equivalent circuit diagram obtained by further simplifying FIG. 14B.

The apparent permeability has a distribution in the longitudinal direction according to the present embodiment. Descriptions will be given by using configurations of FIGS. 13A and 13B to describe these by way of a simple model. With respect to the configuration of FIG. 9A, FIG. 13A illustrates the magnetic core and the conductive layer divided into three in the longitudinal direction. Conductive layers 173*e* and 173*c* having the same shape and the same physical property are respectively arranged as illustrated in FIG. 13A. The conductive layers 173*e* and 173*c* both have the longitudinal dimension of 80 mm, a resistance value of the conductive layers 173*e* in the circumferential direction is set as Re, and a resistance value of the conductive layer 173*c* in the circumferential direction is set as Rc. A circumferential resistance refers, to a resistance value in a case where a current path is taken in a circumferential direction of a cylindrical member. Both Re and Rn are values equal to R. The exciting core is divided into end portions 171*e* (permeability μe) and a central portion 171*c* (permeability μc), and the longitudinal dimensions of the end portions 171*e* and the central portion 171*c* are both 80 mm. The permeabilities of the respective magnetic cores have, a relationship where the permeability in the central portion (μc) is larger than the permeability in the end portions (μe). Herein, the considerations are made by way of the simple physical model, changes in the individual apparent permeabilities inside the end portion 171*e* the central portion 171*c* are not taken into account. As illustrated in FIG. 13B, with regard to the winding, an exciting coil 172*e* and an exciting coil 172*c* are respectively wound 6 times around the exciting core 171*e* and the exciting core 171*c* (Ne=6), and these are connected to each other in series. In addition, an interaction between the magnetic cores in the end portion and the central portion is sufficiently small, and the respective circuits can be modeled as three branched circuits as illustrated in FIG. 14A. Since the permeabilities of the magnetic cores have a relationship of μe<μc, a relationship of the mutual inductances is also Me<Mc. FIG. 14B illustrates a further simplified model.

When the equivalent resistances of the respective circuits as seen from the primary side are observed, $R'=6^2R$ in the end portion and $R'=6^2R$ in the central portion are obtained. Thus, when combined impedances Xe and Xc are calculated, the combined impedances Xe and Xc are respectively represented by the following expressions (5) and (6).

[Math 5]

$$|X_e| = \frac{1}{\sqrt{\left(\frac{1}{6^2R}\right)^2 + \left(\frac{1}{\omega M_e}\right)^2}} \tag{5}$$

$$|X_c| = \frac{1}{\sqrt{\left(\frac{1}{6^2R}\right)^2 + \left(\frac{1}{\omega M_c}\right)^2}} \tag{6}$$

6. Method of Setting Uniform Heating Value

Subsequently, descriptions will be given of a setting a uniform heat generation distribution in the longitudinal direction of the conductive layer 1*a* by setting the number of turns per unit length of the coil in the end portions of the magnetic core to be higher than that in the central portion to control the driving frequency.

According to the present embodiment, this setting can be achieved by the following two processes.

Figure 17A:
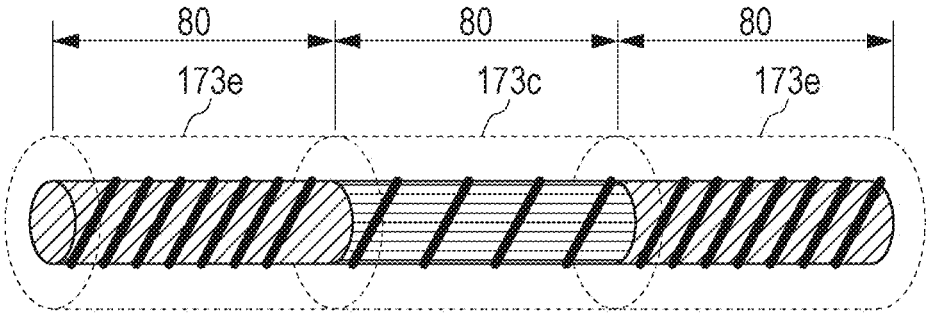
FIGS. 17A and 17B are arrangement diagrams of the conductive layer divided into three.
Figure 17B:
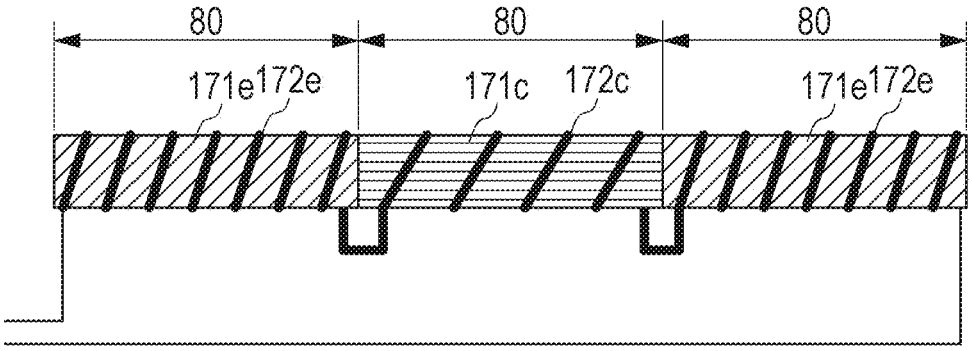
Figure 18A:
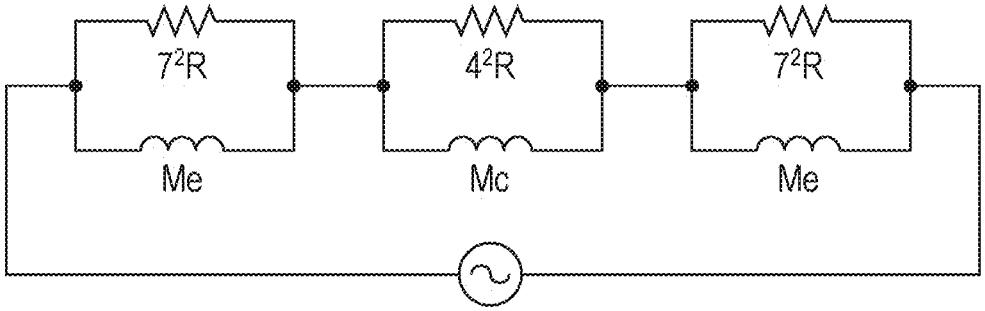
FIG. 18A is an equivalent circuit diagram.

6-1) Setting the number of turns of the coil in the end portions of the magnetic core to be dense, and setting the number of turns of the coil in the central portion of the magnetic core to be sparse 6-2) Setting an appropriate frequency While the number of turns of the coil in the end portion of the magnetic core is set to be dense, and the number of turns in the central portion is set to be sparse, a balance between the inductance and the resistance in the end portion and the central portion can be changed. This will be described by way of the above-described model where the magnetic core and the conductive layer are divided in the longitudinal direction into three. In contrast to the model of FIG. 13A, with regard to the winding of FIG. 17A, as illustrated in FIG. 17B, the exciting coil 172*e* is wound 7 times around the exciting core 171*e* (Ne=7), and the exciting coil 172*c* is wound 4 times around the exciting core 171*c* (Nc=4) like the configuration according to the present embodiment. The other configurations are the same as those of the model in FIG. 13A. The simplified model diagram is illustrated in FIG. 18A.

When the equivalent resistances of the respective circuits as seen from the primary side are observed, $R'=7^2R$ is established in the end portion, and $R'=4^2R$ is established in the central portion. Thus, when the combined impedances Xe and Xc are calculated, the combined impedances Xe and Xc are respectively represented by the following the expressions (7) and (8).

[Math. 6]

$$|X_e| = \frac{1}{\sqrt{\left(\frac{1}{7^2 R}\right)^2 + \left(\frac{1}{\omega M_e}\right)^2}} \quad (7)$$

$$|X_c| = \frac{1}{\sqrt{\left(\frac{1}{4^2 R}\right)^2 + \left(\frac{1}{\omega M_c}\right)^2}} \quad (8)$$

Figure 15A:
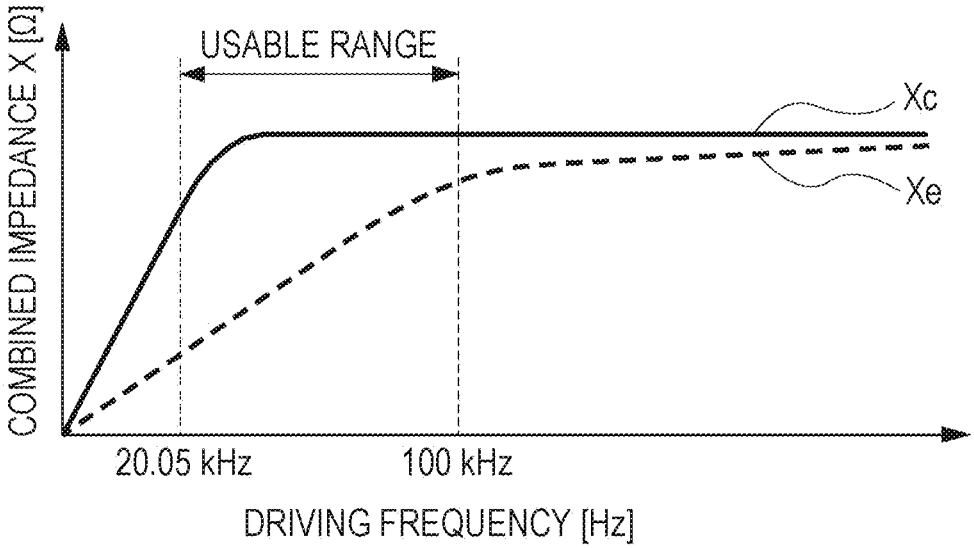
FIG. 15A is a graphic representation on which frequency characteristics are plotted.
Figure 18B:
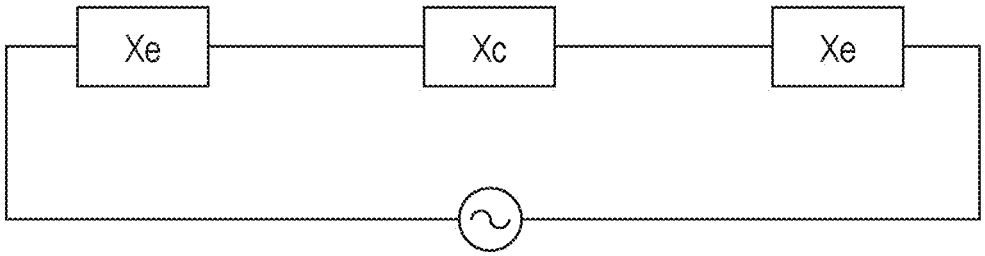
FIG. 18B is an equivalent circuit diagram obtained by further simplifying FIG. 18A.
Figure 19A:
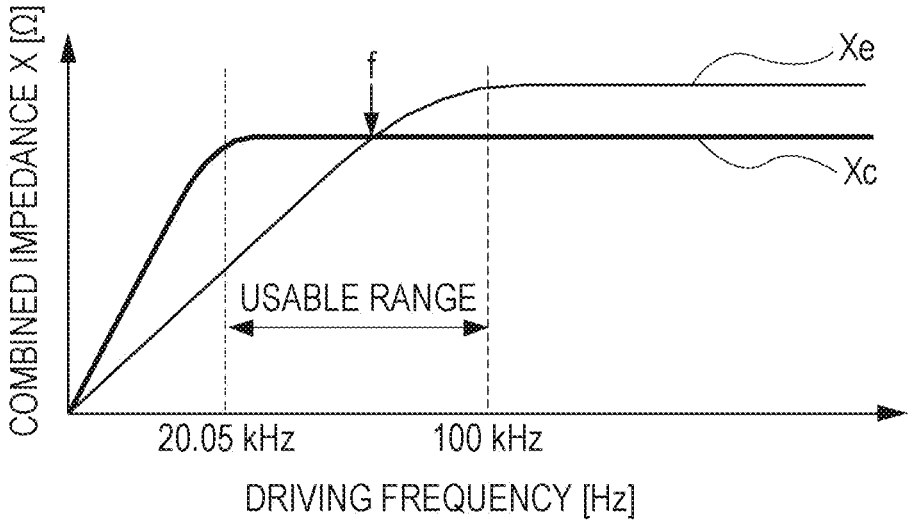
FIG. 19A is a graphic representation on which the frequency characteristics are plotted.
Figure 19B:
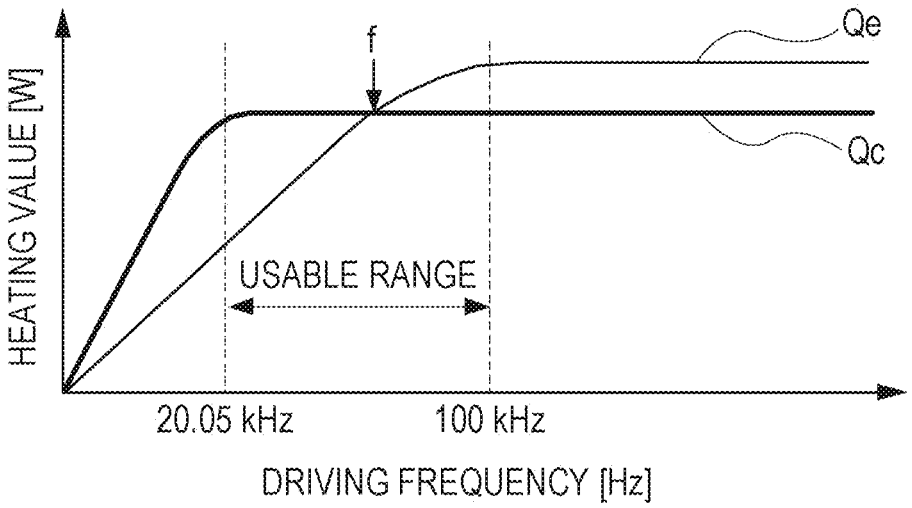
FIG. 19B is a graphic representation on which the frequency characteristics are plotted.

When the parallel circuit parts of R and L are replaced by the combined impedance X, the model is as illustrated in FIG. 18B. Frequency dependencies of Xe and Xc are different from the graphic representation illustrated in FIG. 15A since the value R' differs, and Xe=Xc can be established within a usable frequency range. This is due to an increase in the term of R' in Xe. A frequency at which Xe=Xc is established is set as f (a predetermined value). In a case where an alternating voltage is applied from a high-frequency converter 16, as illustrated in FIG. 19B, Qe=Qc can be established at the frequency f.

Figure 20:
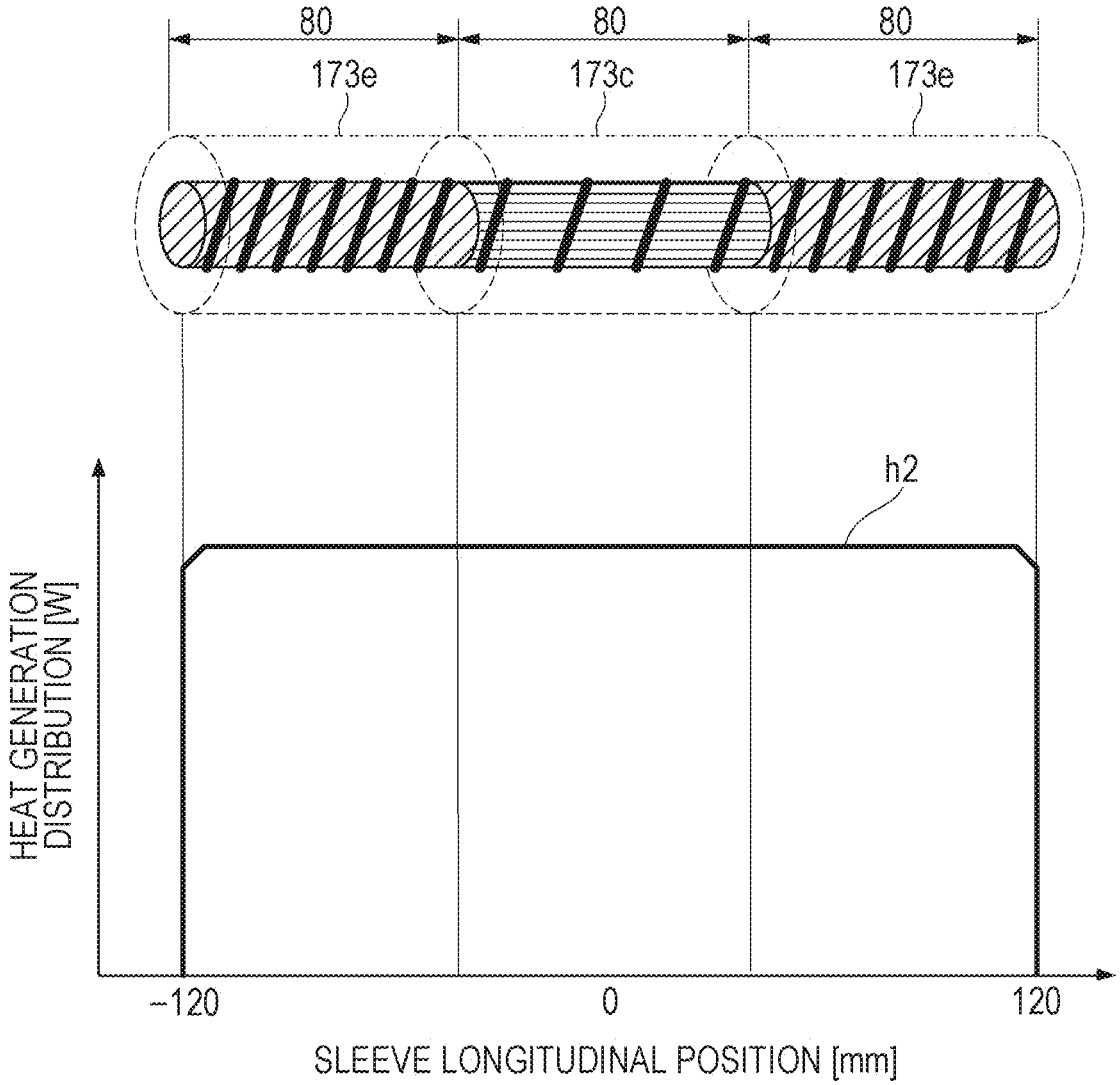
FIG. 20 illustrates a heat generation distribution in a longitudinal direction.

Thus, when the alternating current at the frequency f flows through the exciting coil, as indicated by h2 in FIG. 20, a soaking distribution of the heating value in the end portion and the heating value in the central portion can be generated.

As described above, it is possible to generate the soaking distribution of the heating value in the end portion and the heating value in the central portion.

Figure 21:
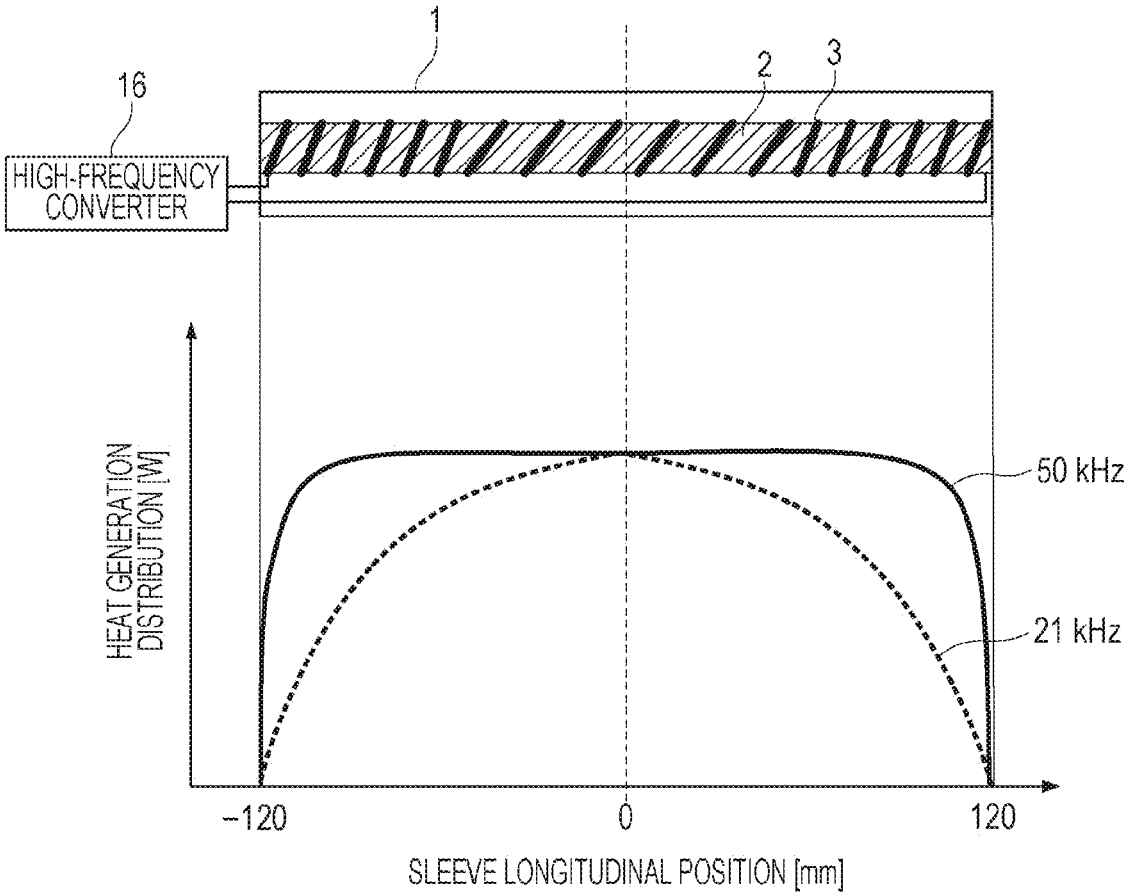
FIG. 21 illustrates a heat generation distribution in a longitudinal direction of the configuration according to the first embodiment.

With the configuration according to the embodiment of the present invention illustrated in FIG. 5, in a case were the alternating current at the driving frequency f=50 kHz flows through the exciting coil, the soaking heat generation as illustrated in FIG. 21 can be obtained, and in a case where the alternating current at f=21 kHz flows, the heat generation distribution where the heating value in the end portion is small can be obtained. Thus, by selecting the frequency at f=50 kHz, the soaking of the heat value in the end portion and the heat value in the central portion can be realized. The value of the frequency f may of course be changed depending on an exciting coil turns ratio, a shape of the magnetic core, and a circumferential resistance of the conductive layer.

7. Power Adjusting Method

Figure 22:
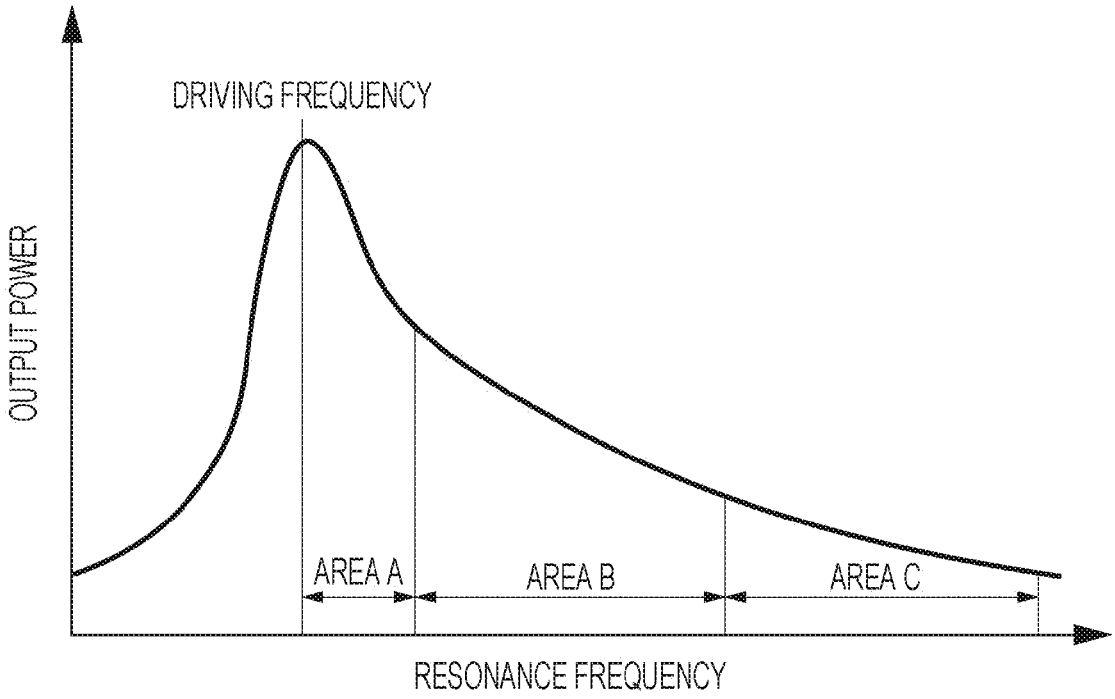
FIG. 22 illustrates a relationship between a driving frequency and output power.
Figure 23:
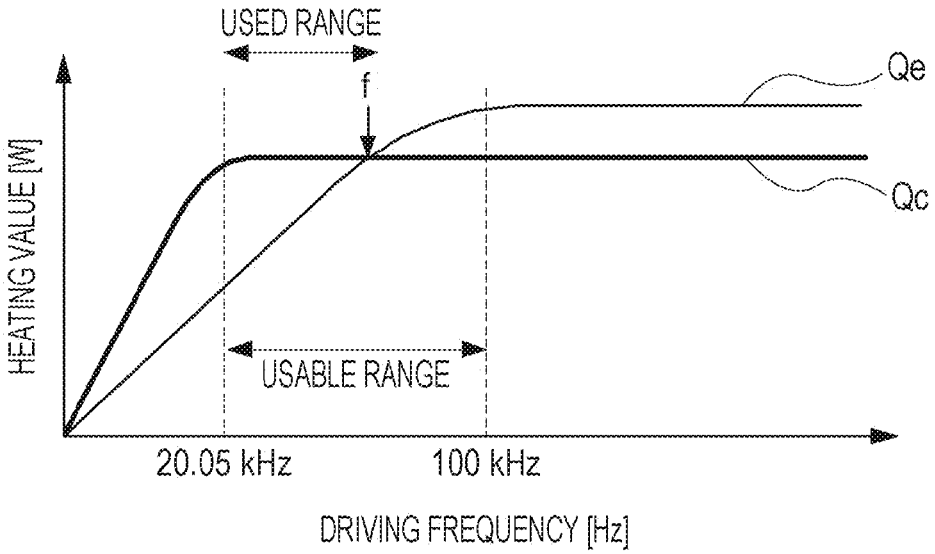
FIG. 23 is a graphic representation on which the frequency characteristics are plotted.

According to the present invention, the soaking of the heat generation distribution is realized by fixing the frequency of the exciting coil to an appropriate value. Hereinafter, a method of adjusting power according to the present embodiment will be described. The image heating apparatus of the electromagnetic induction system in related art generally uses a method of adjusting power by changing a driving frequency of a current. In the electromagnetic induction system where induction heat generation is performed by using a resonance circuit, as illustrated in a graphic representation of FIG. 22, output power is changed by the driving frequency. For example, the output power is maximized in a case where a region A is selected, and the output power is decreased as the frequency is increased from a region B towards a region C. This configuration uses such a property that the power is maximized when the driving frequency is matched with a resonance frequency of the circuit, and the power is decreased as the driving frequency is away from the resonance frequency. That is, according to the method, an output voltage is not changed, and the driving frequency is changed from 21 kHz to 100 kHz in accordance with a temperature difference between a target temperature and the temperature detection member 9 to adjust the output power. However, since the fixation to the desired heat generation distribution according to the present embodiment is the fixation of the frequency, the power cannot be adjusted by the related-art method. In the present specification, the following power adjustment is carried out.

In order that the sleeve 1 has the desired heat generation distribution in the longitudinal direction, the frequency control unit 45 illustrated in FIG. 4 fixes f (the frequency at which the soaking of the heat value in the end portion and the heat value in the central portion can be realized) to 50 kHz. Next, the engine control unit 43 decides a target temperature of the sleeve 1 on the basis of the detection temperature in the temperature detection member 9, recording material information and image information obtained from the printer controller, printing sheet number information, and the like. The power control unit 46 turns ON/OFF the high-frequency converter 16 configured to convert the current flowing through the exciting coil into a predetermined driving frequency to maintain the detected temperature of the temperature detection member 9 at the target temperature.

When the above-described control is used, while the alternating current where the frequency is fixed flows through the exciting coil, and the state is maintained in which the soaking of the heat value in the end portion and the heat value in the central portion is realized, the power can be adjusted.

As described above, according to the present embodiment, advantages are attained that the use of the magnetic core in which the loop is not formed outside the sleeve attributes to the miniaturization of the apparatus and can also form the uniform heat generation distribution in the generatrix direction of the sleeve 1.

Figure 12B:
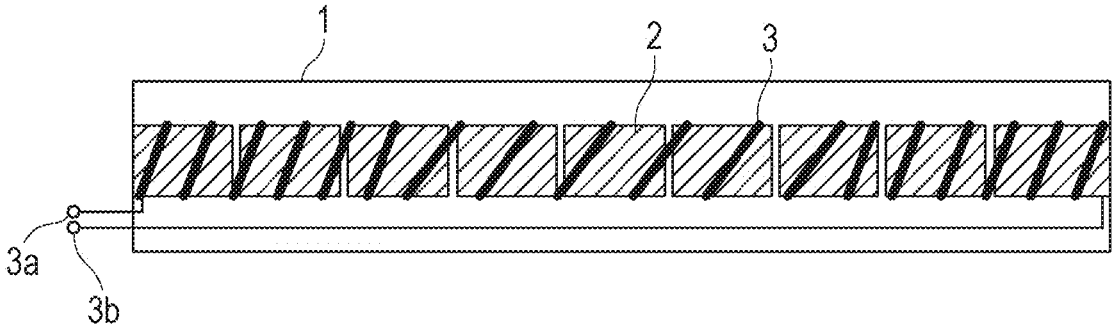
FIG. 12B illustrates a configuration of the exciting coil wound around divided cores.

It is noted that according to the present embodiment, the descriptions of the case where the magnetic core is formed by a single component without being divided have been given, but the magnetic core formed by the divided plural cores as illustrated in FIG. 12B may also be used. In addition, according to the present embodiment, the configuration where the air and the magnetic core having the substantially different permeabilities from each other have the boundary planes perpendicular to the magnetic lines in the magnetic region is supposed. Therefore, in the configuration of an air core that does not have the magnetic core, the problem to be solved by the present embodiment does not occur.

Second Embodiment

When small-size recording materials having a width narrower than the heat generation region of the conductive layer 1*a* are continuously printed, a temperature rise in the non-sheet passing portion occurs. According to the present embodiment, a method of suppressing the temperature rise in the non-sheet passing portion by controlling the driving frequency in accordance with the size of the recording material in the configuration according to the first embodiment will be described.

Figure 24:
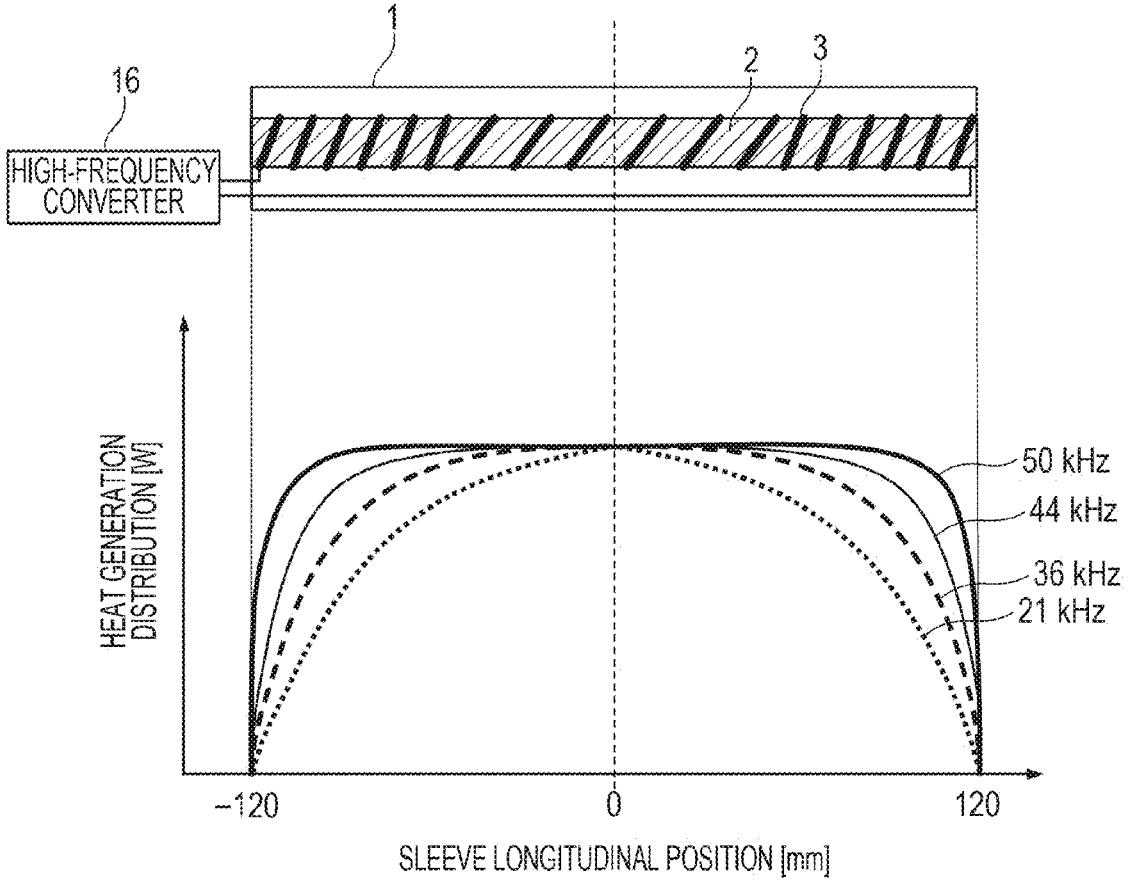
FIG. 24 illustrates a heat generation distribution in a longitudinal direction of the conductive layer according to a second embodiment.
Figure 25:
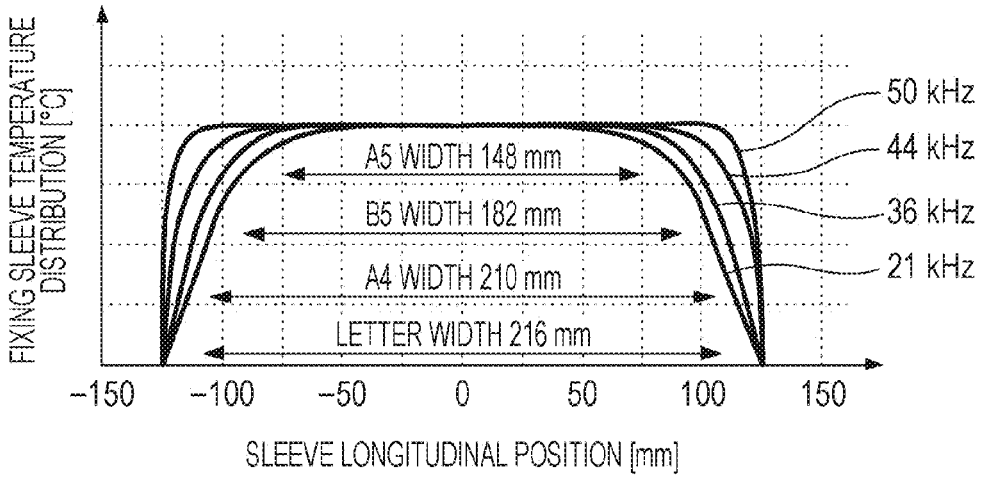
FIG. 25 illustrates a relationship between a driving frequency and a heat generation distribution in accordance with a recording material size.

According to the present embodiment, since configurations of the exciting coil, the magnetic core, the heat generator, and the like are the same as those according to the first embodiment, the descriptions thereof will be omitted. A difference resides in that the driving frequency of the exciting coil is changed in accordance with the size of the recording material. An entire frequency band between 21 kHz corresponding to a lower limit of the usable driving frequency and 50 kHz at which the soaking can be realized is set as a usable range, and the driving frequency of the high-frequency converter 16 is controlled, so that the temperature distribution in the longitudinal direction of the sleeve 1 is changed in accordance with the size of the recording material. The frequency control unit 45 performs a control in a manner that the driving frequency is decreased as the width of the recording material is narrowed, and the temperature rise in the non-sheet passing portion is suppressed. FIG. 24 illustrates a relationship between the driving frequency and the heat generation distribution of the conductive layer 1*a*. As the driving frequency of the power supplied to the exciting coil is decreased starting from 50 kHz, 44 kHz, 38 kHz, and until 21 kHz, it is possible to decrease the heating value in the end portion of the conductive layer 1*a*. By using this property, the control is performed in a manner that the driving frequency is decreased as the width of the recording material is narrowed, and the temperature rise in the non-sheet passing portion is suppressed. Table 1 illustrates a relationship between the recording material size and the driving frequency according to the present embodiment. Similarly, FIG. 25 also illustrates the relationship between the recording material size and the driving frequency.

TABLE 1

| | LETTER SIZE | A4 SIZE | B5 SIZE | A5 SIZE |
|---|---|---|---|---|
| RECORDING MATERIAL SIZE | WIDTH 216 mm LENGTH 279.4 mm | WIDTH 210 mm LENGTH 297 mm | WIDTH 182 mm LENGTH 257 mm | WIDTH 148 mm LENGTH 210 mm |
| DRIVING FREQUENCY | 50 kHz | 44 kHz | 36 kHz | 21 kHz |
| SHEET GAP | 50 mm | 35 mm | 75 mm | 120 mm |

In Table 1, a frequency at the temperature in the end portion is lower with respect to the temperature in the central portion in the generatrix direction of the sleeve 1 by 5% is selected for the driving frequency.

According to the present embodiment, the frequency control unit 45 changes the driving frequency in accordance with the size information of the recording material specified by the user via the host computer 42. The conveyance speed of the recording material according to the present embodiment is set as 250 mm/s, the gaps of the printings of the respective recording materials are set as 50 mm in a letter size, 35 mm in an A4 size, 75 mm in a B5 size, and 120 mm in an A5 size. Accordingly, printing productivities (productivities) of the respective recording materials are set as 45 sheets/minute irrespective of the size of the recording material.

Advantages of Frequency Control

Figure 26:
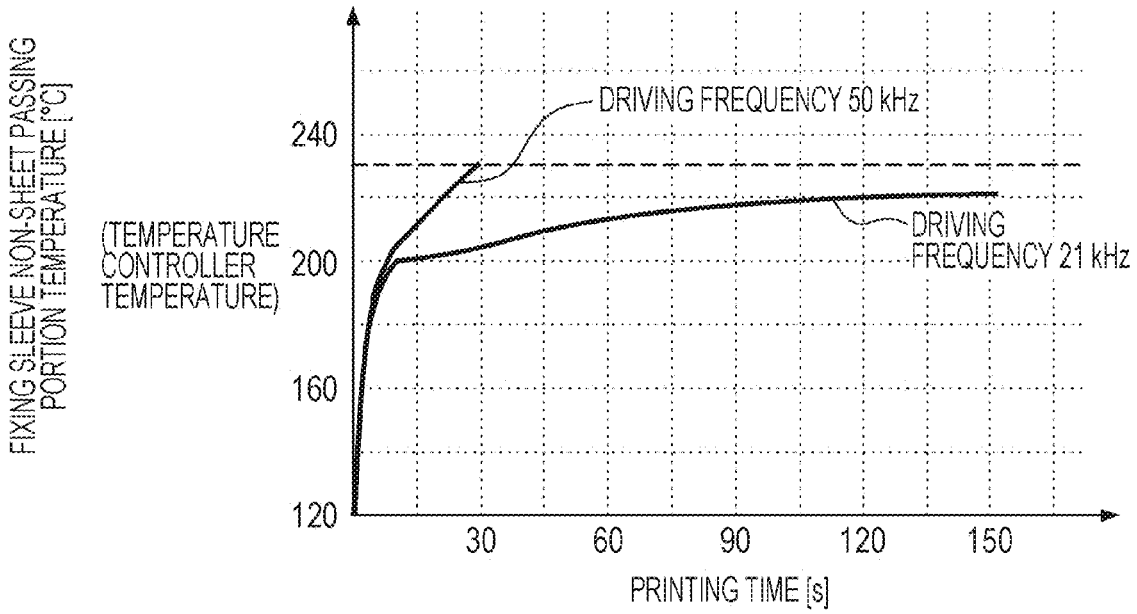
FIG. 26 illustrates a relationship between a printing time and a temperature at a non-sheet passing portion for each frequency.

To confirm the advantages according to the present embodiment, a generation status of the temperature rise in the non-sheet passing portion is compared in a case where the recording material having the A5 size is driven at 21 kHz (the second embodiment) and a case where the recording material having the A5 size is driven at 50 kHz appropriate to the letter size (comparison example 2). An experiment is carried out under such conditions that plain paper having a basis weight of 64 g/m$^2$ is used as the recording material having the A5 size, and the target temperature is set as 200° C. With regard to the temperature in the non-sheet passing portion, the longitudinal entire regions of the fixing film and the pressure roller are imaged by using the infrared thermography R300SR manufactured by Nippon Avionics Co., Ltd., the highest temperature in the non-sheet passing portion is monitored. Specifically, all the temperatures on the outer side of the width of 148 mm (the A5 size) in the longitudinal direction of the fixing film are measured, and the highest temperature among them is picked up as data to be illustrated in FIG. 26. In the case of the second embodiment, even after the sheets are caused to pass for 150 seconds, the temperature in the non-sheet passing portion of the sleeve 1 is increased only up to 220° C., but in the case of the comparison example, the temperature in the non-sheet passing portion reaches 230° C. in 30 seconds at which the fixing device may be damaged. In the case of the comparison example 2, the printing productivity needs to be decreased to be lower than 45 sheets/minute before the time reaches 30 seconds, but according to the second embodiment, advantages are attained that the printing productivity can be maintained at 45 sheets/minute even after the sheets are caused to pass for 150 seconds. In addition, similar advantages are confirmed also in a case where the recording materials having the A4 size and the B5 size are continuously printed.

As described above, according to the present embodiment, the advantages are attained that it is possible to form the heat generation distribution in accordance with the size of the recording material by changing the driving frequency, and it is possible to suppress the temperature rise in the non-sheet passing portion without decreasing the productivity.

Figure 15B:
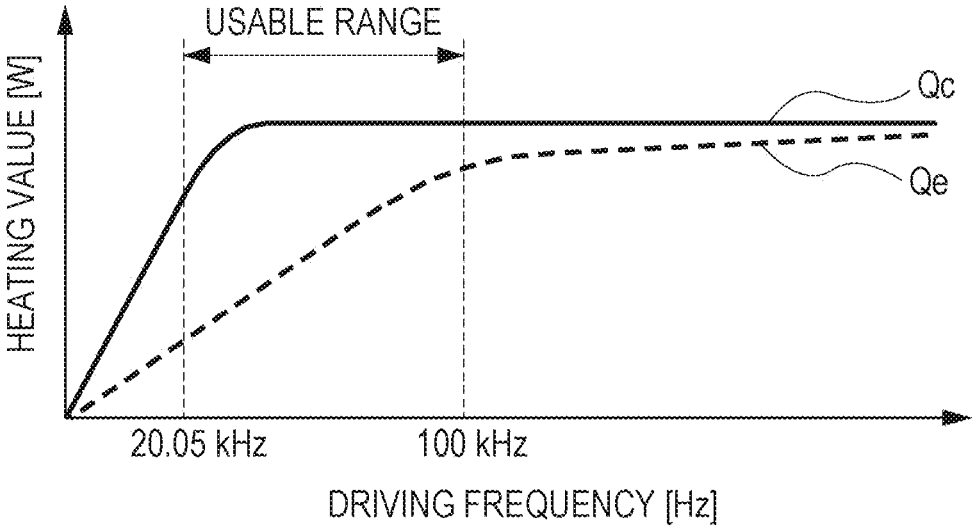
FIG. 15B is a graphic representation on which frequency characteristics are plotted.
Figure 16:
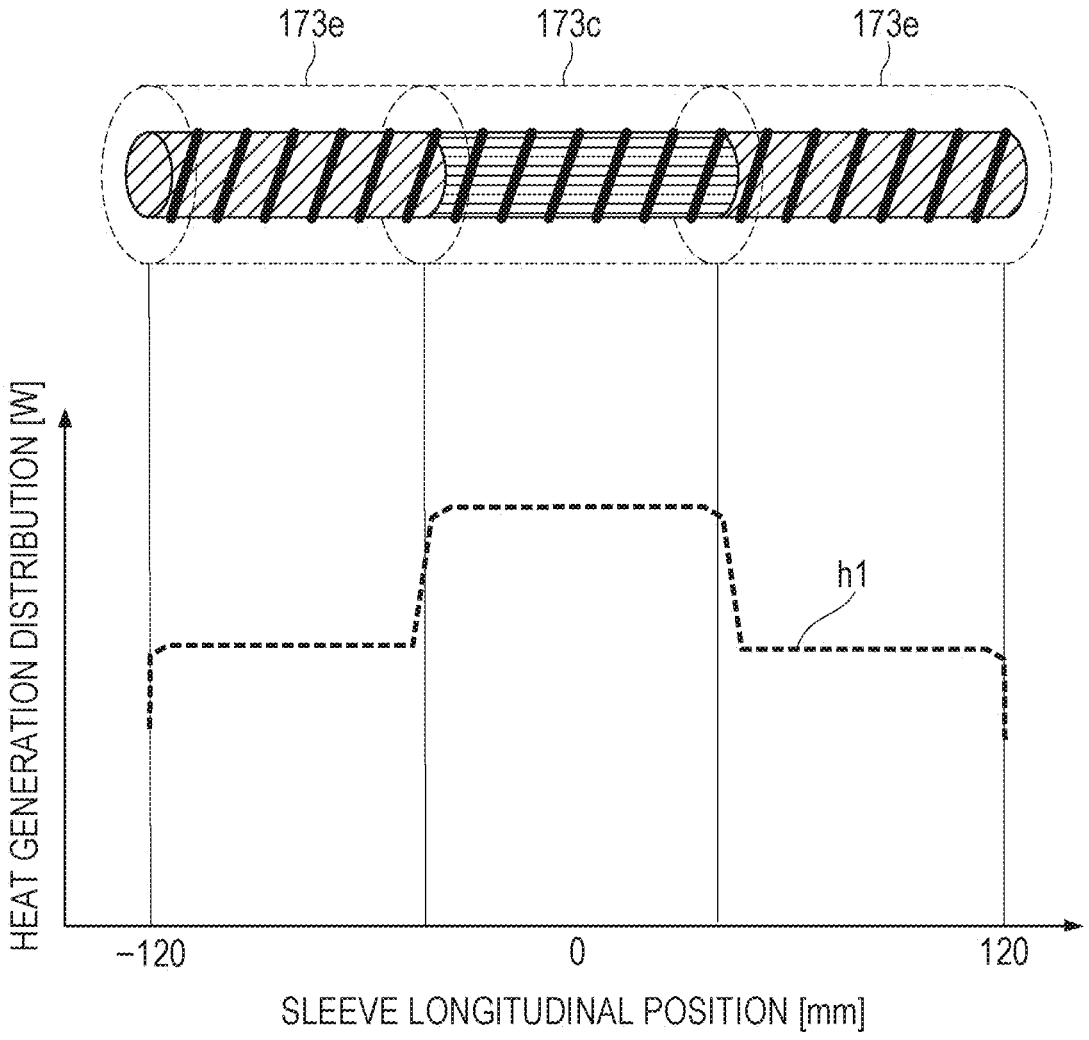
FIG. 16 illustrates heating values in a central portion and an end portion of the conductive layer.

It is noted that the configuration of the image heating apparatus according to the present embodiment is the same as the first embodiment, but the number of turns per unit length of the coil in the end portion does not necessarily need to be higher than the number of turns per unit length of the coil in the central portion, and the number of turns in the central portion may be uniform with the number of turns in the end portion. This is because even when these numbers of turns of the coil are uniform in the longitudinal direction, it may be apparent from FIG. 15B that the heat generation distribution in the longitudinal direction can be changed by changing the driving frequency, and the recording materials from a small size up to a large size can be coped with.

In, according to the present embodiment, the driving frequency is decided on the basis of the size information of the recording material specified by the user via the host computer 42, but units configured to detect size information of the recording material may be provided in the sheet feeding cassette 105 or in the conveyance path, and the driving frequency may be decided on the basis of those detection results.

Third Embodiment

According to the present embodiment, with regard to a method of performing the frequency control in accordance with the recording material size, descriptions will be given of a method of periodically switching two types of the driving frequencies including the driving frequency of 50 kHz and the driving frequency of 21 kHz and suppressing the temperature rise in the non-sheet passing portion in accordance with the sheet passing width of the recording material.

It is noted that the configuration of the image heating apparatus is similar to that according to the first embodiment, and the descriptions thereof will be omitted. Table 2 illustrates a relationship between the recording material size and the driving frequency ratio according to the present embodiment.

TABLE 2

| | LETTER SIZE | A4 SIZE | B5 SIZE | A5 SIZE |
|---|---|---|---|---|
| RECORDING MATERIAL SIZE | WIDTH 216 mm LENGTH 279.4 mm | WIDTH 210 mm LENGTH 297 mm | WIDTH 182 mm LENGTH 257 mm | WIDTH 148 mm LENGTH 210 mm |
| DRIVING FREQUENCY RATIO 50 kHz:21 kHz | 10:0 | 9:1 | 5:5 | 0:10 |

In Table 2, a cycle for switching the driving frequency is set as 100 ms. In addition, a driving frequency ratio is set such that the temperature in the end portion of the sleeve 1 is lower than the temperature in the central portion by 5% in the generatrix direction of the sleeve 1.

Advantages of Frequency Control

Figure 27:
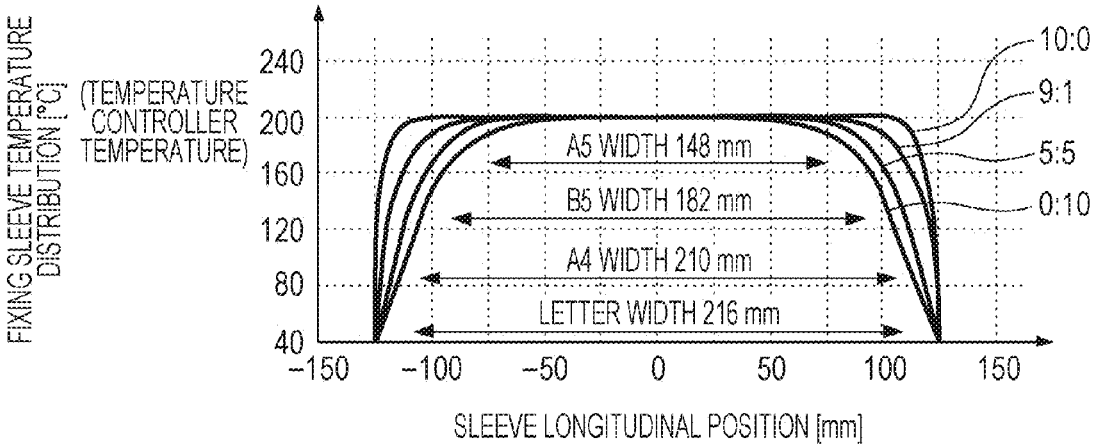
FIG. 27 illustrates a relationship between a driving frequency ratio and a heat generation distribution in accordance with a recording material size.

FIG. 27 is a drawing representing the temperature distribution of the sleeve 1 in the generatrix direction of the sleeve 1 when the driving frequency ratio is changed. From FIG. 27, it may be understood that as the driving frequency ratio is changed from 10:0 to 0:10, the temperature in the end portion of the sleeve 1 is decreased with respect to the temperature in the central portion. With this property, the temperature distribution in accordance with the recording material size is obtained by adjusting the driving frequency ratio, and it is possible to suppress the temperature rise in the non-sheet passing portion.

The equivalent advantages are also obtained in the experiment in which the recording materials having the A4 size and the B5 size are continuously printed. According to the present embodiment too, the small-size recording materials are continuously printed, advantages are attained that the temperature rise in the non-sheet passing portion is suppressed, and the high printing productivity can be maintained.

It is noted that according to the present embodiment too, the number of turns per unit length of the coil in the end portion does not necessarily need to be higher than the number of turns per unit length of the coil in the central portion, and the number of turns in the central portion may be uniform with the number of turns in the end portion. This is because even when the numbers of turns of the coil are uniform in the longitudinal direction, from FIG. 15B, the heat generation distribution in the longitudinal direction can be changed by changing the driving frequency.

In addition, according to the present embodiment, the number of the driving frequency types to be switched is not limited to two, and three or more types of driving frequencies can also be switched and used.

Fourth Embodiment

According to the present embodiment, a method of performing the frequency control in accordance with the number of passing sheets will be described. According to the present embodiment, a control is performed such that the driving frequency is decreased as the number of passing sheets of the recording materials is increased to suppress the temperature rise in the non-sheet passing portion.

Table 3 illustrates a relationship between the driving frequency and the number of passing sheets according to the present embodiment. It is noted that according to the present embodiment, the descriptions will be given while A4 is taken as the example for the size of the recording material.

TABLE 3

| | 1 TO 25 SHEETS | 26 TO 75 SHEETS | 76 TO 150 SHEETS | 151 AND SUBSEQUENT SHEETS |
|---|---|---|---|---|
| COMPARISON EXAMPLE 4 | 50 kHz | | | |
| EMBODIMENT 4-1 | 50 kHz | 45 kHz | | |
| EMBODIMENT 4-2 | 50 kHz | 45 kHz | 40 kHz | |
| EMBODIMENT 4-3 | 50 kHz | 45 kHz | 40 kHz | 35 kHz |

In Table 3, the driving frequency of 50 kHz for the 1st to 25th sheets is a frequency at which the heating value over the entire width region of the recording material having the A4 size in the generatrix direction of the sleeve 1 is set to be uniform in the sleeve 1. As an embodiment 4-1, a control of changing the driving frequency to 45 kHz for the 26th sheet and subsequent sheets is performed. As an embodiment 4-2, a control of further changing the driving frequency to 40 kHz for the 76th sheet and subsequent sheets is performed, and as an embodiment 4-3, a control of further changing the driving frequency to 35 kHz for the 151st sheet and subsequent sheets is performed.

That is, according to the present embodiment, in a case where the heating processing is continuously performed on the plurality of recording materials, when the number of sheets on which the heating processing has been performed exceeds a predetermined number of sheets (25 sheets, 75 sheets, or 150 sheets in Table 3), the driving frequency is set to be lower than that before reaching the relevant predetermined number of sheets.

The conveyance speed of the recording material, the sheet gap of the recording material having the A4 size, the printing productivity, the basis weight of the recording material, and the condition for the temperature controller temperature are similar to those according to the first embodiment.

Advantages of Frequency Control

To confirm the advantages according to the present embodiment, a case where the driving frequency is changed as indicated by the relationship in Table 3 and a case for comparison where the driving frequency is fixed at 50 kHz are compared with each other while 250 sheets are continuously printed. A monochrome character image is printed as the image on the whole recording material while leaving 3 mm margins from the left and right, end portions of the recording material and 5 mm margins from the top and bottom end portions. The temperatures of the sleeve 1 are imaged by using the infrared thermography R300SR manufactured by Nippon Avionics Co., Ltd., and the highest temperature in the non-sheet passing portion is monitored. In addition, to check if a problem occurs in a fixing intensity of the toner, it is checked whether or not a defect of the above-described character image exists.

Figure 28:
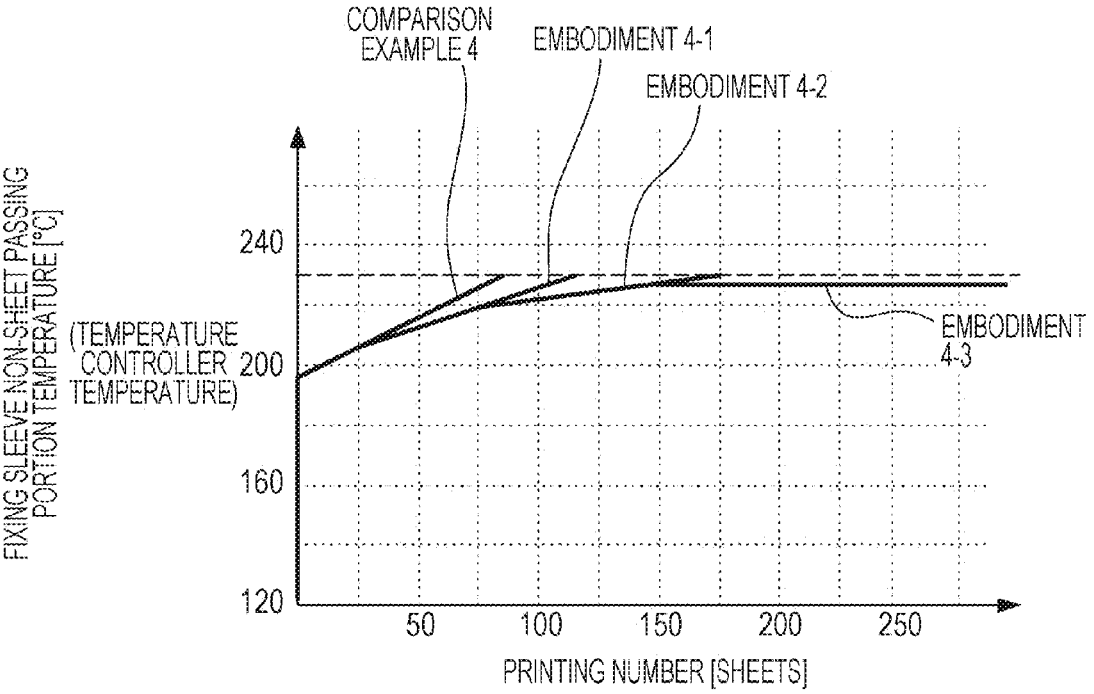
FIG. 28 illustrates a comparison between a comparison example 4 and a fourth embodiment with regard to the relationship between the printing time and the temperature at the non-sheet passing portion for each frequency.

FIG. 28 is a graphic representation of the above-described results. According to the embodiment 4-1, the highest temperature in the non-sheet passing portion reaches 230° C. at which the fixing device may be damaged when 120 sheets are printed. According to the embodiment 4-2, the highest temperature in the non-sheet passing portion reaches 230° C. when 175 sheets are printed, and according to the embodiment 4-3, the highest temperature in the non-sheet passing portion does not reach 230° C. even when 250 or more sheets are printed. On the other hand, in the comparison experiment in which the frequency is fixed to 50 kHz, the temperature in the non-sheet passing portion of the sleeve reaches 230° C. when 80 sheets are printed. A defect of a character image is not observed according to any of the embodiments 4-1, 4-2, and 4-3, and the comparison example, and the results indicate a satisfactory fixing intensity.

Figure 29A:
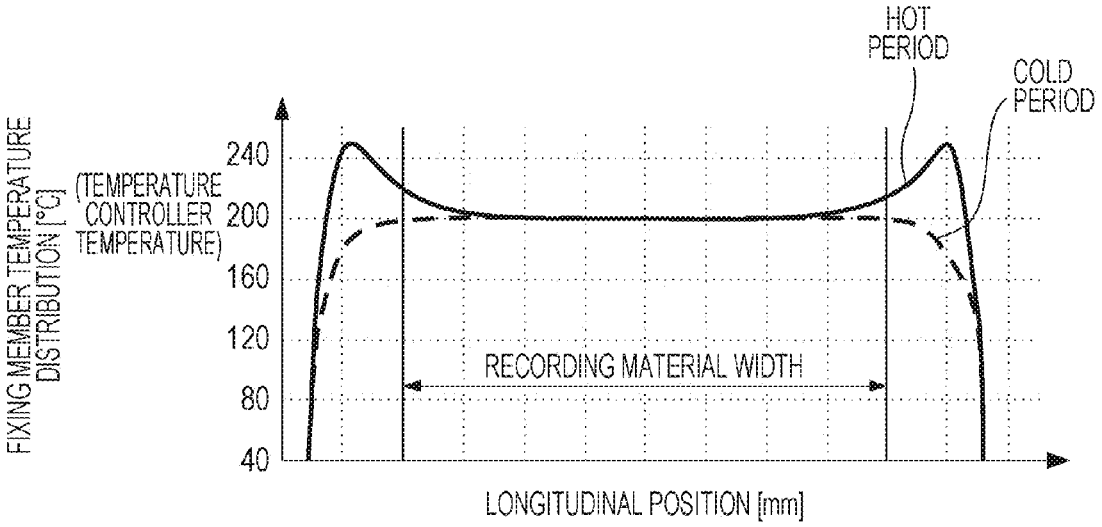
FIG. 29A illustrates a temperature distribution of a sleeve when the driving frequency is 50 kHz.
Figure 29B:
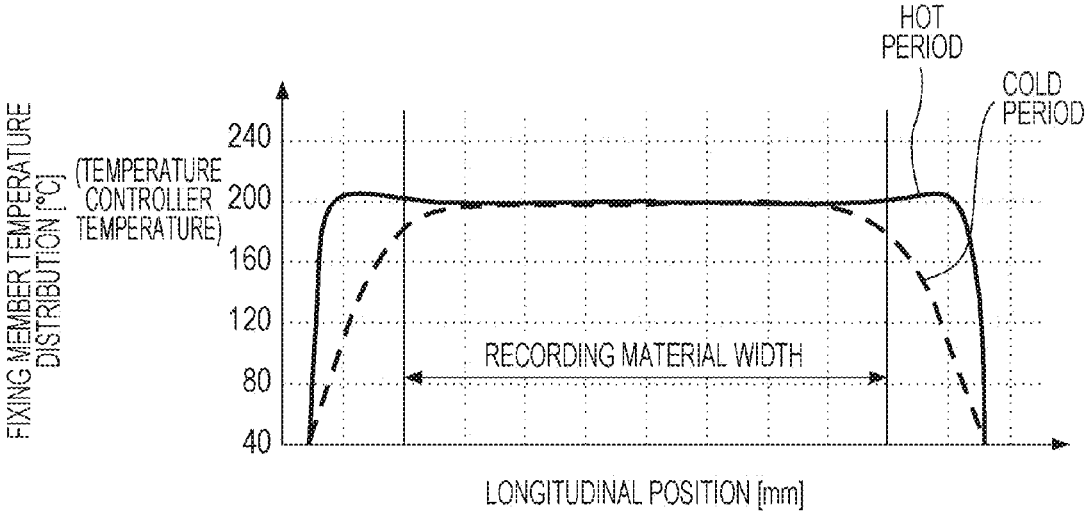
FIG. 29B illustrates a temperature distribution of the sleeve when the driving frequency is 35 kHz.

The above results will be described by FIG. 29A and FIG. 29B. FIG. 29A illustrates the temperature distribution in the longitudinal direction of the sleeve surface when the driving is performed at the driving frequency of 50 kHz. Broken lines in FIGS. 29A and 29B indicate the temperature distribution when the image heating apparatus is started up from a cold state (cold period). Solid lines in FIGS. 29A and 29B indicate the temperature distributions when the image heating apparatus is warmed up after the continuous printing (hot period). The heat generated outside the width of the recording material is accumulated during the printing, so that the temperature in the non-sheet passing portion is increased. On the other hand, FIG. 29B illustrates the temperature distribution when the driving is performed at the frequency of 35 kHz. The temperature cannot be held at 200° C. in the end portion of the recording material during the cold period, but the soaking over the entire width region of the recording material is substantially realized during the hot period.

According to the present embodiment 4-3, the driving frequency is decreased stepwise from the driving frequency of 50 kHz. That is, the printing is started in the temperature distribution as indicated by the broken line in FIG. 29A, and before the temperature distribution reaches a state as indicated by the solid line in FIG. 29A, the driving frequency is decreased stepwise to finally perform the driving at 35 kHz. That is, the final temperature distribution turns to the temperature distribution as indicated by the solid line in FIG. 29B. When the driving frequency is set as 35 kHz during the cold period in which the sleeve does not reserve the heat, the temperature decrease in both the end portions as indicated by the broken line in FIG. 29B is observed. However, when the sleeve reserves the heat after the printing operation is continued for a while the driving frequency is set as 50 kHz (hot period), the temperature in both the end portions is not decreased even when the driving frequency is switched to 35 kHz, and the fixing intensity is not also degraded.

As described above, according to the present embodiment, advantages are attained that the temperature rise in the non-sheet passing portion at the time of the continuous printing can be suppressed without decreasing the printing productivity.

It is noted that according to the present embodiment too, the number of turns per unit length of the coil in the end portion does not necessarily need to be higher than the number of turns per unit length of the coil in the central portion, and the number of turns in the central portion may be uniform with the number of turns in the end portion. This is because even when the numbers of turns of the coil are uniform in the longitudinal direction, from FIG. 15B, the heat generation distribution in the longitudinal direction can be changed by changing the driving frequency.

In addition, according to the present embodiment, the frequency is changed in accordance with the number of printing sheets, but the configuration is not limited to this. For example, the frequency may be controlled by using an integrated time for the sheets to pass through the fixing nip part, a time calculated by subtracting a time for the fixing device to idly rotate from the integrated time for the sheets to pass through the fixing nip part, and the like. In addition, the frequency may be controlled by using an integrated distance for the sheets to pass through the fixing nip part, a distance calculated by subtracting a distance for the fixing device to idly rotate from the integrated distance for the sheets to pass through the fixing nip part, and the like. Moreover, a method of changing a ratio for switching two or more frequencies in accordance with the number of sheets as described in the third embodiment may be adopted.

Fifth Embodiment

The present embodiment is different from the fourth embodiment in that the driving frequency is changed on the basis of the detection result of the temperature detection member 10 or 11 arranged in the non-sheet passing portion of the image heating apparatus to suppress the temperature rise in the non-sheet passing portion at the time of the continuous printing. According to the present embodiment, since the configuration is the same as the first embodiment, the descriptions thereof will be omitted.

Figure 30:
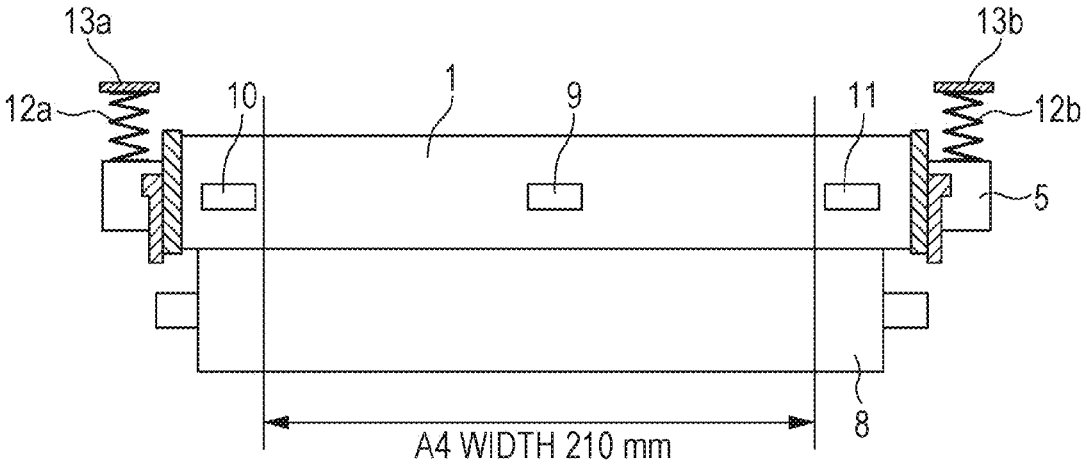
FIG. 30 is a front view of the main part of the image heating apparatus according to a fifth embodiment.

FIG. 30A is a schematic front view of the main part of the image heating apparatus according to the present embodiment. The temperature detection member 10 or 11 is arranged in the non-sheet passing portion corresponding to the time when the recording material having the A4 size passes according to the present embodiment. The control unit 46 and the frequency control unit 45 control the driving frequency on the basis of the temperature detected by the temperature detection member 10 or 11 of the non-sheet passing portion of the sleeve 1. Specifically, an upper limit temperature of the temperature detection member 10 or 11 is set, and the frequency is decreased when the detection temperature of the temperature detection member 10 or 11 is higher than the upper limit temperature, and the frequency is increased when the detection temperature is lower than the upper limit temperature. Accordingly, it is possible to perform the control in a manner that the temperature in the non-sheet passing portion of the sleeve does not exceed the upper limit temperature (according to the present embodiment, 230° C.).

TABLE 4

| | DETECTION RESULT | DRIVING FREQUENCY |
|---|---|---|
| #01 | 170° C. OR LOWER | 50 kHz |
| #02 | 171-190 | 45 kHz |
| #03 | 191-210 | 40 kHz |
| #04 | 211° C. OR HIGHER | 35 kHz |

In addition, an application of a control method as illustrated in Table 4 is also conceivable. For example, (#01) when the detection result of the temperature detection member 10 or 11 is lower than or equal to 170° C., the frequency is set as 50 kHz, (#02) when the detection result is in a range from 171 to 190° C., the frequency is set as 45 kHz, (#03) when the detection result is in a range from 191 to 210° C., the frequency is set as 40 kHz, and (#04) when the detection result is higher than or equal to 210° C., the frequency is set as 35 kHz. With this setting, since the heat generation distribution is gradually changed by the stepwise frequency changes, it is possible to perform the control in a manner that overshoot or undershoot of the temperature in the non-sheet passing portion of the sleeve does not occur.

According to the present embodiment, the advantages are attained that the temperature rise in the non-sheet passing portion of the image heating apparatus corresponding to the time when the small-size recording materials are continuously printed can be suppressed.

It is noted that according to the present embodiment too, the number of turns per unit length of the coil in the end portion does not necessarily need to be higher than the number of turns per unit length of the coil in the central portion, and the number of turns in the central portion may be uniform with the number of turns in the end portion. This is because even when the numbers of turns of the coil are uniform in the longitudinal direction, from FIG. 15B, the heat generation distribution in the longitudinal direction can be changed by changing the driving frequency.

Sixth Embodiment

Next, a frequency control in accordance with printing information according to the present embodiment will be described. In FIG. 3, when the printer controller 41 receives image data from the host computer 42, the printer controller 41 transmits a printing signal to the engine control unit 43 and also converts the received image data into bitmap data. The engine control unit 43 having an image processing function performs laser light scanning in accordance with an image signal derived from this bitmap data. Herein, the image forming apparatus according to the present embodiment obtains the printing information from the image signal converted into the bitmap data in the printer controller 41.

The printing information refers to data correlated to the toner amount borne on the recording material P and includes density information and a printing rate, toner overlapping information of a plurality of colors in a color laser printer, and the like. In the image forming apparatus according to the present embodiment, a printing rate D is used.

Figure 31:
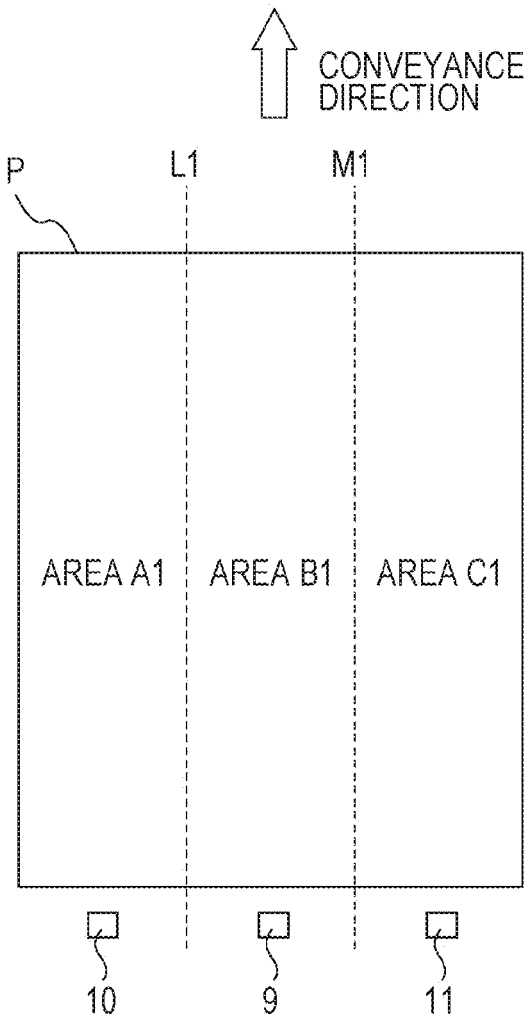
FIG. 31 illustrates an area diving method for obtaining printing rate information.

The obtainment of the printing rate information by the printer controller 41 is performed by dividing a printing region formed on the recording material P into an area A1, an area B1, and an area C1 which are divided by broken lines L1 and M1 and detecting the printing rates D in the respective areas as illustrated in FIG. 31. It is noted that according to the present embodiment, the temperature detection member 9 is located in a region of the divided area B1, the temperature detection member 10 is located in a region of be divided area A1, and the temperature detection member 11 is located in a region of the divided area C1. In addition, the area division is not limited to the division into the three areas, and the temperature detection members are also not limited to the configuration where the temperature detection members are allocated to the respective areas.

The obtained information of the printing rate D is transmitted to the engine control unit 43. The engine control unit 43 stores a table as illustrated in Table 5 below and decides the driving frequency on the basis of this table. Specifically, the driving frequency is set as 36 kHz at the time of #01 in Table 5, the driving frequency is similarly set as 30 kHz at the time of #02, the driving frequency is set as 36 kHz at the time of #03, and the driving frequency is set as 21 kHz at the time of #04.

TABLE 5

| | PRINTING RATE D IN AREA A1 OR AREA C1 (%) | PRINTING RATE D IN AREA B1 (%) | DRIVING FREQUENCY (kHz) |
|---|---|---|---|
| #01 | 10 ≤ D | 10 ≤ D | 36 |
| #02 | D < 10 | D < 10 | 30 |
| #03 | 10 ≤ D | D < 10 | 36 |
| #04 | D < 10 | 10 ≤ D | 21 |

It is noted that, in the image forming apparatus according to the present embodiment, as illustrated in Table 5, the driving frequency is changed stepwise in the stated order of 21 kHz, 30 kHz, and 36 kHz in accordance with the printing rate D for each area.

As illustrated in FIG. 31, the power control unit 46 normally performs a control of the power supplied to the image heating apparatus A on the basis of the temperature detected by the temperature detection member 9 arranged at the position corresponding to the center of the recording material. Therefore, the power control is performed on the basis of the detected temperature of the temperature detection member 9 at the time of #01, #02, and #04 in Table 5 described above. Then, at the time of #03 in Table 5 described above, for the purpose of guarantee the fixing property of the area A1 or C1, the power control is performed on the basis of the detection temperature of the temperature detection member 10 or 11 corresponding to the position of the areas A1 or C1. This is because, when the temperature distribution in the longitudinal direction of the sleeve 1 is generated, the temperature of the sleeve in the area having a high printing rate is to be held at a desired fixing temperature (according to the present embodiment, 200° C.) Accordingly, the fixing quality can be more reliably guaranteed. In addition, the engine control unit 43 sets the heat generation distribution and the temperature of the sleeve to be appropriate to the image pattern on the basis of the printing information by using the frequency control unit 45 and the power control unit 46.

Advantages of Frequency Control

To confirm the advantages according to the present embodiment, when the recording material having the B5 size passes through, 250 sheets are continuously printed in a case where the driving frequency is changed as indicated by the relationship in Table 5 and a case where the driving frequency is fixed at 36 kHz as a comparison example 6-1 for comparison. Two types of images illustrated in FIG. 32A (corresponding to #03 in Table 5, and the frequency is 36 kHz) and FIG. 32B (corresponding to #04 in Table 5, and the frequency is 21 kHz) are alternately printed as the images. Furthermore, as a comparison example 6-2, the driving frequency is fixed at 36 kHz, and an image having a low printing rate where the printing rate of the whole area is lower than or equal to 5% is printed as the image. The temperatures in the non-sheet passing portion of the sleeve 1 at this time are imaged by using the infrared thermography R300SR manufactured by Nippon Avionics Co., Ltd., and the highest temperature in the non-sheet passing portion for the B5 size is monitored by a similar method to the second embodiment.

Figure 33:
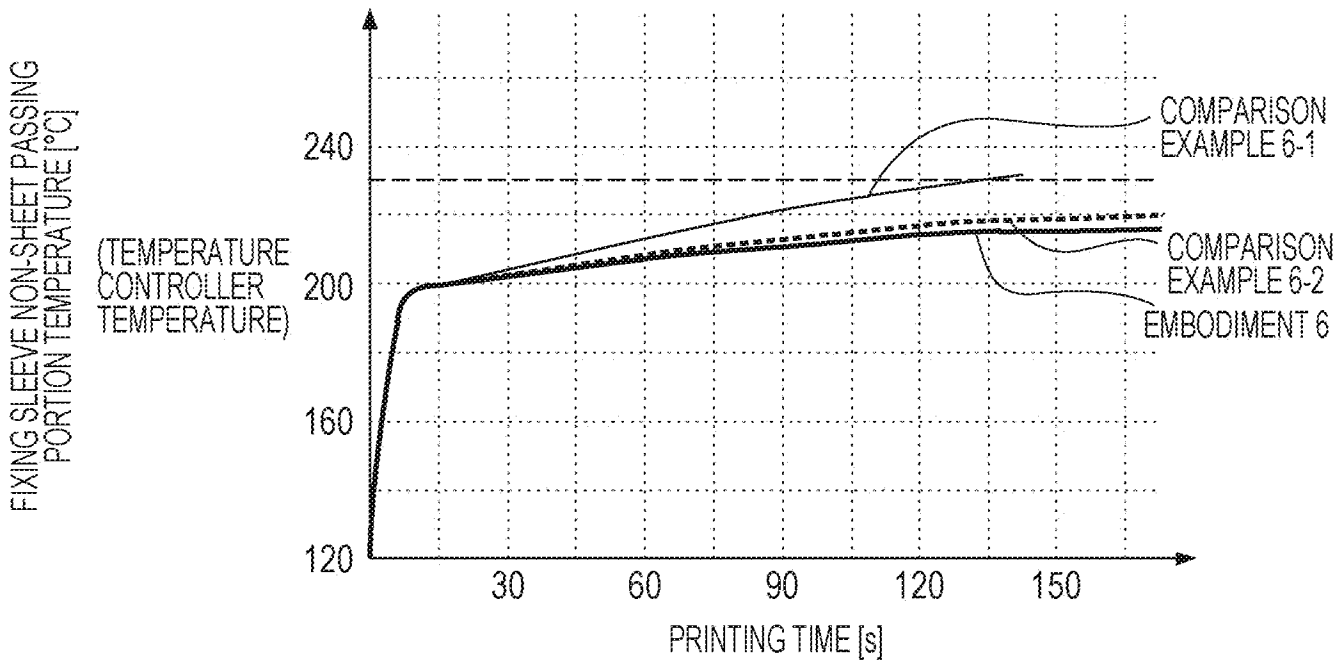
FIG. 33 is an explanatory diagram for describing a cockling index.

FIG. 33 illustrates results of the above-described experiments. According to the comparison example 6-1, the temperature in the non-sheet passing portion of the sleeve reaches the upper limit temperature (230° C.) in 150 seconds. According to the comparison example 6-2, because of the low printing rate, the power during the sheet passing is low, and the temperature of the temperature rise in the non-sheet passing portion is slightly decreased and is lower than or equal to 220° C. According to the sixth embodiment, although the configuration is disadvantageous in terms of the temperature rise in the non-sheet passing portion since the printing rate is high and the power supplied to the image heating apparatus is high, it is possible to suppress the highest temperature in the non-sheet passing portion to be lower than or equal to 220° C. In addition, according to the sixth embodiment, the defect of the character image is not observed, and the result of the satisfactory fixing intensity is attained.

As described above, the advantages are attained that the temperature rise in the non-sheet passing portion can be suppressed without relying on the printing information according to the present embodiment.

It is noted that according to the present embodiment too, the number of turns per unit length of the coil in the end portion does not necessarily need to be higher than the number of turns per unit length of the coil in the central portion, and the number of turns in the central portion may be uniform with the number of turns in the end portion. This is because even when the numbers of turns of the coil are uniform in the longitudinal direction, from FIG. 15B, the heat generation distribution in the longitudinal direction can be changed by changing the driving frequency.

In addition, according to the present embodiment too, the ratio for switching the two or more frequencies may be changed in accordance with the printing information as in the third embodiment.

Seventh Embodiment

Figure 34A:
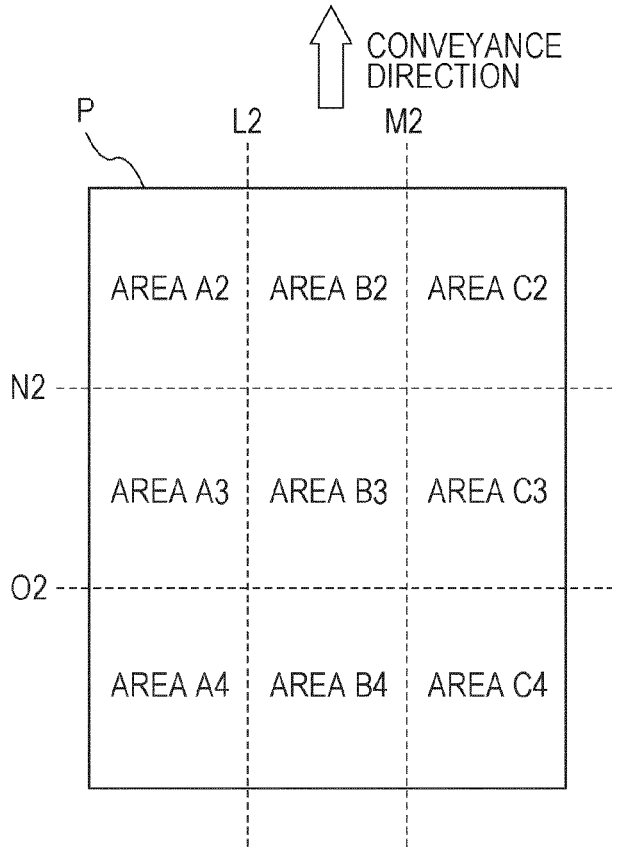
FIG. 34A illustrates an area dividing method for obtaining the printing rate information.
Figure 34B:
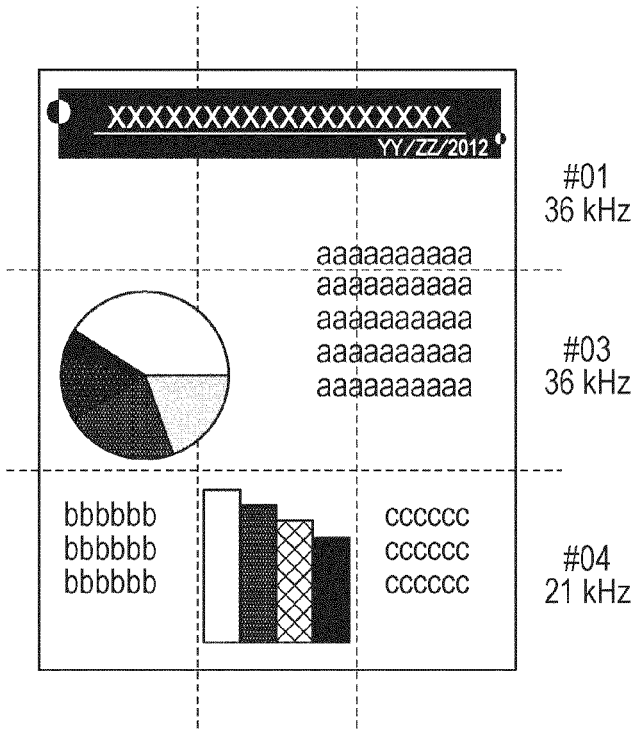
FIG. 34B illustrates another image pattern.

The image forming apparatus according to the present embodiment also performs area division in the conveyance direction of the recording material as illustrated in FIG. 34A and also changes the driving frequency while the recording material is conveyed in the nip part N. While this control is performed, in an image pattern having different printing rates in the conveyance direction of the recording material, it is also possible to appropriately perform the heating for each area of the image formed on the recording material P like the image as illustrated in FIG. 34B.

Figure 32A:
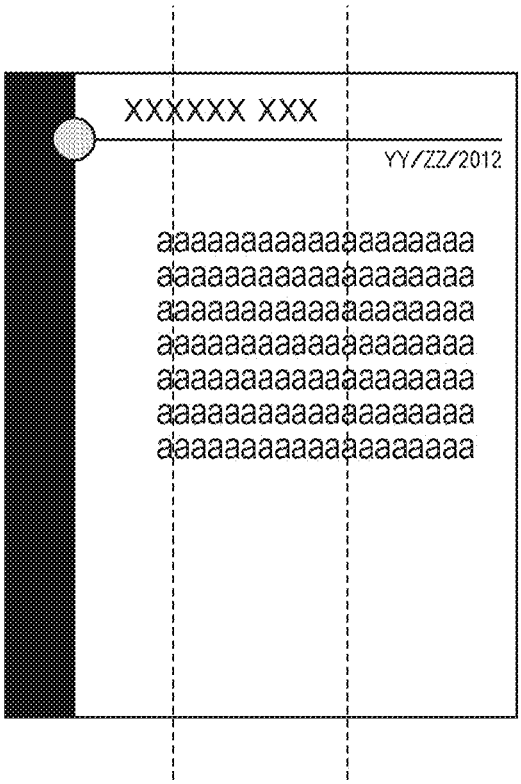
FIG. 32A illustrates an image pattern.
Figure 32B:
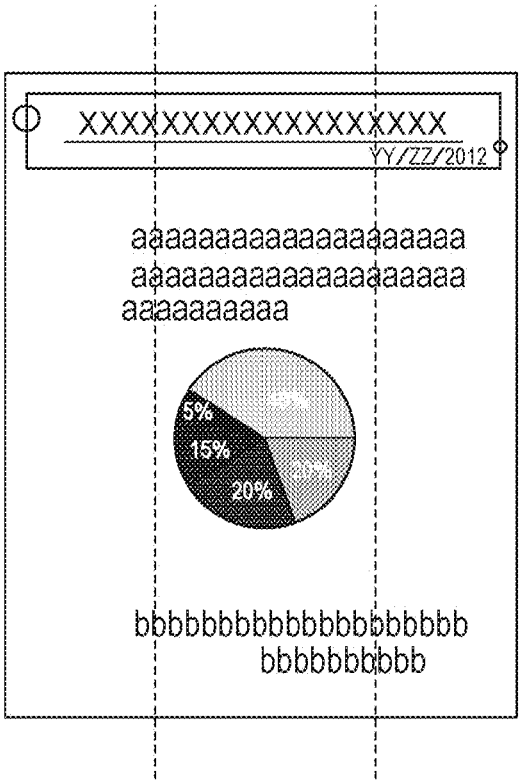
FIG. 32B illustrates another image pattern.
Figure 35:
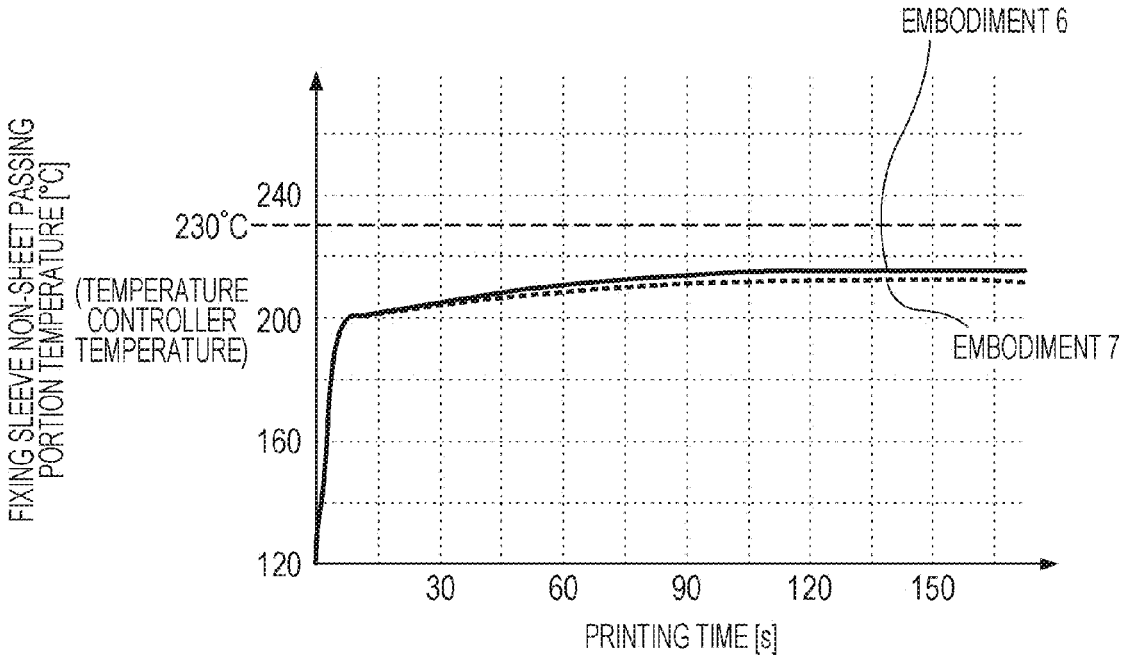
FIG. 35 illustrates a relationship between the printing time and the temperature at the non-sheet passing portion for each frequency.

To confirm the advantages, according to the present embodiment, when the recording material having the B5 size passes through, the area division is carried out in both a direction perpendicular to the conveyance direction of the recording material and the conveyance direction of the recording material, and 250 sheets are continuously printed in the case of changing the driving frequency and the case of the sixth embodiment for comparison. Two types of images illustrated in FIG. 32A and FIG. 34B are alternately printed. In the case of the image illustrated in FIG. 34B, with the method according to the present embodiment, the fixing operation is performed while changing #01 (36 kHz), #03 (36 kHz), and #04 (21 kHz) within the page. The temperatures in the non-sheet passing portion of the sleeve 1 at this time are imaged by using the infrared thermography R300SR manufactured by Nippon Avionics Co., Ltd., and the highest temperature is monitored by the same method as the sixth embodiment. The results are illustrated in FIG. 35.

According to the seventh embodiment, the highest temperature in the non-sheet passing portion is 210° C. According to the sixth embodiment, the temperature in the non-sheet passing portion of the sleeve reaches 215° C. The defect of the character image is not observed in the sixth and seventh embodiments, and the result of the satisfactory fixing intensity is attained.

As described above, according to the present embodiment, the advantages are attained that the temperature rise in the non-sheet passing portion can be further suppressed than the sixth embodiment without relying on the printing information.

In addition, as described in the third embodiment, the ratio for switching the two or more frequencies may be changed in accordance with the printing information.

Eighth Embodiment

According to the present embodiment, a power conversion efficiency of the image heating apparatus according to the first to seventh embodiments will be described. The image heating apparatus is the same as that described in the first embodiment, and the descriptions thereof will be omitted.

First, a heat generation mechanism of the image heating apparatus according to the first to seventh embodiments of the present specification will be described. The magnetic lines, which are generated when the alternating current flows through the coil, pass through the inside, of the magnetic core 2 on the inner side of the tubular conductive layer in a generatrix direction of the conductive layer 1*a* (direction from S towards N). Then, the magnetic lines exit from one end (N) of the magnetic core 2 to the outer side of the conductive layer to return to the other end of the magnetic core 2. As a result, the induced electromotive force for generating the magnetic lines in the direction for inhibiting the increase or decrease of the magnetic flux that penetrates through the inside of the conductive layer 1*a* in the generatrix direction of the conductive layer 1*a* is generated in the conductive layer 1*a* to induce the current in the circumferential direction of the conductive layer. The conductive layer generates heat by Joule's heat by this induction current. A magnitude of this induced electromotive force V generated in the conductive layer 1*a* is proportional to a variation ($\Delta\phi/\Delta t$) of the magnetic flux per unit time which passes through the inside of the conductive layer 1*a* and the number of turns of the coil from the following expression (500).

[Math 7]

$$V = -N\frac{\Delta\Phi}{\Delta t} \tag{500}$$

Figure 36A:
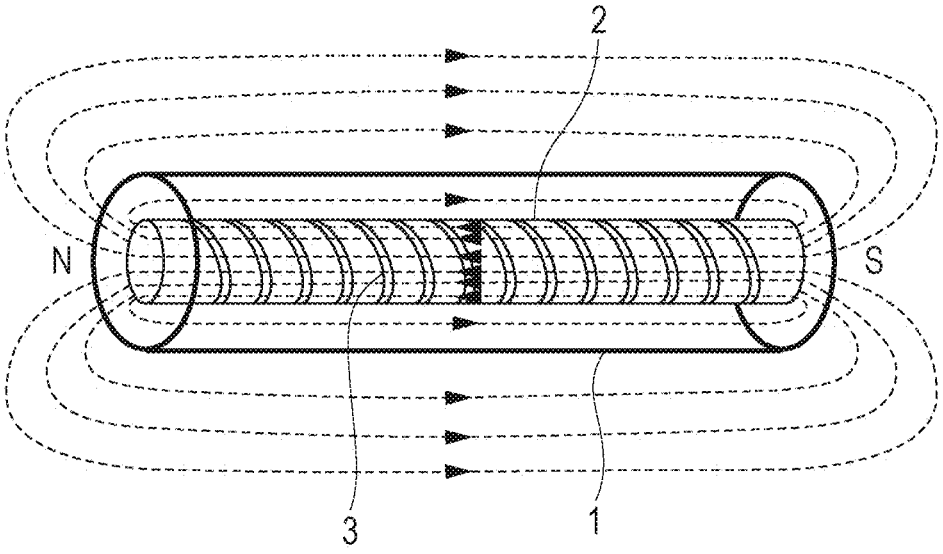
FIG. 36A illustrates a magnetic flux route of an open magnetic path.
Figure 36B:
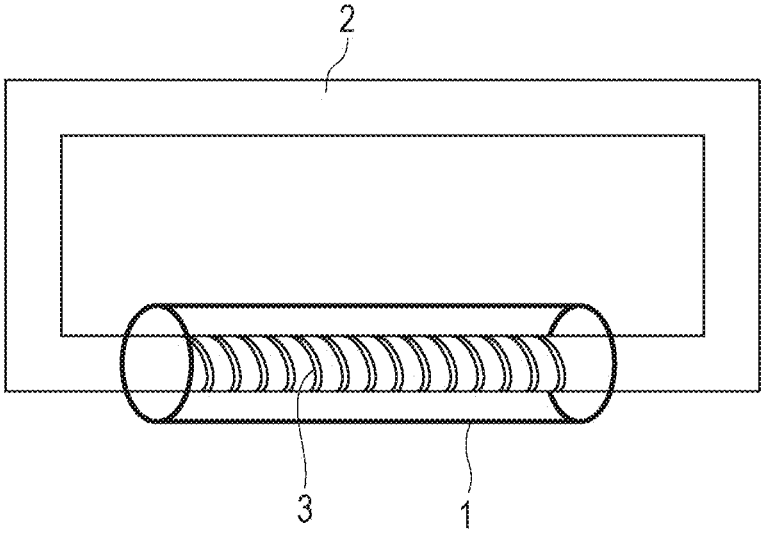
FIG. 36B illustrates a magnetic flux route of the closed magnetic path.

(1) Relationship Between Percentage of Magnetic Flux that Passes Through Outer Side of Conductive Layer and Power Conversion Efficiency Incidentally, the magnetic core 2 of FIG. 36A has a shape with the end portions without forming a loop. The magnetic lines in the image heating apparatus where the magnetic core 2 forms a loop outside the conductive layer 1*a* as illustrated in FIG. 36B are induced to the magnetic core 2 and exit from the inside of the conductive layer to the outside to return to the inside. However, in the case of the configuration where the magnetic core 2 has the end portions as in the present embodiment, no components induce the magnetic lines that have exited from one end of the magnetic core 2. Thus, paths (N to S) for the magnetic lines that have exited from one end of the magnetic core 2 to return to the other end of the magnetic core 2 may pass through an outside route passing though the outside of the conductive layer as well as an inside route passing though the inside of the conductive layer. Hereinafter, the route from N towards S of the magnetic core 2 by passing through the outside of the conductive layer will be referred to outside route, and the route from N towards S of the magnetic core 2 by passing through the inside of the conductive layer will be referred to inside route.

A percentage of the magnetic lines that pass through the outside route among the magnetic lines that have exited from this end of the magnetic core 2 has a correlation with the power consumed by the heat generation in the conductive layer among the power input to the coil (power conversion efficiency) and is an important parameter. As the percentage of the magnetic lines that pass through the outside route is increased, the percentage of the power consumed by the heat generation in the conductive layer among the power input to the coil (power conversion efficiency) is increased. This reason is the same as the principle in which the power conversion efficiency is increased when flux leakage in the transformer is sufficiently small, and the number of the magnetic fluxes that pass through the primary coil and the number of the magnetic fluxes, that pass through the secondary coil are equal to each other. That is, according to the present embodiment, as the number of the magnetic fluxes that pass through the inside of the magnetic core and the number of the magnetic fluxes that pass through the outside route are closer to each other, the power conversion efficiency is increased, and the high-frequency current that flows through the coil can be electromagnetically induced efficiently as the circumferential current of the conductive layer.

This is because, since the direction for the magnetic lines passing through the inside of the core from S towards N in FIG. 36A is opposite to the direction for the magnetic lines passing though the inside route, these magnetic lines are cancelled by each other as seen from the entirety of the inner side of the conductive layer 1*a* including the magnetic core 2. As a result, the number of the magnetic lines (magnetic fluxes) passing through the entirety of the inner side of the conductive layer 1*a* from S towards N is decreased, and the variation of the magnetic flux per unit time is decreased. When the variation of the magnetic flux per unit time is decreased, the induced electromotive force generated in the conductive layer 1*a* is reduced, and the heating value of the conductive layer is decreased.

From the above-described aspects, it is important to manage the percentage of the magnetic lines that pass through the outside route to obtain the necessary power conversion efficiency for the image heating apparatus according to the present embodiment.

(2) Index Indicating Percentage of Magnetic Flux that Passes Through Outer Side of Conductive Layer In view of the above, an ease for the magnetic lines to pass through the outside route in the image heating apparatus will be represented by an index called permeance. First, a concept of a general magnetic circuit will be described. A circuit of a magnetic path through which magnetic lines pass is referred to as magnetic circuit. When a magnetic flux is calculated in the magnetic circuit, the calculation can be performed in accordance with a calculation for a current of an electric circuit. Ohm's law related to the electric circuit can be applied to the magnetic circuit. When a magnetic flux corresponding to the current of the electric circuit is set as Φ, a magnetomotive force corresponding to an electromotive force is set as V, and a magnetic resistance corresponding to the electric resistance is set as R, the following expression (501) is satisfied.

$$\Phi = V/R \tag{501}$$

However, descriptions will be given by using a permeance P corresponding to an inverse number of the magnetic resistance R to facilitate a better understanding of the principle herein. When the permeance P is used, the above-described expression (501) can be represented as the following expression (502).

$$\Phi = V \times P \tag{502}$$

Furthermore, when a length of the magnetic path is set as B, a cross-sectional area of the magnetic path is set as S, and a permeability of the magnetic path is set as μ, the permeance P can be represented as the following expression (503).

$$P = \mu \times S/B \tag{503}$$

The permeance P is proportional to the cross-sectional area S and the permeability μ, and is inversely proportional to the length B of the magnetic path.

Figure 37A:
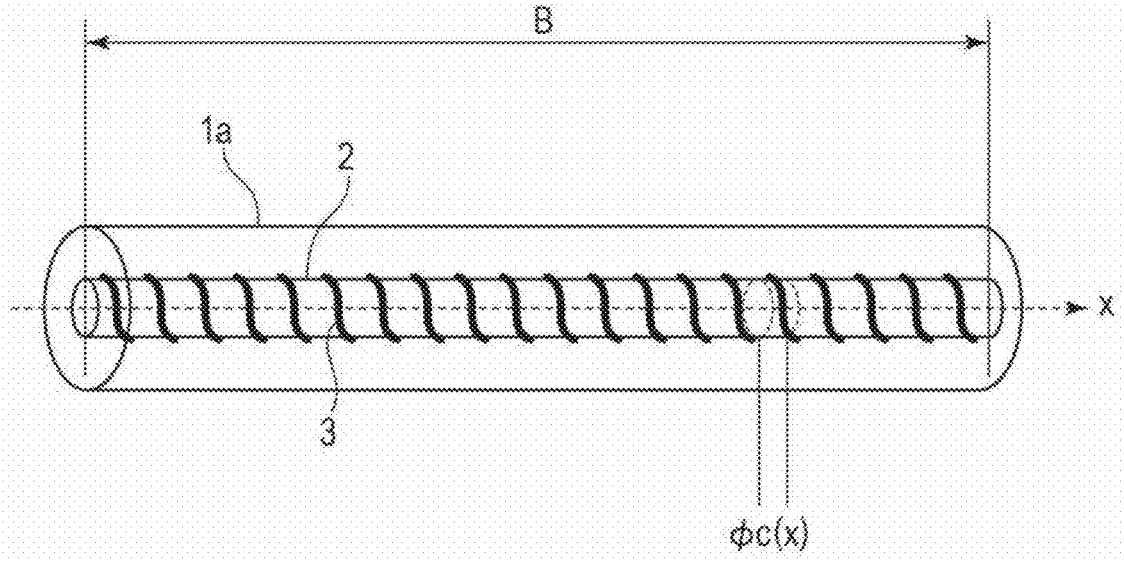
FIG. 37A illustrates the magnetic core, the exciting coil, and the conductive layer.
Figure 37B:
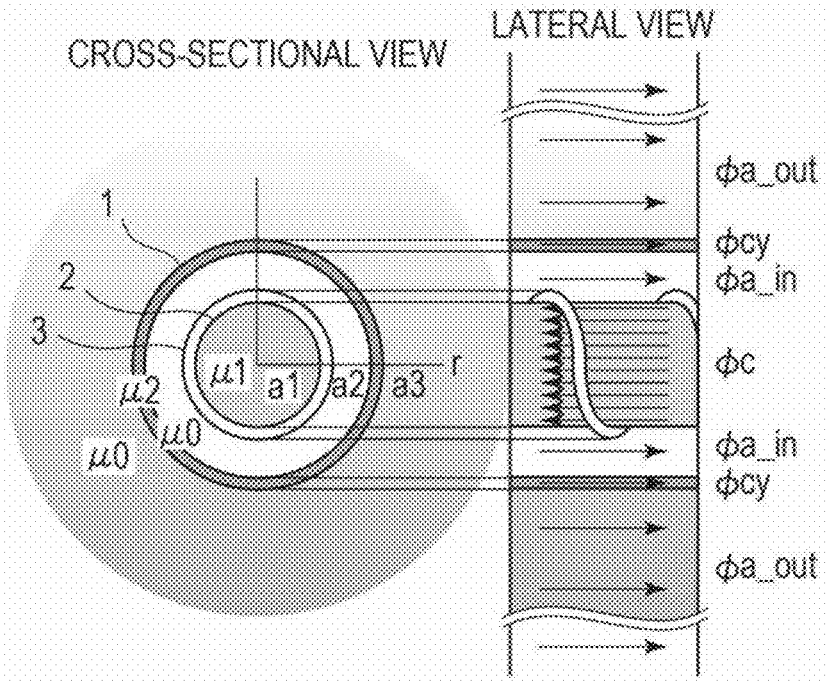
FIG. 37B illustrates a region through which the magnetic flux passes.

FIG. 37A illustrates a product obtained by winding the exciting coil 3 N times around the magnetic core 2 having a radius a1 [m], the length B [m], and a relative permeability μ1 on the in side of the conductive layer 1*a* such that the helical axis is approximately parallel to the generatrix direction of the conductive layer 1*a*. Herein, the conductive layer 1*a* is a conductor having the length B [m], an inner diameter a2 [m], an outer diameter a3 [m], and a relative permeability μ2. A vacuum permeability on the inner side and the outer side of the conductive layer is set as $\mu_0$ [H/m]. A magnetic flux generated per unit length of the magnetic core 2 when a current I [A] flows through the exciting coil 3 is set as ϕc(x). FIG. 37B is a cross-sectional view perpendicular to the longitudinal direction of the magnetic core 2. Arrows in FIG. 37B represent magnetic fluxes that pass through the inside of the magnetic core 2, the inner side of the conductive layer 1*a*, and the outer side of the conductive layer 1*a* and are parallel to the longitudinal direction of the magnetic core 2 when the current I flows through the exciting coil 3. The magnetic flux that passes through the inside of the magnetic core 2 is set as ϕc (=ϕc(x)), the magnetic flux that passes through the inner side of the conductive layer 1*a* (region between the conductive layer 1*a* and the magnetic core 2) is set as $\phi a_{13}$ in, the magnetic flux that passes through the conductive layer itself is set as ϕs, and the magnetic flux that passes through the outer side of the conductive layer is set as ϕa_out.

Figure 38A:
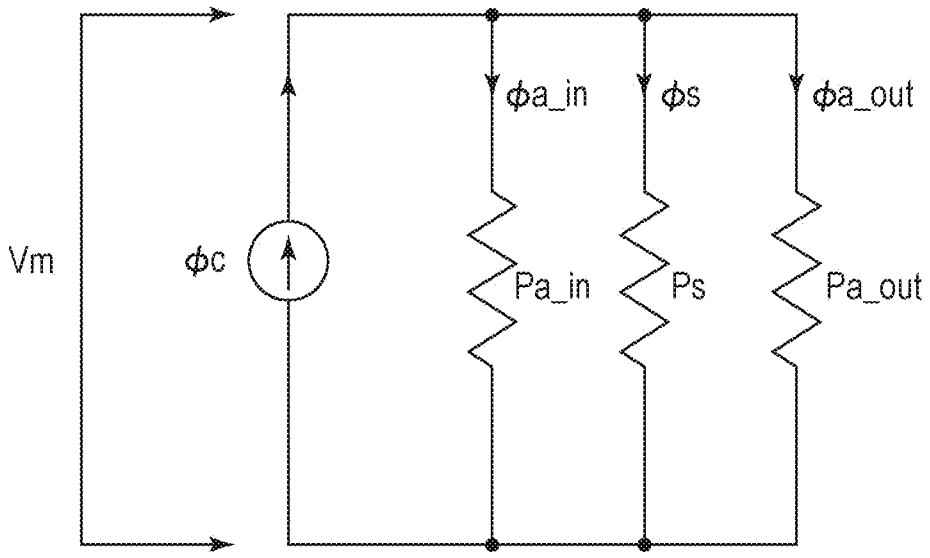
FIG. 38A illustrates a magnetic equivalent circuit of a space including the magnetic core, the exciting coil, and the conductive layer.
Figure 38B:
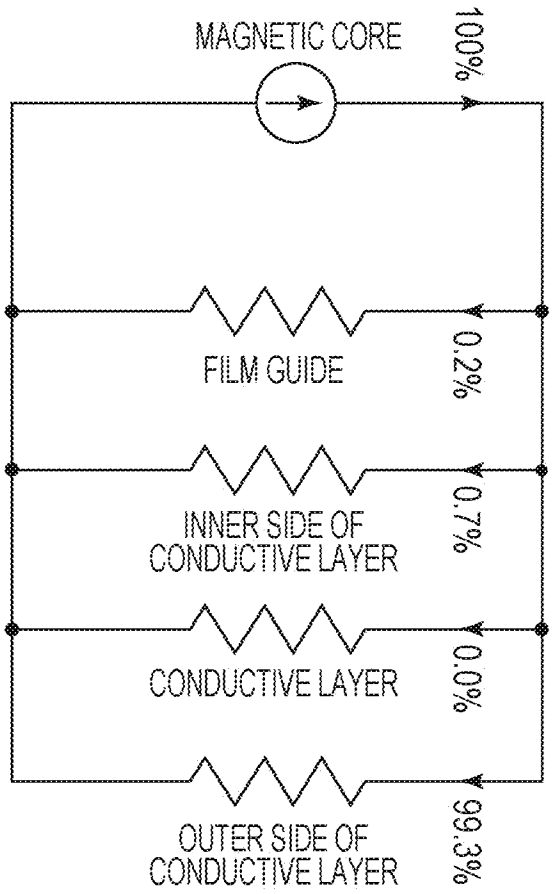
FIG. 38B illustrates a region through which the magnetic flux passes.

FIG. 38A illustrates a magnetic equivalent circuit in a space including the magnetic core 2 the exciting coil 3, and the conductive layer 1*a* per unit length illustrated in FIG. 36A. A magnetomotive force generated by the magnetic flux ϕc that passes through the magnetic core 2 is set as Vm, a permeance or the magnetic core 2 is set as Pc, a permeance of the inner side of the conductive layer is set as Pa_in, a permeance of the inside of the conductive layer 1*a* itself of the film is set as Ps, and a permeance of the outer side of the conductive layer is set as Pa_out.

Herein, when Pc is sufficiently higher than Pa_in and Ps, it is conceivable that the magnetic flux that has passed through the inside of the magnetic core 2 and exited from one end of the magnetic core 2 passes through one of ϕa_in, ϕs, and ϕa_out to return to the other end of the magnetic core 2. Thus, the following relational expression (504) is established.

$$\phi c = \phi a_in + \phi s + \phi a_out \tag{504}$$

In addition, ϕc, ϕa_in, ϕs, and ϕa_out are respectively represented by the following expression (505) to (508).

$$\phi c = Pc \times Vm \tag{505}$$

$$\phi s = Ps \times Vm \tag{506}$$

$$\phi a_in = Pa_in \times Vm \tag{507}$$

$$\phi a_out = Pa_out \cdot Vm \tag{508}$$

Therefore, when (505) to (508) are assigned to the expression (504), Pa_out can be represented as the following expression (509).

$$\begin{aligned} Pc \times Vm &= \text{Pa_in} \times Vm + Ps \times Vm + \text{Pa_out} \times Vm \\ &= (\text{Pa_in} + Ps + \text{Pa_out}) \times Vm \\ \therefore \text{Pa_out} &= Pc - \text{Pa_in} - Ps \end{aligned} \tag{509}$$

From FIG. 37B, when a cross-sectional area of the magnetic core 2 is set as Sc, a cross-sectional area of the inner side of the conductive layer 1*a* is set as Sa_in, and a cross-sectional area of the conductive layer 1*a* itself is set as Ss, the permeance can be represented as "the permeability× the cross-sectional area", and the unit is [H·m].

$$Pc=\mu 1\cdot Sc=\mu 1\cdot\pi(a1)^2 \tag{510}$$

$$Pa_in=\mu 0\cdot Sa_in=\mu 0\cdot\pi\cdot((a2)^2-(a1)^2) \tag{511}$$

$$Ps=\mu 2\cdot Ss=\mu 2\cdot\pi\cdot((a3)^2-(a2)^2) \tag{512}$$

When the expressions (510) to (512) are assigned to the expression (509), Pa_out can be represented as the expression (513).

$$\begin{aligned}\text{Pa_out} &= Pc-\text{Pa_in}-Ps \\ &= \mu 1\cdot Sc-\mu 0\cdot\text{Sa_in}-\mu 2\cdot Ss \\ &= \pi\cdot\mu 1\cdot(a1)^2-\pi\cdot\mu 0\cdot\left((a2)^2-(a1)^2\right)- \\ &\quad \pi\cdot\mu 2\cdot\left((a3)^2-(a2)^2\right)\end{aligned} \tag{513}$$

Pa_out/Pc corresponding to a percentage of the magnetic lines that passes through the outer side of the conductive layer 1*a* can be calculated by using the expression (513) described above.

It is noted that the magnetic resistance R may be used instead of the permeance P. In a case where the argument is carried out by using the magnetic resistance R, since the magnetic resistance R is simply an inverted number of the permeance P, the magnetic resistance R per unit length can be represented as "1/(the permeability×the cross-sectional area)", and the unit is "1/(H·−m)".

Hereinafter, results specifically calculated by using parameters of the apparatus according to the embodiment will be illustrated in Table 6.

TABLE 6

| | UNIT | MAGNETIC CORE | FILM GUIDE | INNER SIDE OF CONDUCTIVE LAYER | CONDUCTIVE LAYER | OUTER SIDE OF CONDUCTIVE LAYER |
|---|---|---|---|---|---|---|
| CROSS-SECTIONAL AREA | m^2 | 1.5E−04 | 1.0E−04 | 2.0E−04 | 1.5E−06 | |
| RELATIVE PERMEABILITY | | 1800 | 1 | 1 | 1 | |
| PERMEABILITY | H/m | 2.3E−03 | 1.3E−06 | 1.3E−06 | 1.3E−06 | |
| PERMEANCE PER UNIT LENGTH | H · m | 3.5E−07 | 1.3E−10 | 2.5E−10 | 1.9E−12 | 3.5E−07 |
| MAGNETIC RESISTANCE PER UNIT LENGTH | 1/(H · m) | 2 .9E+06 | 8.0E+09 | 4.6E+09 | 5.3E+11 | 2.9E+06 |
| PERCENTAGE OF MAGNETIC FLUX | % | 100.0% | 0.0% | 0.1% | 0.0% | 99.9% |

The magnetic core 2 is formed of the ferrite (the relative permeability is 1800), the diameter is 14 [mm], and the cross-sectional area of $1.5\times10^{-4}$ [$m^2$]. The film guide is formed of PPS (polyphenylene sulfide) (the relative permeability is 1.0), and the cross-sectional area is $1.0\times10^{-4}$ [$m^2$]. The conductive layer 1*a* is formed of aluminum (the relative permeability is 1.0), the diameter is 24 [mm], the thickness is 20 [μm], and the cross-sectional area is $1.5\times10^{-6}$ [$m^2$].

It is noted that the cross-sectional area in the region between the conductive layer 1*a* and the magnetic core 2 is calculated by subtracting the cross-sectional area of the magnetic core 2 and the cross-sectional area of the film guide from the cross-sectional area of the hollow portion on the inner side of the conductive layer having the diameter of 24 [mm]. The elastic layer 1*b* and the releasing layer 1*c* are arranged on the outer side of the conductive layer 1*a* and do not contribute to the heat generation. Therefore, the elastic layer 1*b* and the releasing layer is can be regarded as air layers on the outer side of the conductive layer in the magnetic circuit model for calculating the permeance and accordingly do not need to be taken into the calculation.

From Table 6, Pc, Pa_in, and Ps have the following values.

$$Pc=3.5\times10^{-7}\ [\text{H·m}]$$

$$Pa_in=1.3\times10^{-10}+2.5\times10^{-10}\ [\text{H·m}]$$

$$Ps=1.9\times10^{-12}\ [\text{H·m}]$$

By using these values, it is possible to calculate Pa_out/Pc from the following expression (514).

$$Pa_out/Pc=(Pc-Pa_in-Ps)/Pc=0.999\ (99.9\%) \tag{514}$$

It is noted that the magnetic core 2 may be divided in the longitudinal direction into plural pieces, and gaps may be provided between the respective divided magnetic cores in some cases. In this case, when this gap is filled with air, substances having a relative permeability regarded as 1.0, or substances having a relative permeability significantly lower than the relative permeability of the magnetic core, the magnetic resistance R of the entire magnetic core 2 is increased, and the function of inducing the magnetic lines is degraded.

A calculation method for the permeance of the thus divided magnetic cores 2 becomes complex. Hereinafter, descriptions will be given of a calculation method for the permeance of the entire magnetic core in a case where the magnetic core is divided into plural pieces, and the divided magnetic cores are arranged at even intervals while sandwiching a gap or sheet-like nonmagnetic material. In this case, the magnetic resistance of the entire longitudinal region needs to be derived and divided by the entire length to calculate the magnetic resistance per unit length, and an inverse number of the magnetic resistance per unit length needs to be obtained to calculate the permeance per unit length.

Figure 39:
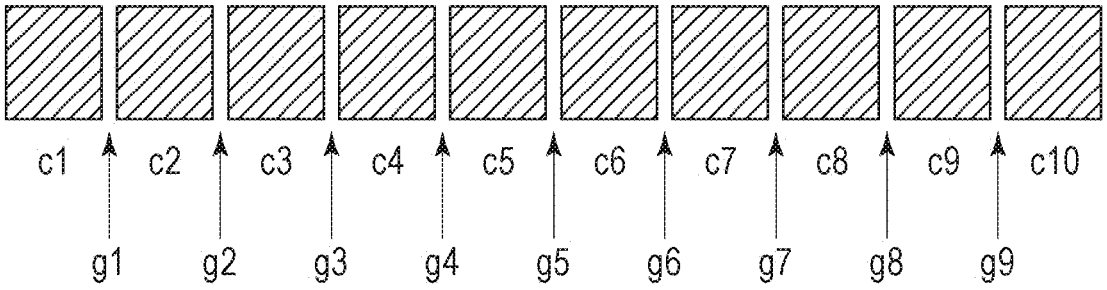
FIG. 39 illustrates the divided cores.

First, FIG. 39 illustrates a configuration diagram in the longitudinal direction of the magnetic core. Magnetic cores c1 to c10 are set to have the cross-sectional area Sc, the permeability μc, a width Lc per each divided magnetic core, and gaps g1 to g9 are set to have the cross-sectional area Sg, a permeability μg, and a width Lg per each gap. An entire magnetic resistance Rm_all in the longitudinal direction of the magnetic core can be found by the following expression (515).

$$Rm_all=(Rm_c1+Rm_c2+\ldots+Rm_c10)+(Rm_g1+Rm_g2+\ldots+Rm_g9) \quad (515)$$

Since the shape, the material, and the gap width of the magnetic cores are uniform in the case of the present configuration, when a total of summing up Rm_c is set as ΣRm_c, and a total of summing up Rm_g is set as ΣRm_g, those can be represented by the following expression (516) to (518).

$$Rm_all=(\Sigma Rm_c)+(\Sigma Rm_g) \quad (516)$$

$$Rm_c=Lc/(\mu c\cdot Sc) \quad (517)$$

$$Rm_g=Lg/(\mu g\cdot Sg) \quad (518)$$

The expression (517) and the expression (518) are assigned to the expression (516), and the longitudinal entire magnetic resistance Rm_all can be represented as the following expression (519).

$$\begin{aligned} \text{Rm_all} &= (\Sigma\text{Rm_c}) + (\Sigma\text{Rm_g}) \quad (519) \\ &= (Lc/(\mu c\cdot Sc))\times 10 + (Lg/(\mu g\cdot Sg))\times 9 \end{aligned}$$

Here, the magnetic resistance per unit length Rm is represented by the following expression (520) when a total of summing up Lc is set as ΣLc, and a total of summing up Lg is set as ΣLg.

$$\begin{aligned} Rm &= \text{Rm_all}/(\Sigma\text{Lc}+\Sigma\text{Lg}) \quad (520) \\ &= \text{Rm_all}/(L\times 10 + Lg\times 9) \end{aligned}$$

From the above, the permeance Rm per unit length can be represented as the following expression (521).

$$\begin{aligned} Pm &= 1/Rm \quad (521) \\ &= (\Sigma\text{Lc}+\Sigma\text{Lg})/\text{Rm_all} \\ &= (\Sigma\text{Lc}+\Sigma\text{Lg})/[\{\Sigma\text{Lc}/(\mu c+Sc)\}+\{\Sigma\text{Lg}/(\mu g+Sg)\}] \end{aligned}$$

The increase in the gap Lg leads to the increase in the magnetic resistance of the magnetic core 2 (decrease in the permeance). For the heat generation principle, since the magnetic resistance of the magnetic core 2 is preferably designed to be low (the permeance is, to be high) in terms of the construction of the image heating apparatus according to the present embodiment, the gap is not preferably provided. However, to avoid a breakage of be magnetic core 2, the magnetic core 2 may be divided into plural pieces to provide the gap in some cases.

From the above-described aspects, it is illustrated that the percentage of the magnetic lines that pass through the outside route can be represented by using the permeance or the magnetic resistance.

(3) Power Conversion Efficiency Necessary for Image Heating Apparatus

Next, the power conversion efficiency necessary for the image heating apparatus according to the present embodiment will be described. For example, in a case where the power conversion efficiency is 80%, the remaining 20% of the power is converted into thermal energy by the coil, the core, and the like other than the conductive layer to be consumed. In a case where the power conversion efficiency is low, the magnetic core, the coil, and the like, which should not generate heat, generate heat, and it may be necessary to take measures to cool down those in some cases.

Incidentally, according to the present embodiment, when the heat generation is caused in the conductive layer, a high-frequency alternating current flows through the exciting coil, and an alternating magnetic field is formed. The alternating magnetic field induces the current to the conductive layer. As the physical model, this is very similar to the magnetic coupling of the transformer. For that reason, when the power conversion efficiency is considered, an equivalent circuit of the magnetic coupling of the transformer can be used. The magnetic coupling of the exciting coil and the conductive layer is realized by the alternating magnetic field, and the power input to the exciting coil is conductively transferred. The "power conversion efficiency" mentioned herein is a ratio between the power input to the exciting coil functioning as a magnetic field generation unit and the power consumed by the conductive layer. In the case of the present embodiment, the power conversion efficiency is a ratio between the power input to the high-frequency converter 16 with respect to the exciting coil 3 illustrated in FIG. 1 and the power consumed by the conductive layer 1*a*. The power conversion efficiency can be represented by the following expression (522).

$$\text{Power conversion efficiency}=\text{Power consumed in the conductive layer/Power supplied to the exciting coil} \quad (522)$$

The power supplied to the exciting coil and consumed by the elements other than the conductive layer includes a loss by the resistance of the exciting coil, a loss by the magnetic characteristic of the magnetic core material, and the like.

Figure 40A:
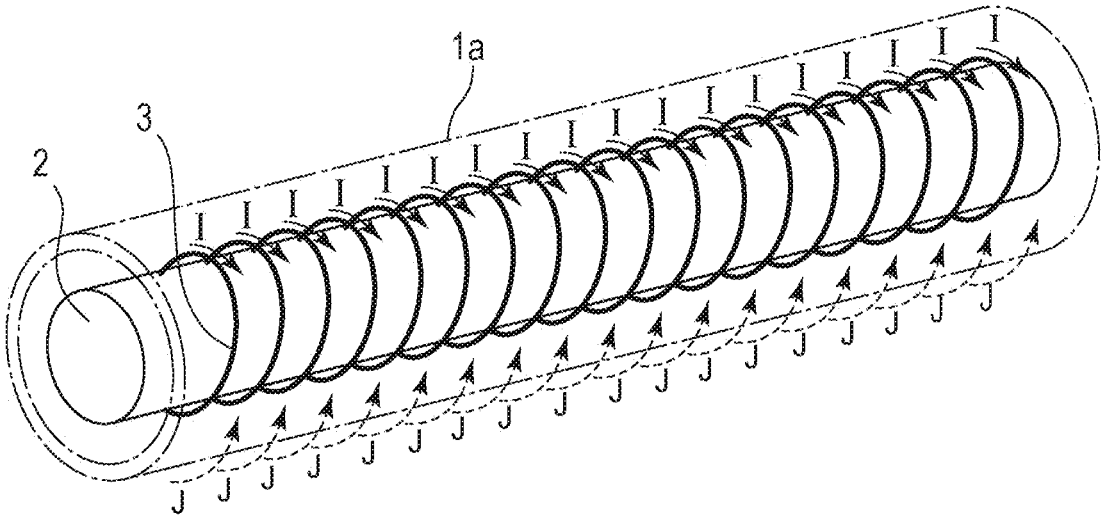
FIG. 40A illustrates the magnetic core, the exciting coil, and the conductive layer.
Figure 40B:
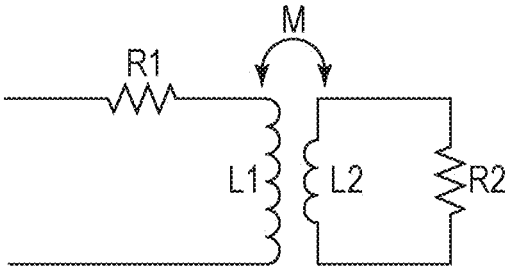
FIG. 40B illustrates an equivalent circuit.

FIGS. 40A and 40B are explanatory diagrams for describing an efficiency of the circuit. FIG. 40A illustrates the conductive layer 1*a*, the magnetic core 2, and the exciting coil 3. FIG. 40B illustrates an equivalent circuit.

Figure 41A:
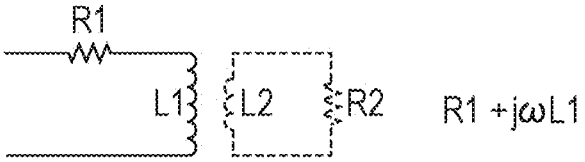
FIG. 41A illustrates an equivalent circuit (without sleeve mounting).

R1 denotes a loss amount of the exciting coil 3 and the magnetic core 2, L1 denotes the inductance of the exciting coil 3 wound around the magnetic core 2, M denotes the mutual inductance between the wiring and the conductive layer 1*a*, L2 denotes the inductance of the conductive layer 1*a*, and R2 denotes a resistance of the conductive layer 1*a*. FIG. 41A illustrates an equivalent circuit when the conductive layer is not mounted. A series equivalent resistance R1 from both the end portions of the exciting coil and an equivalent inductance $L_1$ are measured by an apparatus such as an impedance analyzer or an LCR meter, and an impedance $Z_A$ as seen from both the end portions of the exciting coil can be represented by the expression (523).

$$Z_A=R_1+j\omega L_1 \quad (523)$$

A loss of the current flowing through this circuit occurs by $R_1$. That is, R1 denotes the loss by the exciting coil 3 and the magnetic core 2.

Figure 41B:
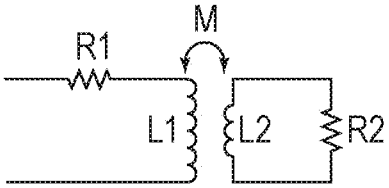
FIG. 41B illustrates an equivalent circuit (with sleeve mounting).

FIG. 41B illustrates an equivalent circuit when the conductive layer is mounted. If the series equivalent resistances Rx and Lx at the time of the mounting of this conductive layer are previously measured, relational expressions (524), (525), and (526) can be obtained by performing an equivalent transformation as in FIG. 41C.

[Math 8]

$$Z = R1 + j\omega(L1 - M) + \frac{j\omega M(j\omega(L2 - M) + R2)}{j\omega M + j\omega(L2 - M) + R2} \quad (524)$$

$$= R1 + \frac{\omega^2 M^2 R_2}{R_2^2 + \omega^2 L_2^2} + j(\omega(L_1 - M) + \frac{M \cdot R_2^2 + \omega^2 ML_2(L_2 - M)}{R_2^2 + \omega^2 L_2^2}$$

[Math 9]

$$Rx = R_1 + \frac{\omega^2 M^2 R_2}{R_2^2 + \omega^2 L_2^2} \quad (525)$$

[Math 10]

$$Lx = \omega(L_1 - M) + \frac{M \cdot R_2^2 + \omega^2 ML_2(L_2 - M)}{R_2^2 + \omega^2 L_2^2}) \quad (526)$$

M can be represented as a mutual inductance of the exciting coil and the conductive layer.

Figure 41C:
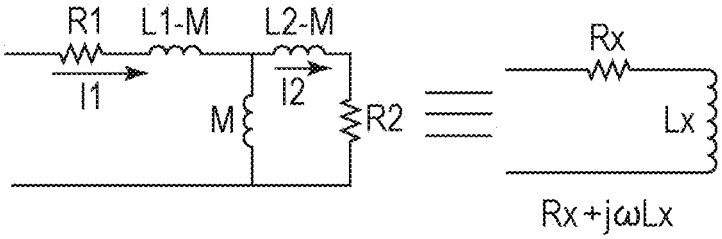
FIG. 41C illustrates an equivalent circuit after an equivalent transformation of FIG. 41B.

As illustrated in FIG. 41C, when a current flowing through R1 is set as I1, and a current flowing through. R2 is set as I2, the following expression (527) is established.

[Math. 11]

$$j\omega M(I_1 - I_2) = (R_2 + j\omega(L_2 - M))I_2 \quad (527)$$

The following expression (528) can be derived from the expression (527).

[Math 12]

$$I_1 = \frac{R_2 + j\omega L_2}{j\omega M} I_2 \quad (528)$$

The, efficiency (power conversion efficiency) can be represented as the power consumption by the resistance R2/(the power consumption by the resistance R1+the power consumption by the resistance R2) as in the expression (529).

[Math 13]

$$\text{Power conversion efficiency} = \frac{R_2 \times |I_2^2|}{R_1 \times |I_1^2| + R_2 \times |I_2^2|} = \frac{\omega^2 M^2 R_2}{\omega^2 L_2^2 R_1 + R_1 R_2^2 + \omega^2 M^2 R_2} = \frac{Rx - R_1}{Rx} \quad (529)$$

When the series equivalent resistance $R_1$ before mounting of the conductive layer and the series equivalent resistance Rx after mounting are measured, it is possible to calculate the power conversion efficiency indicating how much power among the power supplied to the exciting coil is consumed by the conductive layer. It is noted that according to the present embodiment, the impedance analyzer 4294A manufactured by Agilent Technologies is used for the measurement of the power conversion efficiency. First, the series equivalent resistance $R_1$ from both the ends of the coil in a state in which the fixing film does not exist is measured, and next, the series equivalent resistance Rx from both the ends of the coil in a state in which the magnetic core is inserted into the fixing film is measured. $R_1$=103 mΩ and Rx=2.2Ω are obtained, and at this time, the power conversion efficiency can be calculated as 95.3% from the expression (529). After this, performance of the image heating apparatus is evaluated by using this power conversion efficiency.

Figure 42:
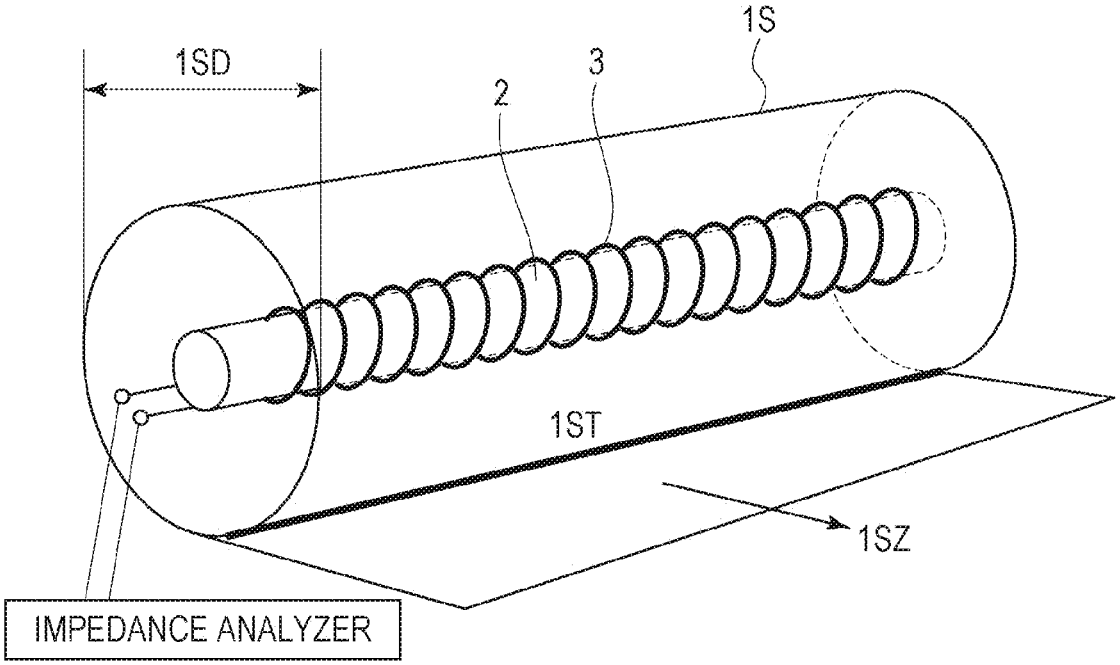
FIG. 42 illustrates an experimental apparatus configured to measure a power conversion efficiency.

Here, the power conversion efficiency necessary for the apparatus is calculated. The power conversion efficiency is evaluated by allocating the percentage of the magnetic flux that passes through the outside route of the conductive layer 1*a*. FIG. 42 illustrates an experimental apparatus used for the measurement experiment of the power conversion efficiency. A metallic sheet 1S is a sheet made of aluminum having a width of 230 mm, a length of 600 mm, and a thickness of 20 μm. The conductive layer is obtained by rolling the metallic sheet 1S into a cylindrical shape so as to surround the magnetic core 2 and the exciting coil 3 and realizing continuity in a part indicated by a bold line 1ST. The magnetic core 2 is a ferrite having a relative permeability of 1800 and a saturation magnetic flux density of 500 mT and has a cylindrical column shape having a cross-sectional area of 26 $mm^2$ and a length of 230 mm. The magnetic core 2 is arranged approximately at the center of the cylinder of the metallic sheet 1S by the mounting unit. (not illustrated). The exciting coil 3 is helically wound. 25 times around the magnetic core 2. When the end portion of the metallic sheet 15 is pulled in an arrow 1SZ direction, a diameter 1SD of the conductive layer can be adjusted in a range of 18 to 191 mm.

Figure 43:
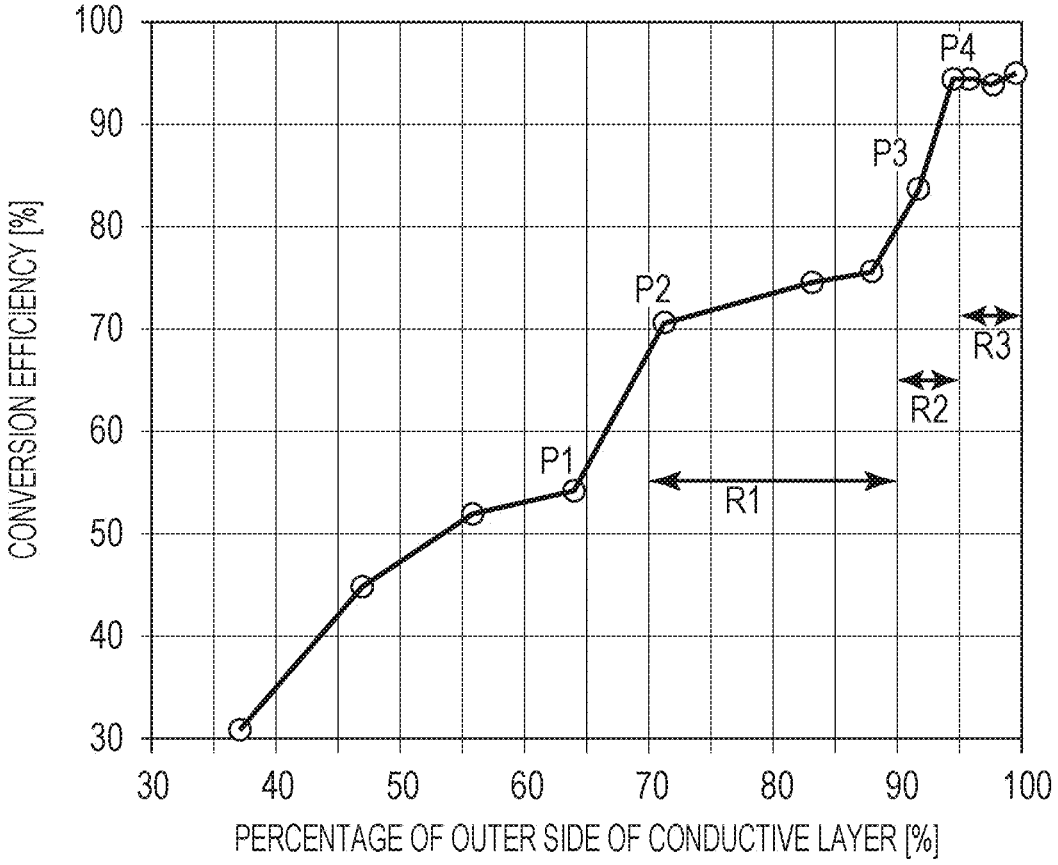
FIG. 43 illustrates a relationship between a percentage of the magnetic flux that passes an outer side of the conductive layer and the power conversion efficiency.

FIG. 43 is a graphic representation in which the percentage [%] of the magnetic flux that passes through the outside route of the conductive layer is set as the horizontal axis, and the power conversion efficiency at the frequency of 21 kHz is set as the vertical axis.

The power conversion efficiency sharply increases and exceeds 70% on a plot P1 and subsequent sections in the graphic representation of FIG. 43, and the power conversion efficiency is maintained at 70% or higher in a range R1 indicated by arrows. The power conversion efficiency sharply increases again in the vicinity of P3 and reaches 80% or higher in a range R2. The power conversion efficiency in a range R3 on P4 and subsequent sections is stabilized at a high value of 94% or higher. This phenomenon where the power conversion efficiency starts to sharply increase occurs because the circumferential current starts to effectively flow through the conductive layer.

Table 7 below illustrates evaluation results when the configurations relevant to P1 to P4 in FIG. 43 are actually designed as the image heating apparatus.

TABLE 7

| NUMBER | AREA | DIAMETER OF CONDUCTIVE LAYER [mm] | PERCENTAGE OF MAGNETIC FLUX PASSING THROUGH OUTER SIDE OF CONDUCTIVE LAYER | CONVERSION EFFICIENCY [%] | EVALUATION RESULT (IN CASE OF HIGHLY SPECIFIED FIXING APPARATUS) |
|---|---|---|---|---|---|
| P1 | — | 143.2 | 64.0 | 54.4 | POWER SHORTAGE MAY OCCUR |
| P2 | R1 | 127.3 | 71.2 | 70.8 | COOLING UNIT IS PREFERABLY PROVIDED |
| P3 | R2 | 63.7 | 91.7 | 83.9 | HEAT RESISTANCE DESIGN IS PREFERABLY OPTIMIZED |
| P4 | R3 | 47.7 | 94.7 | 94.7 | OPTIMAL CONFIGURATION FOR FLEXIBLE FILM |

Image Heating Apparatus P1

According to the present configuration, the cross-sectional area of the magnetic core is 26.5 $mm^2$ (5.75 mm×4.5 mm), the diameter of the conductive layer is 143.2 mm, and the percentage of the magnetic flux that passes through the outside route is 64%. The power conversion efficiency calculated by the impedance analyzer of this apparatus is 54.4%. The power conversion efficiency is a parameter indicating how much of the power input to the image heating apparatus is attributed to the heat generation of the conductive layer. Therefore, even when the apparatus is designed as the image heating apparatus that can output up to 1000 W, approximately 450 W is lost, and the loss is the heat generation of the coil and the magnetic core.

In the case of the present configuration, at the time of the start-up, even when 1000 W is input for only a few seconds, the coil temperature may exceed 200° C. in some cases. Given that an allowable temperature limit of the insulator of the coil is in a range of approximately 250° C. and 299° C., and a Curie point of the magnetic core of the ferrite is normally approximately 200° C. to 250° C., it is difficult to keep the temperature of the member such as the exciting coil to be lower than or equal to the allowable temperature limit at the loss of 45%. In addition, if the temperature of the magnetic core exceeds the Curie point, the inductance of the coil is sharply decreased, and a load fluctuation occurs.

Since approximately 45% of the power supplied to the image heating apparatus is not used for the heat generation of the conductive layer, to supply the power at 900 W (supposing 90% of 1000 W) to the conductive layer, the power supply at approximately 1636 W is needed. This means that the power supply consumes 16.36 A at the time of the input of 100 V. The power supply may exceed an allowable current that can be input from a commercial alternating current attachment plug. Thus, the image heating apparatus P1 having the power conversion efficiency of 54.4% may run short of the power supplied to the image heating apparatus.

Image Heating Apparatus P2

According to the present configuration, the cross-sectional area of the magnetic core is the same as P1, the diameter of the conductive layer is 127.3 mm, and the percentage of the magnetic flux that passes through the outside route is 71.2%. The power conversion efficiency calculated by the impedance analyzer of this apparatus is 70.8%. A temperature increase of the coil and the core may become a problem in some cases depending on a specification of the image heating apparatus. When the image heating apparatus having the present configuration is set as a highly specified apparatus that can perform the printing operation at 60 sheets/minute, the rotation speed of the conductive layer becomes 330 mm/sec, and the temperature of the conductive layer needs to be maintained at 180° C. When the temperature of the conductive layer is to be maintained at 180° C., the temperature of the magnetic core may exceed 240° C. in 20 seconds in some cases. Since a Curie temperature of the ferrite used as the magnetic core is normally approximately 200° C. to 250° C., the ferrite exceeds the Curie temperature, and the permeability of the magnetic core is sharply decreased, so that the magnetic lines may not be appropriately induced in the magnetic core. As a result, it may become difficult to induce the circumferential current and cause the conductive layer to generate heat.

Therefore, the image heating apparatus in which the percentage of the magnetic flux that passes through the outside route is in the range R1 is set as the above-described highly specified apparatus, a cooling unit is preferably provided to decrease the temperature of the ferrite core. An air-cooling fan, water cooling, a cooling wheel, a radiating fin, a heat pipe, a Peltier element, or the like can be used as the cooling unit. Of course, in a case where such a highly specified apparatus is not demanded in the present configuration, the cooling unit is not necessarily used.

Image Heating Apparatus P3

The present configuration corresponds to a case where the cross-sectional area of the magnetic core is the same as P1, and the diameter of the conductive layer is 63.7 mm. The power conversion efficiency calculated by the impedance analyzer of this apparatus is 83.9%. Although a heat quantity is constantly generated in the magnetic core, the coil, and the like, this is not a level at which the cooling unit is needed. When the image heating apparatus having the present configuration is set as the highly specified apparatus that can perform the printing operation at 60 sheets/minute, the rotation speed of the conductive layer becomes 330 mm/sec, and the surface temperature of the conductive layer may be maintained at 180° C. in some cases, but the temperature of the magnetic core (ferrite) is not increased to 220° C. or higher. Therefore, according to the present configuration, in a case where the image heating apparatus is set as the above-described highly specified apparatus, the ferrite having the Curie temperature of 220° C. or higher is preferably used.

From the above-described aspects, in a case where the image heating apparatus having the configuration where the percentage of the magnetic flux that passes through the outside route is in the range R2 is used as the highly specified apparatus, the heat resistance design such as the ferrite is preferably optimized. On the other hand, in a case where the image heating apparatus is not used as the highly specified apparatus, the above-described heat resistance design is not necessarily used.

Image Heating Apparatus P4

The present configuration corresponds to a case where the cross-sectional area of the magnetic core is the same as P1, and the diameter of the cylindrical body is 47.7 mm. In this apparatus, the power conversion efficiency calculated by the impedance analyzer is 94.7%. Even in a case where the image heating apparatus having the present configuration is set as the highly specified apparatus that can perform the printing operation at 60 sheets/minute (the rotation speed of the conductive layer is 330 mm/sec), and the surface temperature of the conductive layer is maintained at 180° C., the exciting coil, the coil, or the like does not reach 180° C. or higher. Therefore, a cooling unit configured to cool the magnetic core, the coil, or the like or a special heat resistance design is not necessarily used.

From the above-described aspects, in the range R3 where the percentage of the magnetic flux that passes through the outside route is higher than or equal to 94.7%, the power conversion efficiency becomes higher than or equal to 94.7%, and the power conversion efficiency is sufficiently high. Thus, even when the apparatus is used as the further highly specified image heating apparatus, the cooling unit is not necessarily used.

In addition, even when the amount of magnetic flux that per unit time that passes the inner side of the conductive layer is slightly fluctuated by a fluctuation of the positional relationship between the conductive layer and the magnetic core in the range R3 where the power conversion efficiency is stabilized at a high value, the variation of the power conversion efficiency is small, and the heating value of the conductive layer is stabilized. Significant advantages are attained when the range R3 where this power conversion efficiency is stabilized at a high value is used in the image heating apparatus in which a distance between the conductive layer and the magnetic core tends to be fluctuated like a film having a flexibility.

From the above-described aspects, the percentage of the magnetic flux that passes through the outside route needs to be higher than 72% in the image heating apparatus according to the present embodiment to satisfy at least the necessary power conversion efficiency.

Relational Expression of Permeance or Magnetic Resistance to be Satisfied by Apparatus A situation where the percentage of the magnetic flux that passes through the outside route of the conductive layer is 72% or higher is equivalent to a situation where a sum of the permeance of the conductive layer and the permeance of the inner side of the conductive layer (region between the conductive layer and the magnetic core) is 28% or less of the permeance of the magnetic core. Therefore, one of the characteristic configurations according to the present embodiment satisfies the following expression (529) when the permeance of the magnetic core is set as Pc, the permeance of the inner side of the conductive layer is set as Pa, and the permeance of the conductive layer is set as Ps.

$$0.28\times Pc \geq Ps+Pa \tag{529}$$

When the relational expression of the permeance is replaced by the magnetic resistance and represented, the following expression (530) is established.

[Math. 14]

$$\begin{aligned} &0.28\times P_c \geq P_s + P_a \\ &0.28\times \frac{1}{Rc} \geq \frac{1}{R_s} + \frac{1}{R_a} \\ &0.28\times \frac{1}{Rc} \geq \frac{1}{R_{sa}} \\ &0.28\times R_{sa} \geq Rc \end{aligned} \tag{530}$$

It is however noted that, the combined magnetic resistance Rsa of Rs and Ra is calculated by the following expression (531).

[Math. 15]

$$\begin{aligned} &\frac{1}{R_{sa}} = \frac{1}{R_s} + \frac{1}{R_a} \\ &R_{sa} = \frac{R_a \times R_s}{R_a + R_s} \end{aligned} \tag{531}$$

Rc: Magnetic resistance of the magnetic core
Rs: Magnetic resistance of the conductive layer
Ra: Magnetic resistance in the region between the conductive layer and the magnetic core
Rsa: Combined magnetic resistance of Rs and Ra The above-described relational expression of the permeance or the magnetic resistance is preferably satisfied in a cross section in a direction perpendicular to the generatrix direction of the cylindrical rotary member across the entire largest region through which the recording material of the image heating apparatus passes.

Next, the percentage of the magnetic flux that passes through the outside route of the conductive layer in the image heating apparatus according to the present embodiment in the range R2 is 92% or higher. A situation where the percentage of the magnetic flux that passes through the outside route of the conductive layer is 92% or higher is equivalent to a situation where a sum of the permeance of the conductive layer and the permeance of the inner side of the conductive layer (region between the conductive layer and the magnetic core) is 8% or less of the permeance of the magnetic core. Thus, the relational expression of the permeance is the following expression (532).

$$0.08\times Pc \geq Ps+Pa \tag{532}$$

When the above-described relational expression of the permeance is transformed into a relational expression of the magnetic resistance, the following expression (533) is obtained.

[Math. 16]

$$\begin{aligned} &0.08\times P_C \geq P_s+P_a \\ &0.08\times R_{sa} \geq Rc \end{aligned} \tag{533}$$

Furthermore, the percentage of the magnetic flux that passes through the outside route of the conductive layer is 95% or higher in the image heating apparatus according to the present embodiment in the range R3. A situation where the percentage of the magnetic flux that passes through the outside route of the conductive layer is 95% or higher is equivalent to a situation where a sum of the permeance of the conductive layer and the permeance of the inner side of the conductive layer (region between the conductive layer and the magnetic core) is 5% or less of the permeance of the magnetic core. The relational expression of the permeance is represented as (534) below.

$$0.05\times Pc\geq Ps+Pa \quad (534)$$

When the above-described relational expression of the permeance (534) is transformed into a relational expression of the magnetic resistance, the following expression (535) is obtained.

[Math. 17]

$$0.05\times P_C\geq P_s+P_a$$

$$0.05\times R_{sa}\geq Rc \quad (535)$$

Figure 44:
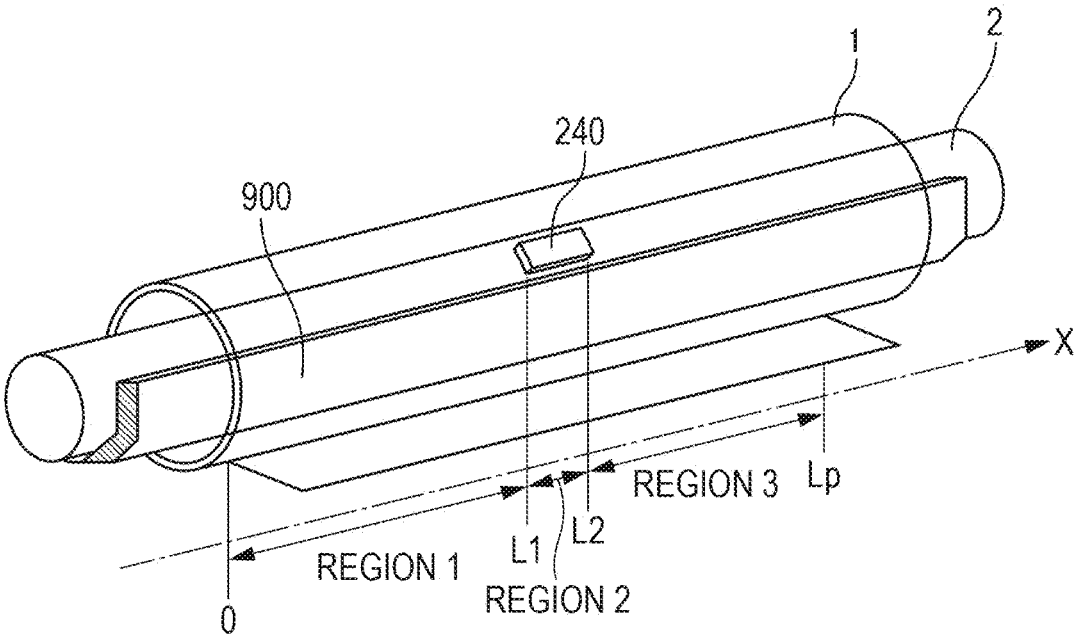
FIG. 44 illustrates a position of a temperature detection member of the image heating apparatus.

Incidentally, the relational expressions of the permeance the magnetic resistance have been illustrated with regard to the image heating apparatus in which the members and the like in the largest image region of the image heating apparatus have the uniform cross-sectional configuration in the longitudinal direction. Here, the image heating apparatus in which the members constituting the image heating apparatus have nonuniform cross-sectional configurations in the longitudinal direction. FIG. 44 illustrates a temperature detection member 240 on the inner side of the conductive layer (region between the magnetic core and the conductive layer). The other configurations is similar to the second embodiment, and the image heating apparatus includes a film (sleeve) 1 having a conductive layer, a magnetic core, and a nip part forming member (film guide) 900.

Figure 45A:
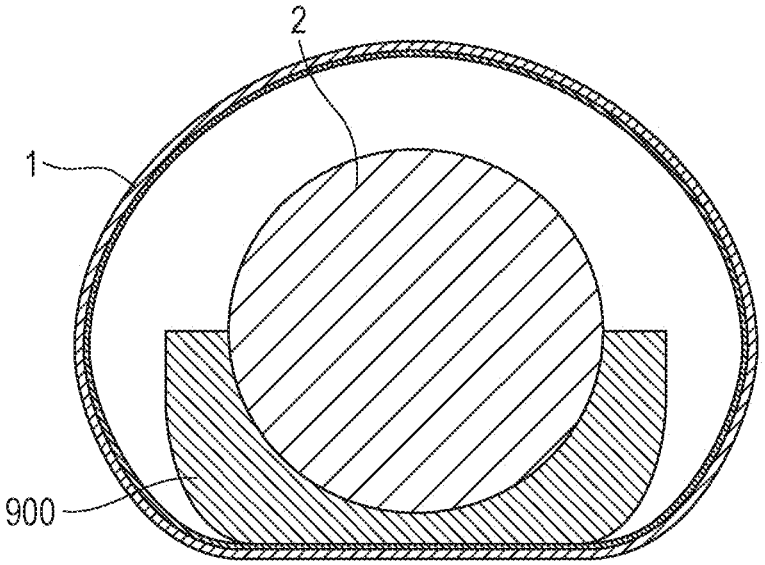
FIG. 45A is a cross-sectional diagram of a region 1 or a region 3 of the image heating apparatus illustrated in FIG. 44.
Figure 45B:
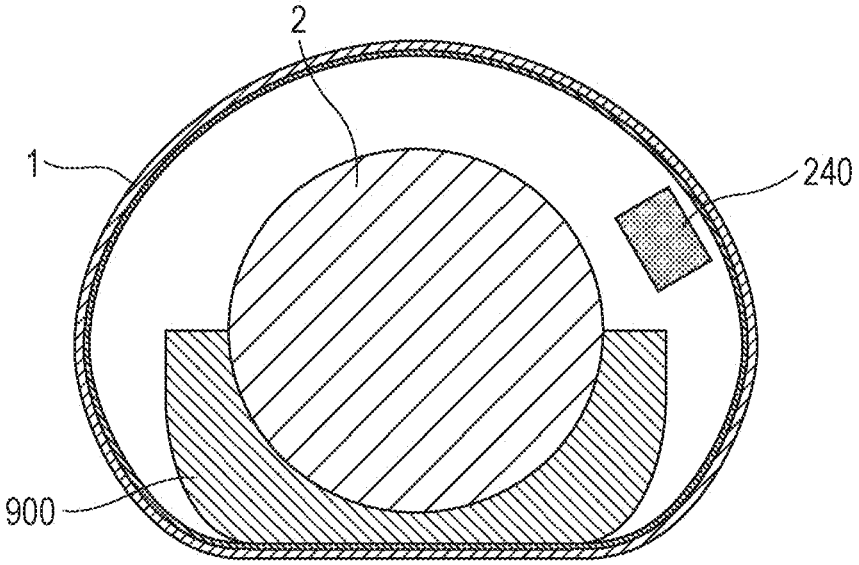
FIG. 45B is a cross-sectional diagram of a region 2 of the image heating apparatus illustrated in FIG. 44.

When the longitudinal direction of the magnetic core 2 is set as an X axis direction, the largest image forming region is in a range of 0 to Lp on the X axis. For example, in the case of the image forming apparatus in which the largest region through which the recording material passes is set as an LTR size of 215.9 mm, it is sufficient that Lp=215.9 mm is set. The temperature detection member 240 is composed of a nonmagnetic substance having a relative permeability of 1, the cross-sectional area in a direction perpendicular to the X axis is 5 mm×5 mm, and a length in a parallel direction to the X axis is 10 mm. The temperature detection member 240 is arranged at a position from L1 (102.95 mm) to L2 (112.95 mm) on the X axis. Herein, a region from 0 to L1 on the X coordinate is referred to as region 1, a region from L1 to L2 where the temperature detection member 240 exists is referred to as region 2, and a region from L2 to LP is referred to as region 3. FIG. 45A illustrates a cross-sectional structure in the region 1, and FIG. 45B illustrates a cross-sectional structure in the region 2. As illustrated in FIG. 45B, since the temperature detection member 240 is enclosed in the film (sleeve) 1, the temperature detection member 240 is subjected to the magnetic resistance calculation. To strictly perform the magnetic resistance calculation, the "magnetic resistance per unit length" is separately calculated for the region 1, the region 2, and the region 3, and an integration calculation is performed in accordance with the lengths of the respective regions, so that those are summed up to calculate the combined magnetic resistance. First, the magnetic resistances per unit length of the respective components in the region 1 or 3 are illustrated in Table 8 below.

TABLE 8

| ITEM | UNIT | MAGNETIC CORE | FILM GUIDE | INNER SIDE OF CONDUCTIVE LAYER | CONDUCTIVE LAYER |
|---|---|---|---|---|---|
| CROSS-SECTIONAL AREA | m^2 | 1.5E−04 | 1.0E−04 | 2.0E−04 | 1.5E−06 |
| RELATIVE PERMEABILITY | | 1800 | 1 | 1 | 1 |
| PERMEABILITY | H/m | 2.3E−03 | 1.3E−06 | 1.3E−06 | 1.3E−06 |
| PERMEANCE PER UNIT LENGTH | H · m | 3.5E−07 | 1.3E−10 | 2.5E−10 | 1.9E−12 |
| MAGNETIC RESISTANCE PER UNIT LENGTH | 1/(H · m) | 2.9E+06 | 8.0E+09 | 4.6E+09 | 5.3E+11 |

The magnetic resistance $r_c$1 per unit length of the magnetic core in the region 1 is represented as follows.

$$r_c1=2.9\times10^6\ [1/(H\cdot m)]$$

Here, the magnetic resistance $r_a$ per unit length in the region between the conductive layer and the magnetic core is the combined magnetic resistance of the magnetic resistance $r_f$ per unit length of the film guide and the magnetic resistance per unit length of the magnetic resistance $r_{air}$ on the inner side of the conductive layer. Therefore, the calculation can be performed by using the following expression (536).

[Math. 18]

$$\frac{1}{r_a}=\frac{1}{r_f}+\frac{1}{r_{air}} \quad (536)$$

As a result of the calculation, the magnetic resistance $r_a$1 in the region 1 and the magnetic resistance $r_s$1 in the region 1 are represented as follows.

$$r_a1=2.7\times10^9\ [1/(H\cdot m)]$$

$$r_s1=5.3\times10^{11}\ [1/(H\cdot m)]$$

In addition, the region 3 is the same as the region 1, and therefore the following expression are obtained as follows.

$$r_c3=2.9\times10^6\ [1/(H\cdot m)]$$

$$r_a3=2.7\times10^9\ [1/(H\cdot m)]$$

$$r_s3=5.3\times10^{11}\ [1/(H\cdot m)]$$

Next, the magnetic resistances per unit length of the respective components in the region 2 are illustrated in Table 9 below.

TABLE 9

| ITEM | UNIT | MAGNETIC CORE c | FILM GUIDE | THERMISTOR | INNER SIDE OF CONDUCTIVE LAYER | CONDUCTIVE LAYER |
|---|---|---|---|---|---|---|
| CROSS-SECTIONAL AREA | m^2 | 1.5E−04 | 1.0E−04 | 25E−05 | | |
| RELATIVE PERMEABILITY | | 1800 | | | | |
| PERMEABILITY | H/m | 2.3E−03 | 1.3E−06 | 1.3E−06 | 1.3E−06 | 1.3E−06 |
| PERMEANCE PER UNIT LENGTH | H · m | 3.5E−07 | 1.3E−10 | 3.1E−11 | 2.2E−10 | 1.9E−12 |
| MAGNETIC RESISTANCE PER UNIT LENGTH | 1/(H · m) | 2.9E+06 | 8.0E+09 | 3.2E+10 | 4.6E+09 | 5.3E+11 |

The magnetic resistance $r_c$2 of the magnetic core 2 per unit length in the region 2 is represented as follows.

$$r_c2=2.9\times10^6\ [1/(\mathrm{H\cdot m})]$$

The magnetic resistance $r_a$ per unit length in the region between the conductive layer and the magnetic core is of the combined magnetic resistance of the magnetic resistance $r_f$ per unit length of the film guide, the magnetic resistance $r_t$ per unit length of a thermistor, and the magnetic resistance $r_{air}$ per unit length of the air on the inner side of the conductive layer. Therefore, the calculation can be performed by the following expression. (537).

[Math. 19]

$$\frac{1}{r_a}=\frac{1}{r_t}+\frac{1}{r_f}+\frac{1}{r_{air}} \tag{537}$$

As a result of the calculation, the magnetic resistance $r_a$2 per unit length and the magnetic resistance $r_c$2 per unit length in the region 2 are represented as follows.

$$r_a2=2.7\times10^9\ [1/(\mathrm{H\cdot m})]$$

$$r_s2=5.3\times10^{11}\ [1/(\mathrm{H\cdot m})]$$

Since the calculation method for the region 3 is the same as the region 1, and the descriptions thereof will be omitted.

It is noted that a reason why $r_a$1=$r_a$2=$r_a$3 is established in the magnetic resistance $r_a$ per unit length in the region between the conductive layer and the magnetic core will be described. With regard to the magnetic resistance calculation in the region 2, the cross-sectional area of the temperature detection member 240 is increased, and the cross-sectional area of the air in the inner side of the conductive layer is decreased. However, since both the relative permeabilities are 1, the magnetic resistance is the same in the end irrespective of the presence or absence of the temperature detection member 240. That is, in a case were only the nonmagnetic substance is arranged in the region between the conductive layer and the magnetic core, it is sufficient for the calculation accuracy even if the calculation for the magnetic resistance is dealt with in the same manner as the air. This is because the relative permeability takes a value almost close to 1 in the case of the nonmagnetic substance. In contrast to this, in the case of a magnetic material (such as nickel, iron, or silicon steel), it is better to separately perform the calculation in the region where the magnetic material exists and in the other region.

The integration of the magnetic resistance R [A/Wb(1/H)] as the combined magnetic resistance in the generatrix direction of the conductive layer with respect to the magnetic resistance r1, r2, and r3 of the respective regions [1/(H·m)] can be calculated by the following expression (538).

[Math. 20]

$$R=\int_0^{L1} r1\,dl1+\int_{L1}^{L2} r2\,dl1+\int_{L2}^{Lp} r3\,dl1= r1(L1-0)+r2(L2-L1)+r3(LP-L2) \tag{538}$$

Therefore, the magnetic resistance Rc [H] of the core in the section from one end to the other end of the largest region through which the recording material or the image passes can be calculated by the following expression (539).

[Math. 21]

$$R_c=\int_0^{L1} r_c1\,dl1+\int_{L1}^{L2} r_c2\,dl1+\int_{L2}^{Lp} r_c3\,dl1= r_c1(L1-0)+r_c2(L2-L1)+r_c3(LP-L2) \tag{539}$$

In addition, the combined magnetic resistance Ra [H] in the region between the conductive layer in the section from one end to the other end of the largest region through which the recording material or the image passes and the magnetic core can be calculated by the following expression (540).

[Math. 22]

$$R_s=\int_0^{L1} r_s1\,dl1+\int_{L1}^{L2} r_s2\,dl1+\int_{L2}^{Lp} r_s3\,dl1= r_s1(L1-0)+r_s2(L2-L1)+r_s3(LP-L2) \tag{540}$$

The combined magnetic resistance Rs [H] of the conductive layer in the section from one end to the other end of the largest region through which the recording material or the image passes can be represented as the following expression (541).

[Math. 23]

$$R_s=\int_0^{L1} r_s1\,dl1+\int_{L1}^{L2} r_s2\,dl1+\int_{L2}^{Lp} r_s3\,dl1= r_s1(L1-0)+r_s2(L2-L1)+r_s3(LP-L2) \tag{541}$$

Results of the above-described calculation performed for the respective regions are illustrated in Table 10.

TABLE 10

| | REGION 1 | REGION 2 | REGION 3 | COMBINED MAGNETIC RESISTANCE |
|---|---|---|---|---|
| INTEGRATION STARTING POINT [mm] | 0 | 102.95 | 112.95 | |
| INTEGRATION ENDING POINT [mm] | 102.95 | 112.95 | 215.9 | |
| DISTANCE [mm] | 102.95 | 10 | 102.95 | |
| PERMEANCE pc PER UNIT LENGTH [H · m] | 3.5E−07 | 3.5E−07 | 3.5E−07 | |
| MAGNETIC RESISTANCE rc PER UNIT LENGTH [1/(H · m)] | 2.9E+06 | 2.9E+06 | 2.9E+06 | |
| INTEGRATION OF MAGNETIC RESISTANCE rc [A/Wb(1/H)] | 3.0E+08 | 2.9E+07 | 3.0E+08 | 6.2E+08 |
| PERMEANCE pa PER UNIT LENGTH [H · m] | 3.7E−10 | 3.7E−10 | 3.7E−10 | |
| MAGNETIC RESISTANCE ra PER UNIT LENGTH [1/(H · m)] | 2.7E+09 | 2.7E+09 | 2.7E+09 | |
| INTEGRATION OF MAGNETIC RESISTANCE ra [A/Wb(1/H)] | 2.8E+11 | 2.7E+10 | 2.8E+11 | 5.8E+11 |
| PERMEANCE ps PER UNIT LENGTH [H · m] | 1.9E−12 | 1.9E−12 | 1.9E−12 | |
| MAGNETIC RESISTANCE rs PER UNIT LENGTH [1/(H · m)] | 5.3E+11 | 5.3E+11 | 5.3E+11 | |
| INTEGRATION OF MAGNETIC RESISTANCE rs [A/Wb(1/H)] | 5.4E+13 | 5.3E+12 | 5.4E+13 | 1.1E+14 |

From Table 10 above, Rc, Ra, and Rs are represented as follows.

$$Rc=6.2\times10^{8}\ [1/H]$$

$$Ra=5.8\times10^{11}\ [1/H]$$

$$Rs=1.1\times10^{14}\ [1/H]$$

The combined magnetic resistance Rsa of Rs and Ra can be calculated by the following expression (542).

[Math. 24]

$$\frac{1}{R_{sa}}=\frac{1}{R_s}+\frac{1}{R_a} \qquad (542)$$

$$R_{sa}=\frac{R_a\times R_s}{R_a+R_s}$$

From the above calculation, since Rsa=5.8×10$^{11}$ [1/H] is established, the following expression (543) is satisfied,

[Math. 25]

$$0.28\times R_{sa}\geq Rc \qquad (543)$$

In this manner, in the case of the image heating apparatus having the nonuniform traverse section shape in the generatrix direction of the conductive layer, a member is divided by plural regions in the generatrix direction of the conductive layer, and the magnetic resistance is calculated for each region, so that it is sufficient that the permeance of the magnetic resistance obtained by finally combining those may be calculated. It is however noted that, in a case where the member set as the target is the nonmagnetic substance, since the permeability is almost equal to the permeability of the air, the member may be regarded as the air to perform the calculation. Next, a component to be accounted for the above-described calculation will be described. With regard to a component which exists in the region between the conductive layer and the magnetic core and at least a part of which is in the largest region through which the recording material passes (0 to Lp), the permeance or the magnetic resistance is preferably calculated. On the other hand, the permeance or the magnetic resistance does not need to be calculated with regard to a component arranged on the outer side of the conductive layer. This is because, as described above, the induced electromotive force is proportional to the time variation of the magnetic flux that perpendicularly penetrates through the circuit in accordance with Faraday's law and is irrelevant to the magnetic flux on the outer side of the conductive layer. In addition, the component arranged outside the largest region through which the recording material passes in the generatrix direction of the conductive layer does not affect the heat generation of the conductive layer, and it is therefore unnecessary to perform the calculation.

According to the present embodiment, by increasing the power conversion efficiency of the image heating apparatus according to the first to seventh embodiments, it is possible to provide the image heating apparatus having the high energy efficiency while the heat generation in the unnecessary part is suppressed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-261516, filed Dec. 18, 2013, which is hereby incorporated by reference herein in its entirety.

The invention claimed is:

1. An image heating apparatus for heating an image formed on a recording material, the image heating apparatus comprising:

a tubular rotary member including a conductive layer;

a magnetic core inserted into a hollow portion of the rotary member;

a coil helically wound around an outer side of the magnetic core and continuously extending in a range from one longitudinal end of the rotary member to the other longitudinal end of the rotary member in the hollow portion, a helical axis of the coil extending along a generatrix direction of the rotary member; and a control unit configured to control a frequency of an alternating current flowing through the coil, wherein the conductive layer generates heat by an electromagnetic induction in an alternating magnetic field formed when the alternating current flows through the coil, and wherein the control unit controls the frequency in accordance with a size of the recording material.

2. The image heating apparatus according to claim 1, wherein the control unit sets a first frequency in a case where heating processing is performed on the recording material having a first width, and sets a second frequency that is higher than the first frequency in a case where the heating processing is performed on the recording material having a second width that is wider than the first width.

3. The image heating apparatus according to claim 1, wherein a heat generation distribution of the rotary member in the generatrix direction of the rotary member has a heating value in an end portion increased with respect to a heating value in a central portion as the frequency is increased.

4. The image heating apparatus according to claim 1, wherein an end portion of the magnetic core in the generatrix direction of the rotary member is in the vicinity of an end portion of the rotary member.

5. The image heating apparatus according to claim 1, wherein the coil in the generatrix direction of the rotary member has a number of turns per unit length in an end portion higher than a number of turns per unit length in a central portion.

6. The image heating apparatus according to claim 1, wherein a magnetic resistance of the magnetic core in a section from one end to the other end of a largest region through which the image passes in the generatrix direction of the rotary member is 28% or lower of a combined magnetic resistance of a magnetic resistance of the conductive layer and a magnetic resistance in a region between the conductive layer and the core.

7. The image heating apparatus according to claim 1, wherein the control unit sets the frequency in a range from 21 kHz to 100 kHz.

8. The image heating apparatus according to claim 1, wherein, the magnetic core has a shape in which a loop is not formed outside the rotary member.

9. The image heating apparatus according to claim 1, wherein an entire region of the conductive layer is made of the same material.

10. An image heating apparatus for heating an image formed on a recording material, the image heating apparatus comprising:

a tubular rotary member including a conductive layer;

a magnetic core inserted into a hollow portion of the rotary member;

a coil helically wound around an outer side of the magnetic core and continuously extending in a range from one longitudinal end of the rotary member to the other longitudinal end of the rotary member in the hollow portion, a helical axis of the coil extending along a generatrix direction of the rotary member;

a converter configured to covert a frequency of an alternating current flowing through the coil into high-frequency; and a frequency control unit configured to control the converter to change the frequency of an alternating current flowing through the coil, and a power control unit configured to execute an on-off control of the converter to change power supplied to the coil, wherein the conductive layer generates heat by an electromagnetic induction in an alternating magnetic field formed when the alternating current flows through the coil, and wherein the frequency control unit controls the converter so as to change the frequency in accordance with the number of the recording materials on which the image is heated.

11. The image heating apparatus according to claim 10, wherein, the magnetic core has a shape in which a loop is not formed outside the rotary member.

12. The image heating apparatus according to claim 10, further comprising:

a temperature detection member configured to detect a temperature of a sheet-passing portion of the tubular rotary member, wherein the power control unit executes the on-off control of the converter so that a detection temperature of the temperature detection member is maintained at a target temperature.

13. An image heating apparatus for heating an image formed on a recording material, the image heating apparatus comprising:

a tubular rotary member including a conductive layer;

a magnetic core inserted into a hollow portion of the rotary member;

a coil helically wound around an outer side of the magnetic core and continuously extending in a range from one longitudinal end of the rotary member to the other longitudinal end of the rotary member in the hollow portion, a helical axis of the coil extending along a generatrix direction of the rotary member; and a control unit configured to control a frequency of an alternating current flowing through the coil, wherein the conductive layer generates heat by an electromagnetic induction in an alternating magnetic field formed when the alternating current flows through the coil, and wherein the control unit controls a heat generation distribution of the rotary member in the generatrix direction of the rotary member by changing the frequency.

14. The image heating apparatus according to claim 13, wherein, the magnetic core has a shape in which a loop is not formed outside the rotary member.

15. An image heating apparatus for heating an image formed on a recording material, the image heating apparatus comprising:

a tubular rotary member including a conductive layer;

a magnetic core inserted into a hollow portion of the rotary member;

a coil helically wound around an outer side of the magnetic core and continuously extending in a range from one longitudinal end of the rotary member to the other longitudinal end of the rotary member in the hollow portion, a helical axis of the coil extending along a generatrix direction of the rotary member;

a converter configured to covert a frequency of an alternating current flowing through the coil into high-frequency;

a frequency control unit configured to control the converter to change the frequency of the alternating current; and a power control unit configured to control the converter to change power supplied to the coil, wherein the conductive layer generates heat by an electromagnetic induction in an alternating magnetic field formed when the alternating current flows through the coil, and wherein the frequency control unit controls the converter to change the frequency in accordance with a size of the recording material.

16. The image heating apparatus according to claim 15, further comprising:

a temperature detection member configured to detect a temperature of a sheet-passing portion of the tubular rotary member, wherein the power control unit controls the converter so that a detection temperature of the temperature detection member is maintained at a target temperature.

17. The image heating apparatus according to claim 15, wherein the power control unit executes an on-off control of the converter to change power supplied to the coil.

18. An image heating apparatus for heating an image formed on a recording material, the image heating apparatus comprising:

a tubular rotary member including a conductive layer;

a magnetic core inserted into a hollow portion of the rotary member;

a coil helically wound around an outer side of the magnetic core and continuously extending in a range from one longitudinal end of the rotary member to the other longitudinal end of the rotary member in the hollow portion, a helical axis of the coil extending along a generatrix direction of the rotary member;

a temperature detection member configured to detect a temperature of a non-sheet passing portion of the tubular rotary member;

a converter configured to covert a frequency of an alternating current flowing through the coil into high-frequency;

a frequency control unit configured to control the converter to change the frequency of the alternating current, and a power control unit configured to control the converter to change power supplied to the coil, wherein the conductive layer generates heat by an electromagnetic induction in an alternating magnetic field formed when the alternating current flows through the coil, and wherein the frequency control unit controls the converter to change the frequency of the alternating current flowing through the coil, on a basis of a detection result of the temperature detection member.

19. The image heating apparatus according to claim 18, further comprising:

a main temperature detection member configured to detect a temperature of a sheet-passing portion of the tubular rotary member, wherein the power control unit controls the converter so that a detection temperature of the temperature detection member is maintained at a target temperature.

20. The image heating apparatus according to claim 18, wherein the power control unit executes an on-off control of the converter to change power supplied to the coil.

* * * * *